US010023941B2

(12) United States Patent
Tameda et al.

(10) Patent No.: US 10,023,941 B2
(45) Date of Patent: Jul. 17, 2018

(54) LEADLESS BRASS ALLOY EXCELLENT IN STRESS CORROSION CRACKING RESISTANCE

(71) Applicant: KITZ CORPORATION, Chiba (JP)

(72) Inventors: Hidenobu Tameda, Yamanashi (JP); Kazuhito Kurose, Yamanashi (JP); Teruhiko Horigome, Yamanashi (JP); Tomoyuki Ozasa, Yamanashi (JP); Hisanori Terui, Yamanashi (JP); Masaru Yamazaki, Nagano (JP); Hideki Kotsuji, Nagano (JP)

(73) Assignee: KITZ CORPORATION, Chiba (JP)

( * ) Notice: Subject to any disclaimer, the term of this patent is extended or adjusted under 35 U.S.C. 154(b) by 402 days.

(21) Appl. No.: 13/728,290

(22) Filed: Dec. 27, 2012

(65) Prior Publication Data

US 2013/0129561 A1 May 23, 2013

Related U.S. Application Data

(62) Division of application No. 12/448,619, filed as application No. PCT/JP2007/075329 on Dec. 28, 2007, now Pat. No. 8,366,840.

(30) Foreign Application Priority Data

| | | |
|---|---|---|
| Dec. 28, 2006 | (JP) | 2006-355610 |
| Apr. 27, 2007 | (JP) | 2007-119353 |
| Aug. 14, 2007 | (JP) | 2007-211430 |

(51) Int. Cl.
*C22C 9/00* (2006.01)
*C22C 9/04* (2006.01)
(Continued)

(52) U.S. Cl.
CPC ..... *C22C 9/04* (2013.01); *C22C 12/00* (2013.01); *C22F 1/08* (2013.01)

(58) Field of Classification Search
CPC ..... C22C 9/00; C22C 9/02; C22C 9/04; C22F 1/08
(Continued)

(56) References Cited

U.S. PATENT DOCUMENTS

| | | | | |
|---|---|---|---|---|
| 6,599,378 | B1 | 7/2003 | Hagiwara et al. | |
| 2003/0205301 | A1* | 11/2003 | Hagiwara et al. | 148/433 |

(Continued)

FOREIGN PATENT DOCUMENTS

| | | |
|---|---|---|
| EP | 0947592 | 3/2003 |
| JP | 2000-319736 | 11/2000 |

(Continued)

OTHER PUBLICATIONS

Yamazaki et al., JP Pub. No. 2005-281800 (Machine translation).*
International Search Report dated Mar. 18, 2008 in the International (PCT) Application PCT/JP2007/075329.

*Primary Examiner* — Keith Walker
*Assistant Examiner* — John A Hevey
(74) *Attorney, Agent, or Firm* — Wenderoth, Lind & Ponack, L.L.P.

(57) ABSTRACT

By enhancing a stress corrosion cracking resistance in a leadless brass alloy, specifically by suppressing a velocity of propagation of corrosion cracks in the brass alloy, a straight line crack peculiar to the leadless brass alloy is suppressed, a probability of cracks coming into contact with γ phases is heightened and local corrosion on the brass surface is prevented to suppress induction of cracks by the local corrosion, thereby providing a leadless brass alloy contributable to enhancement of the stress corrosion cracking resistance. The present invention is directed to an Sn-containing Bi-based, Sn-containing Bi+Sb-based or Sn-containing Bi+Se+Sb-based leadless brass alloy excellent in stress corrosion cracking resistance, having an α+γ structure or α+β+γ structure and having γ phases distributed uni-
(Continued)

(a)

(b)

formly therein at a predetermined proportion to suppress local corrosion and induction of stress corrosion cracks.

5 Claims, 31 Drawing Sheets

(51) Int. Cl.
*C22F 1/08* (2006.01)
*C22C 12/00* (2006.01)
(58) Field of Classification Search
USPC ..... 420/476, 477, 499, 500
See application file for complete search history.

(56) References Cited

U.S. PATENT DOCUMENTS

| | | | | |
|---|---|---|---|---|
| 2007/0039667 | A1 | 2/2007 | Kosaka et al. | |
| 2007/0158002 | A1* | 7/2007 | Oishi | 148/434 |

FOREIGN PATENT DOCUMENTS

| | | | |
|---|---|---|---|
| JP | 3303301 | | 5/2002 |
| JP | 2004-346947 | | 12/2004 |
| JP | 2004-359968 | | 12/2004 |
| JP | 2005-105405 | | 4/2005 |
| JP | 2005-281800 | | 10/2005 |
| JP | 2006-9053 | | 1/2006 |
| JP | WO2006016630 | * | 2/2006 |
| WO | 2005/093108 | | 10/2005 |

* cited by examiner (a)

(b)

| PRODUCING METHOD | METHOD A | METHOD B | METHOD C | METHOD D |
|---|---|---|---|---|
| STEP | EXTRUSION<br>↓<br>DRAWING | EXTRUSION<br>↓<br>ANNEALING FOR α-PHASE TRANSFORMATION<br>↓<br>DRAWING | EXTRUSION<br>↓<br>ANNEALING FOR α-PHASE TRANSFORMATION<br>↓<br>DRAWING<br>↓<br>STRAIN-REMOVING ANNEALING | EXTRUSION<br>↓<br>DRAWING<br>↓<br>ANNEALING FOR α-PHASE TRANSFORMATION |

(a)

(b)

(c)

(a)

(b)

(mass%)

| ANALYSIS PLACE | PHASE | Ni | Cu | Zn | Sn | Sb | Bi |
|---|---|---|---|---|---|---|---|
| ① | γ | 1 | 54 | 32 | 10 | 3 | 0 |
| ② | | 1 | 55 | 33 | 8 | 3 | 0 |
| ③ | | 1 | 52 | 32 | 12 | 3 | 0 |
| ④ | β | 1 | 57 | 41 | 1 | 0 | 0 |
| ⑤ | | 1 | 55 | 42 | 2 | 0 | 0 |
| ⑥ | α | 1 | 67 | 32 | 0 | 0 | 0 |
| ⑦ | | 1 | 68 | 31 | 0 | 0 | 0 |
| ⑧ | Bi | 0 | 9 | 4 | 0 | 0 | 87 |
| ⑨ | | 0 | 5 | 3 | 0 | 0 | 92 |

(a)

(b)

(mass%)

| ANALYSIS PLACE | PHASE | Ni | Cu | Zn | Sn | Sb | Bi |
|---|---|---|---|---|---|---|---|
| ① | Bi | 0 | 8 | 4 | 0 | 0 | 88 |
| ② | | 0 | 7 | 4 | 0 | 0 | 89 |
| ③ | γ | 1 | 51 | 32 | 13 | 3 | 0 |
| ④ | | 1 | 50 | 33 | 13 | 3 | 0 |
| ⑤ | | 1 | 52 | 31 | 13 | 3 | 0 |
| ⑥ | | 1 | 45 | 41 | 11 | 2 | 0 |
| ⑦ | α | 1 | 65 | 34 | 0 | 0 | 0 |
| ⑧ | | 1 | 64 | 35 | 0 | 0 | 0 |
| ⑨ | | 1 | 64 | 35 | 0 | 0 | 0 |

| | ×200 | ×1000 |
|---|---|---|
| No. 60<br>EVALUATION COEFFICIENT 1. 50<br>SCC time period 46. 0 |  |  |
| No. 69<br>EVALUATION COEFFICIENT 0. 78<br>SCC time period 26. 0 |  |  |
| No. 70<br>EVALUATION COEFFICIENT 0. 23<br>SCC time period 3. 3 |  |  |

LEADLESS BRASS ALLOY EXCELLENT IN STRESS CORROSION CRACKING RESISTANCE

TECHNICAL FIELD

The present invention relates to a leadless brass alloy containing Bi and exhibiting excellent stress corrosion cracking resistance and particularly to a leadless brass alloy suppressing occurrence of corrosion cracking in the brass alloy and having stress corrosion cracking resistance enhanced.

BACKGROUND ART

Generally, since brass alloys including JIS CAC 203 C3604 and C3771 are excellent in characteristics, such as corrosion resistance, machinability, mechanical properties, they have widely been used for tapwater plumbing equipment including valves, cocks and joints, and for electronic device parts. The brass alloys of this kind possibly induce stress corrosion cracks when having been exposed to a corrosion environment, such as an ammonia atmosphere, and loaded with a tensile stress. As a countermeasure for preventing stress corrosion cracking from occurring in the brass alloys, various proposals have heretofore been made.

A brass material of Patent Document 1, for example, contains 57 to 61% of Cu and 1 to 3.7% of Pb, has an Sn content of 0.35% or less, and is brass comprising two phases of α+β at normal temperature. This brass has an α-phase average grain size of 15 μm or less, a β-phase average grain size of 10 μm or less and an α-phase ratio exceeding 80% to intend to enhance the stress corrosion cracking resistance.

Patent Document 2 proposes brass having a crystalline structure of α+β+γ at normal temperature, an α-phase area ratio of 40 to 94% and respective β-phase and γ-phase area ratios of 3 to 30% at normal temperature, respective α-phase and β-phase average grain sizes of 15 μm or less and γ-phase average grain minor axis of 8 μm or less, containing 8% or more of Sn in the γ phase and having the β phase surrounded by the γ phase. This brass also intends to enhance the stress corrosion cracking resistance because of the high Sn content and contains 1.5 to 2.4 wt % of Pb.

Patent Document 1: JP-A 2006-9053

Patent Document 2: Japanese Patent No. 3303301

DISCLOSURE OF THE INVENTION

Problems the Invention Intends to Solve

However, the brass material of Patent Document 1 is applied particularly to a material for flare nuts and is not adequate to a material for tapwater plumbing equipment. This brass contains much Pb and the brass having such a high Pb content adversely affects a human body and, therefore, cannot be applied to the tapwater plumbing equipment.

In the meantime, the present inventors conducted tests under conditions under which stress corrosion cracking was generated. As a result of observing the cracking configurations of a conventional Bi-based leadless brass alloy and a conventional lead-containing brass alloy in each of which stress corrosion cracking was generated, it was clearly found in the brass stress corrosion cracking configurations that minute branched cracks were generated in the lead-containing brass, whereas a relative large crack was linearly generated in the Bi-based leadless brass (refer to FIG. 1(*a*) and FIG. 1(*b*)).

In the case of comparing a lead-containing copper alloy with a leadless copper alloy with respect to cracks generated by stress corrosion cracking, the cracks in the lead-containing brass alloy become a great number of minute cracks branched as shown in FIG. 1(*b*) and show a tendency to be difficult to propagate further in the presence of the branched cracks and to be made shallow. On the other hand, the crack in the leadless brass alloy (Bi-based leadless brass alloy, for example) becomes a single, relatively large crack as shown in FIG. 1(*a*) and, in the presence of the single crack, a phenomenon has been confirmed, in which the crack shows a tendency to propagate deeply.

What are considered as the reasons for these are that branch connection is easy to occur in the lead-containing copper alloy when distal ends of cracks have come into contact with a slip-band (the plane on which metal atoms slip in deforming metal) and produces a tendency of stress to be dispersed and that branch connection is difficult to occur on a slip-band in the Bi-based leadless copper alloy to induce a linear crack, thereby facilitating occurrence of stress concentration. Therefore, particularly in the case of the Bi-based leadless copper alloy, a countermeasure for coping with the crack different from that generated in the case of the lead-containing brass alloy is required. To be specific, it is necessary to devise a countermeasure on the surface of a material so as to prevent a crack by the stress concentration resulting from the generation of the linear crack from propagating.

On the basis of the observation results, the problem of Patent Document 2 will be touched upon. The same Document describes therein that all brass alloys are added with Pb and does not positively describe that it can cope with leadless brass alloys.

The Patent Document 2 describes therein that in the α+γ type and α+β+γ type, the stress corrosion cracking resistance has been improved utilizing the γ phase and particularly describes the area ratio, composition and size of the γ phase quantitatively. In the case of the leadless copper alloy in which a crack linearly propagates without being branched, it is the most important point how the γ phase is distributed relative to the crack-propagating direction. However, since this point is not described, the described technique is insufficient as a countermeasure for the prevention of stress corrosion cracking. That is to say, the technique is for specifying the γ phase using absolute amounts of the area ratio etc. and does not suggest the fact or technical idea that the γ phase is dispersed to prevent the linear cracking peculiar to leadless brass. Though it is conceivable that by increasing the content of Sn based on the above technique it is made possible that all the grains are surrounded by the γ phase or that the absolute amount of the γ phase in the crack-propagating direction is increased, there will be a possibility of casting defects, such as porous shrinkage cavities, being induced. This is problematic.

In addition, the copper alloy of Patent Document 2 has a plenty of Pb contained therein to precipitate a γ phase and utilizes the γ phase to enhance the stress corrosion cracking resistance. However, since the same Document 2 has a plenty of Sn added to the brass containing Pb, a decrease in stress corrosion cracking resistance has been confirmed after all as described below. To be specific, the brass products used in a test herein are materials under test a to h which have chemical component values shown in Table 1 and which are products by metallic mold casting, and a test method comprises screwing a bushing of stainless steel into a screw-processing part of each of the materials under test a to h having a nominal diameter of Rc ½ using a torque of 9.8 N·m (100 kgf·cm), exposing the resultant test materials to a 14% ammonia atmosphere and determining by visual observation the presence or absence of cracks in each test material in predetermined different lapse time periods up to 48 hours tops. An example of the test material used herein is shown in FIG. 2, and the test device used in the stress corrosion cracking test is schematically shown in FIG. 3. The chemical component values of each test material and the stress corrosion cracking results (in the stress corrosion cracking time periods) are shown in Table 1, and the time periods that elapsed up to the induction of stress corrosion cracks relative to the Sn content of each test material are shown in FIG. 48. Incidentally, the test method will be described in an evaluation criterion of the stress corrosion cracking resistance to be described later.

TABLE 1

| Material under test | Cu | Sn | Pb | P | Zn | Stress corrosion cracking time periods (hr) |
|---|---|---|---|---|---|---|
| a | 62.6 | 0.3 | 2.8 | 0.1 | Balance | 48 |
| b | 60.2 | 0.5 | 2.0 | 0.1 | Balance | 36 |
| c | 60.3 | 1.0 | 2.1 | 0.1 | Balance | 39 |
| d | 60.3 | 1.6 | 2.1 | 0.1 | Balance | 39 |
| e | 60.4 | 2.1 | 2.0 | 0.1 | Balance | 15 |
| f | 60.4 | 2.5 | 2.0 | 0.1 | Balance | 11 |
| g | 60.3 | 3.0 | 2.1 | 0.1 | Balance | 8 |
| h | 60.4 | 4.9 | 2.0 | 0.1 | Balance | 0 |

As a result, it was found that the stress corrosion cracking time period was shortened in proportion as the Sn content was increased. Consequently, since the same Document 2 cannot be expected to infallibly enhance the stress corrosion cracking resistance relative to the Pb-containing brass products, it cannot be said that the technique can be diverted to leadless brass alloys without modification.

In view of the problems mentioned above, the present invention has been developed as a result of keep studies and the object thereof is to enhance a stress corrosion cracking resistance in a leadless brass alloy and, specifically, to suppress a corrosion crack-propagating velocity in the brass alloy to thereby head off a linear crack peculiar to a leadless brass alloy, heighten a probability of the crack coming into contact with a γ phase existing in a grain boundary, prevent local corrosion on the surface of the brass and suppress formation of cracks by the corrosion, thereby providing a leadless brass alloy contributable to the enhancement of the stress corrosion cracking resistance.

Means for Solving the Problems

To attain the above object, the invention is directed to an Sn-containing Bi-based, Sn-containing Bi+Sb-based or Sn-containing Bi+Se+Sb-based leadless brass alloy excellent in stress corrosion cracking resistance, having an α+γ structure or α+β+γ structure and having γ phases distributed therein at a predetermined proportion to suppress a velocity of corrosion cracks propagating therein and enhance the stress corrosion cracking resistance.

Further, the invention is directed to the leadless brass alloy excellent in stress corrosion cracking resistance, wherein a ratio of each of the γ phases to grains when the γ phases surround the grains is a grain-surrounding γ phase ratio, and a grain-surrounding average γ phase ratio that is an average value of grain-surrounding γ phase ratios is 28% or more to secure the predetermined proportion.

Further, the invention is directed to the leadless brass alloy excellent in stress corrosion cracking resistance, wherein the number of the γ phases existing in unit length in a vertical direction of a stress load when the load is exerted onto the alloy is the number of contacting γ phases, and the number of contacting γ phases calculated from an average value and a root-mean-square deviation of the number of contacting γ phases is two or more to secure the predetermined proportion.

Further, the invention is directed to the Sn-containing Bi+Sb-based or Sn-containing Bi+Se+Sb-based leadless brass alloy excellent in stress corrosion cracking resistance, wherein the γ phases contain the Sb as a solute.

Further, the invention is directed to an Sn-containing Bi-based, Sn-containing Bi+Sb-based or Sn-containing Bi+Se+Sb-based leadless brass alloy excellent in stress corrosion cracking resistance, having an α+γ structure or α+β+γ structure and having γ phases distributed uniformly therein at a predetermined proportion to suppress local corrosion and induction of stress corrosion cracks.

Further, the invention is directed to a leadless brass alloy excellent in stress corrosion cracking resistance, wherein evaluation means required for having the γ phases distributed uniformly is led to as an evaluation coefficient shown below to evaluate a degree of influence of a stress corrosion cracking resistance in the leadless brass alloy, and the evaluation coefficient is at least 0.46.

(Evaluation Coefficient)

Influence of rod material diameter×Influence of temperature for α-phase transformation×Influence of heat treatments performed before and after drawing=a/32 (1+|470−t|/100)×(0.6 to 0.9 when performing drawing)×(0.3 or less and not including 0 when performing heat treatments before and after drawing), wherein a stands for a rod material diameter and t for a temperature for α-phase transformation.

Further, the invention is directed to the leadless brass alloy excellent in stress corrosion cracking resistance, wherein a degree of influence of drawing is 0.8, and the invention is also directed to the leadless brass alloy excellent in stress corrosion cracking resistance, wherein a degree of influence of heat treatments performed before and after drawing is 0.3.

Further, the invention is directed to the leadless brass alloy excellent in stress corrosion cracking resistance, wherein the γ phases are uniformly distributed as anodes and maintains a balance relative to α phases that become cathodes to suppress the local corrosion.

Further, the invention is directed to the leadless brass alloy excellent in stress corrosion cracking resistance, wherein when a predetermined range of a degree of dispersion of the γ phases in the alloy is defined as a degree of dispersion of intervening phases, a degree of perfect circularity of the γ phases in the alloy as a degree of circularity of the intervening phases, a ratio of a longitudinal length of the α phase a lateral length thereof as an α-phase aspect ratio, the degree of dispersion of intervening phases/(the degree of circularity of the intervening phases×the α-phase aspect ratio) as a parameter X showing a state of uniform dispersion of the γ phases, and a time period until the alloy is fractured by tensile stress corrosion in the parameter X as a fracture time period Y, the alloy satisfies relational expressions of $X \geq 0.5$ and $Y \geq 135.8X-19$.

Further, the invention is directed to the leadless brass alloy excellent in stress corrosion cracking resistance, wherein the alloy is in a corrosion state in which a ratio of a maximum corrosion depth from a predetermined range of an alloy surface after corrosion to an average corrosion depth in the predetermined range becomes 1 to 8.6.

Further, the invention is directed to the leadless brass alloy excellent in stress corrosion cracking resistance, wherein when a value obtained by dividing a root-mean-square deviation of a predetermined range of corrosion depth by an average corrosion depth in the predetermined range is defined as a variation coefficient, the alloy assumes a corrosion configuration in which the variation coefficient is 1.18 or less.

Further, the invention is directed to leadless brass alloy excellent in stress corrosion cracking resistance, wherein the alloy contains 59.5 to 66.0 mass % of Cu, 0.7 to 2.5 mass % of Sn, 0.5 to 2.0 mass % of Bi and the balance of Zn and impurities.

Further, the invention is directed to the leadless brass alloy excellent in stress corrosion cracking resistance, wherein the alloy further contains 0.05 to 0.6 mass % of Sb, and the invention is also directed to the leadless brass alloy excellent in stress corrosion cracking resistance, wherein the alloy further contains 0.01 to 0.20 mass % of Se.

EFFECTS OF THE INVENTION

According to the invention, the velocity of propagation of corrosion cracks in a brass alloy is delayed and the propagation of a linear crack peculiar to a leadless brass alloy is delayed to enable the provision of a leadless brass alloy enhanced in stress corrosion cracking resistance.

According to the invention, by setting the grain-surrounding average ratio of γ phases exiting grain boundaries to be 28% or more, in the case of a stress loading direction being unspecified, i.e. in the case of a crack propagating direction being unspecified, a probability of cracks coming into contact with the γ phases becomes high and the velocity of propagation of corrosion cracks is delayed to suppress induction of cracks peculiar to a Bi-containing leadless brass alloy, thereby making it possible to provide a brass alloy capable of enhance the stress corrosion cracking resistance of the Bi-containing leadless brass alloy.

According to the invention, since the alloy has two or more contacts by the γ phases, by distributing the γ phases in the alloy structure in a direction perpendicular to a stress loading direction and causing a variation in distribution of the γ phases in a direction parallel to the stress loading direction to be within a constant range, in the case of the stress loading direction being specified, i.e. in the case of the crack-propagating direction being specified, it is possible to provide a brass alloy excellent in stress corrosion cracking resistance capable of remarkably improving the stress corrosion cracking resistance of a Bi-containing leadless brass alloy through heightening a probability of corrosion cracks coming into contact with the γ phases and delaying a velocity of propagation of cracks particularly irrespective of a numerical number of the grain-surrounding average γ phase ratio.

According to the invention, by containing Sb in the γ phases as a solute, it is possible to obtain a brass alloy excellent in stress corrosion cracking resistance and capable of securing the stress corrosion cracking resistance the same as or more than that of a lead-containing brass alloy, such as a lead-containing 6/4 brass.

According to the invention, since the γ phases that become sections to be preferentially corroded are uniformly dispersed in the alloy structure, it is possible to obtain a leadless brass alloy excellent in stress corrosion cracking resistance and capable of enhancing the stress corrosion cracking resistance through suppression of local corrosion, alleviation of a stress concentration and suppression of induction of cracks reaching stress corrosion cracks.

According to the invention, since it is possible to obtain high correlation between the evaluation coefficient and the stress corrosion cracking resistance, a leadless brass alloy enhanced in stress corrosion cracking resistance can optimally be designed.

According to the invention, since it is possible to use a proper criterion numerical value as a criterion, it is possible to obtain high correlation between the evaluation coefficient and the stress corrosion cracking resistance and, since a leadless brass alloy can optimally be designed, it is possible to obtain a leadless brass alloy excellent in stress corrosion cracking resistance.

According to the invention, local corrosion is suppressed to obtain a general corrosion state and alleviate a stress concentration, thereby enabling the contribution of enhancement of a stress corrosion cracking resistance.

According to the invention, it is possible to express a uniform dispersion state of γ phases in an alloy structure using a parameter and, by controlling the parameter, it is possible to provide a leadless brass alloy excellent in stress corrosion cracking resistance.

According to the invention, it is possible to obtain a brass alloy excellent in stress corrosion cracking resistance through quantification of a desirable corrosion state into a numerical number and production on the basis of the numerical number and, furthermore, a corrosion depth can be adjusted with high precision to infallibly suppress local corrosion and enable the formation of a general corrosion state, thereby enabling excellent stress corrosion resistance to be obtained.

According to the invention, since the alloy is an Sn-containing Bi-based leadless brass alloy having an α+γ structure or α+β+γ structure, it is possible to provide a brass alloy excellent in stress corrosion cracking resistance.

According to the invention, since the alloy is an Sn-containing Bi+Sb-based or Sn-containing Bi+Se+Sb-based leadless brass alloy having an α+γ structure or α+β+γ structure, it is possible to provide a brass alloy excellent in stress corrosion cracking resistance.

BRIEF DESCRIPTION OF THE DRAWINGS

FIG. 1(*a*) is an enlarged photograph showing a typical cracking state of a Bi-based leadless brass alloy. FIG. 1(*b*) is an enlarged photograph showing a typical cracking state of a lead-containing brass alloy.

FIG. 9(*a*) is a schematic view showing the measurement place of the test material. FIG. 9(*b*) is an enlarged view of a part A.

FIG. 19(*b*) is an explanatory view showing a composition at an analysis place indicated by a numeral.

FIG. 21(*b*) is an explanatory view showing a composition at an analysis place indicated by a numeral.

FIG. 34(*a*) is a cross section showing an overall corrosion state. FIG. 34(*b*) shows local corrosion states in cross section.

FIG. 46(*a*) is a plan view of the tensile test piece. FIG. 46(*b*) is a front view of the tensile test piece.

BEST MODE FOR CARRYING OUT THE INVENTION

Figure 1:
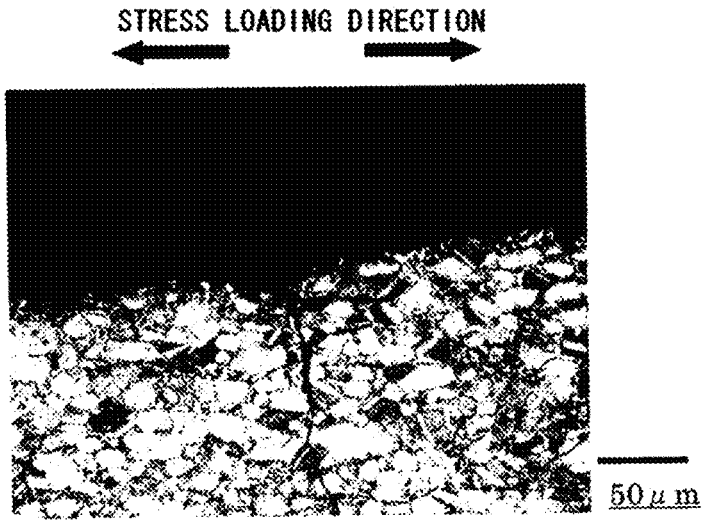
FIG. 1 shows enlarged photographs depicting the states of cracks in brass alloys.
Figure 1:
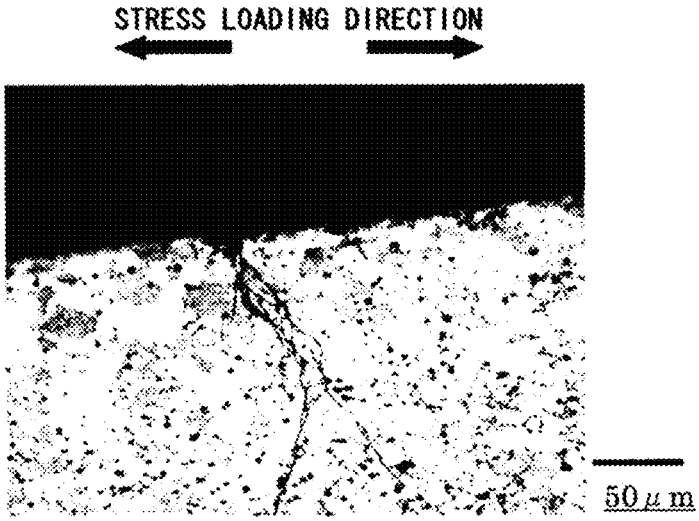

A preferred embodiment of a leadless brass alloy in the first invention will be described. A Bi-containing leadless brass alloy shown in FIG. 1(*a*) has a linear corrosion crack and, as described in detail below, it is made possible to enhance the stress corrosion cracking resistance through suppressing a corrosion crack-propagating velocity as much as possible.

The brass alloy in the first invention is a Bi-containing leadless brass alloy (particularly, 6/4 brass) having Sn contained therein to form an α+γ structure or α+β+γ structure in which the γ phase precipitated is distributed based on a constant rule to fulfill an excellent stress corrosion cracking resistance.

The constant rule for the γ phase comprises defining the ratio of the γ phase to grains when the γ phase has surrounded the grains in the alloy structure of the brass alloy as a grain-surrounding γ phase ratio, defining an average value of the grain-surrounding γ phase ratios as a grain-surrounding average γ phase ratio, deriving a correlation between the grain-surrounding average γ phase ratio and the stress corrosion cracking resistance in this embodiment and confirming from the correlation a grain-surrounding average γ phase ratio capable of having satisfied a predetermined stress corrosion cracking time period, which has been found to be 28% or more. Thus, it has been derived that the grain-surrounding average γ phase ratio in this brass alloy is 28% or more.

In addition, another constant rule for the γ phase comprises supposing γ phases with which stress corrosion cracks induced when a stress load has been exerted on the brass alloy in the first invention come into contact, defining the number of the γ phases existing in a unit length in the longitudinal direction of the stress load as the number of contacting γ phases, defining a numerical number calculated from an average value of the number of contacting γ phases and root-mean-square deviation as the number of contacts by the γ phases, deriving a correlation between the number of contacts by the γ phases and the stress corrosion cracking time period in the embodiment and confirming from the correlation the number of contacts by the γ phases having satisfied a predetermined stress corrosion cracking time period, which has been found to be two or more. Thus, it has been derived that the number of contacts by the γ phase in the brass alloy is two or more.

In view of the above, detailed definitions of the grain-surrounding average γ phase ratio and the number of contacts by the γ phase in the embodiment will be described in addition to an embodiment for deriving these numerical numbers. Preparatory to this description to be made, however, a brass alloy having an evaluation criterion necessary for comparing the leadless brass alloy in the first embodiment with the stress corrosion cracking resistance performance, elements and composition ranges of the brass alloy will be described along with the stress corrosion cracking resistance the brass alloy can fulfill.

(Evaluation Criterion of Stress Corrosion Cracking Resistance)

In describing the stress corrosion cracking resistance the brass alloy can fulfill, an evaluation criterion for comparing its performance is needed. For this reason, first, five kinds of lead-containing 6/4 brass alloy rods generally used widely and exhibiting slightly less problems of stress corrosion cracks are used to set the evaluation criterion.

Figure 2:
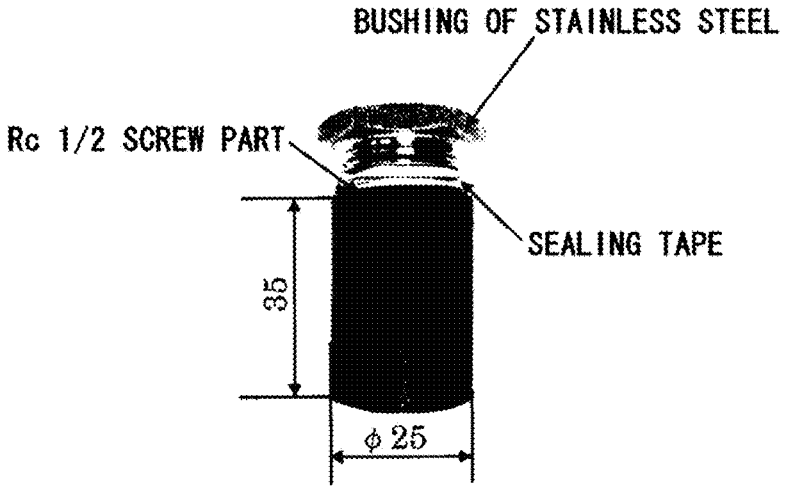
FIG. 2 is an external view of a material under test.
Figure 3:
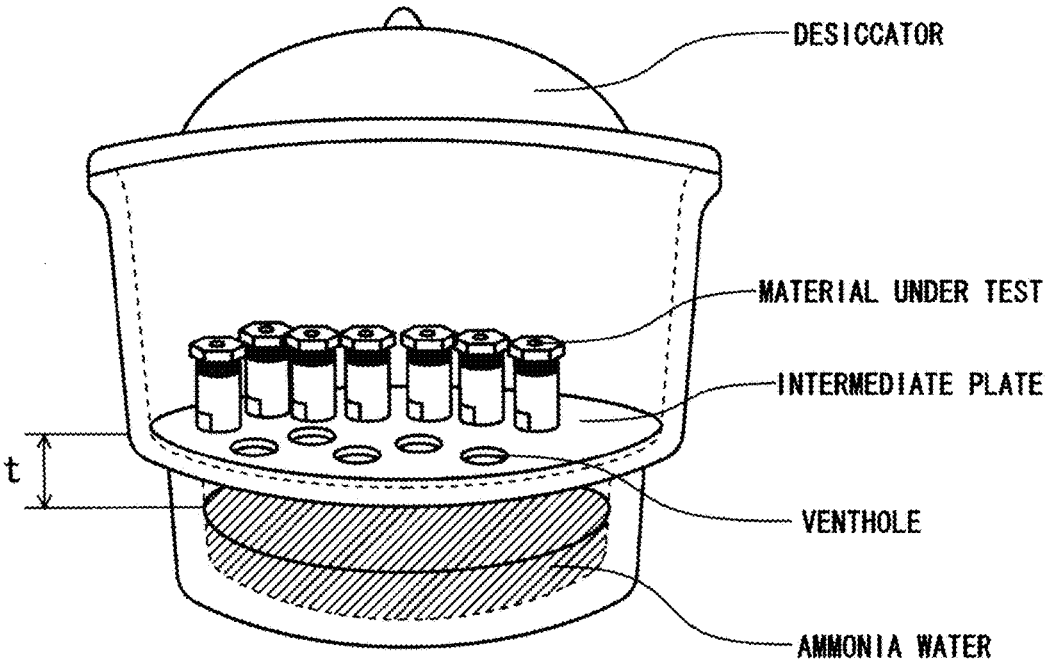
FIG. 3 is a schematic view showing a test device used in a stress corrosion crack test.

The method of the stress corrosion cracking test conducted in the present embodiment comprises screwing a stainless steel bushing (hollow male screw part) in an Rc ½ screw part (hollow female screw part) of each of the test materials a to e using a torque of 9.8 N·m (100 kgf·cm) as shown in FIG. 2, exposing the resultant test materials to a 14% ammonia atmosphere, extracting from a desiccator and washing each test material in prescribed lapse time periods up to the test time period of 48 hours tops (4, 8, 12, 24, 36 and 48 hours). To be specific, as shown in FIG. 3, 2 l, of ammonia water having a concentration of 14% is accommodated in the bottom of the desiccator having accommodated therein an intermediate plate having an outside diameter of 300 mm, and cylindrical test materials are disposed on the upper surface of the intermediate plate. The test materials are disposed, with the sides having the hollow bushings screwed therein directed upward, and accommodated in the desiccator so that the ammonia gas may come into contact with the interiors of the test materials via ventholes formed in the intermediate plate. Incidentally, a distance t between the upper surface of the ammonia water and the intermediate plate is about 100 mm, and the test materials are in a state of non-contact with the ammonia water.

Here, it has been known that stress corrosion cracks are generally induced as a result of a concurrent effect of three factors that are a material variable, an environmental factor and a stress factor, and the mechanism thereof is complicated. For this reason, in performing the stress corrosion cracking test, since influences of material, processing, stress load and test environment possibly induce variations in test results, tests were conducted, with attention paid to test conditions to be as identical as possible. The chemical components (mass %) of 6/4 brass rods (test materials i to m) used for setting the evaluation criterion and the stress corrosion cracking time periods (hr) in the test materials are shown in Table 2.

TABLE 2

| | Cu | Pb | Fe | Sn | Ni | P | Zn | Stress corrosion cracking time period (hr) |
|---|---|---|---|---|---|---|---|---|
| Test material i | 59.4 | 3.1 | 0.1 | 0.3 | 0.1 | 0.1 | Balance | 48 |
| Test material j | 62.6 | 2.8 | 0.1 | 0.3 | 0.1 | 0.1 | Balance | 12 |
| Test material k | 61.3 | 1.9 | 0.1 | 1.1 | 0.1 | 0.1 | Balance | 24 |
| Test material l | 59.4 | 1.8 | 0.2 | 0.3 | 0.1 | 0.0 | Balance | 12 |
| Test material m | 61.5 | 1.8 | 0.1 | 1.1 | 0.1 | 0.1 | Balance | 36 |

Figures 4, 5:
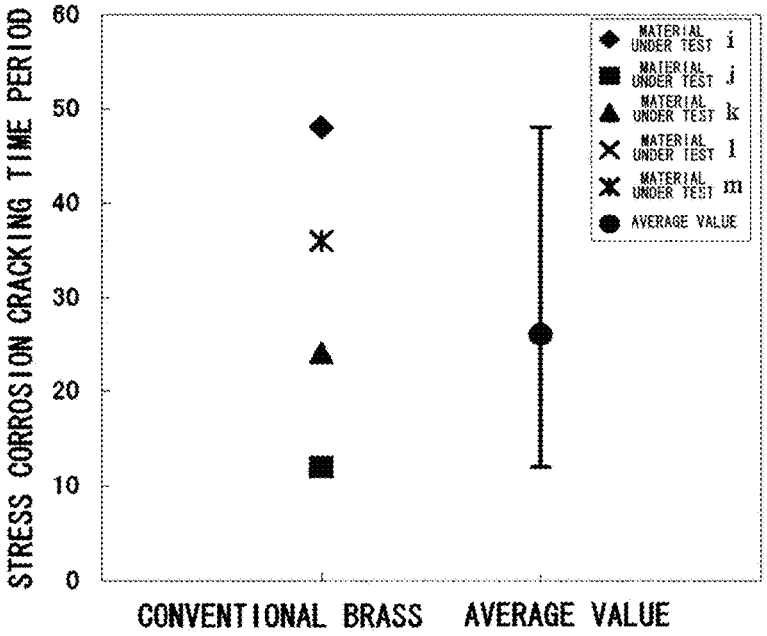
FIG. 4 is a graph showing results of stress corrosion cracking time periods of test materials used for determining evaluation criteria.
FIG. 5 is an explanatory view showing methods for producing rod materials produced from billets of brass alloy.

This test was performed, with the maximum test time period set to be 48 hours, and the graphed results of stress corrosion cracking time periods obtained from Table 2 are shown in FIG. 4. Though the shortest stress corrosion cracking time period was 12 hours in the test materials j and l, since few stress corrosion cracks were induced in the actual products having the same components as these test materials in the past results of use, the time period of 12 hours was adopted as a criterion B in the present invention and, as a more preferable criterion A, the time period of 26 hours that is the average time period in the test materials i to m was adopted.

Here, the elements and desirable composition ranges of the Bi-containing leadless brass alloy in the first invention and the reasons for these will be described. As described above, the cracking configuration of the lead-containing brass alloy by the stress corrosion cracking is such that a minute crack is branched into a large number of cracks and does not further propagate. On the other hand, in the leadless brass alloy, a single relatively large crack propagates deeply due to the stress concentration. That is to say, the cracking configurations of the conventional lead-containing brass alloy and leadless brass alloy by stress corrosion cracking are basically different as shown in FIG. 1(*a*) and FIG. 1(*b*) and, particularly, taking a countermeasure for delaying the cracking propagation is inevitably needed for the stress corrosion cracking resistance of the leadless brass alloy.

Sn: 0.7 to 2.5 mass %

Though Sn is widely known as an element capable of enhancing dezincification corrosion resistance and erosion-and-corrosion resistance, it is an inevitable element in the first invention to be contained so as to contribute mainly to the enhancement of the stress corrosion cracking resistance. The Sn content enables γ phases to be precipitated and distributed in an alloy structure on the basis of the rule to be described in detail later to suppress the stress corrosion crack in the alloy from propagating.

In order to satisfy the criterion B (12 hours) of the stress corrosion cracking resistance, the effective Sn content is 0.7 mass % or more as shown above and, to further satisfy the criterion A (26 hours), the effective Sn content is 1.0 mass % or more (1.1 mass % or more with further certainty). On the other hand, since an excess content of Sn induces defects (porous shrinkage cavities) in a cast, the Sn content is preferably 2.5 mass % or less in order to acquire the stress corrosion cracking resistance suppressing the content and satisfying the criterion A. In addition, since the excess content of Sn deteriorates cuttability or mechanical properties (elongation in particular), the Sn content is preferably 2.0 mass % or less.

Sb: 0.05 to 0.60 mass %

Sb is an element capable of enhancing the dezincification resistance of a brass alloy and, in the first invention, is added besides Sn in the case where it is intended to further enhance the stress corrosion cracking resistance. In the case of a Bi+Sb-based or Bi+Se+Sb-based brass alloy containing Sn and having an α+γ structure or an α+β+γ structure, Sb is an inevitable element and, in other cases, it is an optional element. In an initial corrosion stage, since a surface layer containing γ phases having Sb contained therein as a solute exhibits an entirely corroded configuration, it is possible to suppress the induction of a crack resulting in a stress corrosion crack. In addition, Sb contained in the γ phases as the solute enables the hardness of the γ phases to be increased and, even when a crack has been induced, enables crack propagation to be suppressed.

The effective content of Sb for enhancing the stress corrosion cracking resistance, on the premise of the content of Sn in the range of 0.7 to 2.5 mass %, is 0.05 mass % or more (0.06 mass % or more with further certainty). On the other hand, since an excess content of Sb decreases the stress corrosion cracking resistance after all, the desirable upper limit of the Sb content for acquiring the stress corrosion cracking resistance suppressing the content and satisfying the criterion B (12 hours) is 0.60 mass % (0.52 mass % with further certainty). In addition, in order to infallibly satisfy the criterion A (26 hours), the optimum Sb content is in the range of 0.06 to 0.21 mass %. Incidentally, in the case of further considering the dezincification resistance, it is optimum that the Sb content capable of satisfying the dezincification resistance and stress corrosion cracking resistance (criterion A) and being suppressed to an extent of necessity minimum is in the range of around 0.08 to 0.12 mass % because of the fact that the Sb content of 0.08 mass % could suppress the ISO maximum dezincification depth to 10 μm or less and that the more Sb content showed saturation of the suppressing effect.

Cu: 59.5 to 66.0 mass %

On the premise of acquiring an alloy allowing the γ phases to be precipitated in the presence of Sn and comprising an α+γ structure or α+β+γ structure, Cu is an inevitable element and the necessary content thereof is 59.5 mass % or more. The effective Cu content for satisfying the criterion B (12 hours) of the stress corrosion cracking resistance is 59.5 mass % or more (59.6 mass % or more with further certainty), and the effective Cu content for satisfying the criterion A (26 hours) is 60.0 mass % or more (60.6 mass % or more with further certainty). On the other hand, since an excess amount of Cu decreases the stress corrosion cracking resistance after all, it is better that the upper limit of the Cu content is 66.0% (65.3 mass % with further certainty).

Bi: 0.5 to 2.0 mass %

Bi is an inevitable element to be contained for enhancing the cuttability. The necessary content of Bi to acquire the same cuttability as that of an ordinary leadless brass is 0.5 mass % or more. On the other hand, since an excess content of Bi lowers the tensile strength and elongation, the preferable content of Bi is 2.0 mass % or less. Incidentally, as one of the factors inducing stress corrosion cracks to be solved by the present invention, a residual stress can be cited and, a technique for suppressing the induction of stress corrosion cracks by converting the residual stress from a tensile stress to a compression stress has been known. As a result of measuring the residual stress of the test material (Rc ½ screw-working part) formed by a cutting process, it was found that the residual stress could be converted to a compression stress in the presence of Bi, the content of which was 0.7 mass % or more. When setting much store on the stress corrosion cracking resistance, therefore, the Bi content is preferably in the range of 0.7 to 2.0 mass %.

Se: 0.00 to 0.20 mass %

Se exits in an alloy in the form of ZnSe and CuSe and is an optional element to be contained for the purpose of enhancing the cuttability because it serves as a chip breaker. The content of Se together with the content of Bi is effective for acquiring the same cuttability as that of an ordinary leadless brass, and the infallibly effective content of Se is 0.01 mass %. While the cuttability is enhanced in proportion as the content of Se increases, since an excess content of Se lowers the tensile strength, the content of Se should be 0.20 mass % or less. In addition, according to Examples described later, since coexistence of Sn and Se enables the stress corrosion cracking resistance to be enhanced, Se is an inevitable element to be contained for further enhancing the stress corrosion cracking resistance. However, since Se contained even in an excess amount hits a peak of its effect, the upper limit thereof when setting much store on the stress corrosion cracking resistance is set to be 0.09 mass %. Incidentally, even when the Se content has been made small (0.03 mass % or more) through the recycle of a leadless brass alloy, the stress corrosion cracking resistance is enhanced.

ZnSe or CuSe that is an intermetallic compound exists on grain boundaries and, due to its hardness, can effectively suppress the propagation of stress corrosion cracks of an alloy similarly to γ phases precipitated in the presence of Sn.

As a concrete example, a test material (rod material) was produced in accordance with a method B shown in FIG. 5 using a billet 2 shown in Table 3 shown later, and the α phase and intermetallic compound ZnSe were tested for micro-Vickers hardness at five places, respectively. The average value of the α phase was 81 and that of the ZnSe was 103, from which it was clear that the ZnSe was harder than the α phase. Therefore, by precipitating the metallic compound containing Se in addition to the γ phases, it is possible to further suppress the propagation of the cracks.

Ni: 0.05 to 1.5 mass %

Ni is an optional element to be contained for enhancing the tensile strength. Though the Ni content of 0.05 mass % exhibits its effectiveness, since an excess Ni content shows saturation of the effectiveness, the upper limit thereof is set to be 1.5 mass %. In addition, Ni in the case of an alloy containing Se is the element for enhancing the yield of the Se. The preferable content of Ni for enhancing the yield of the Se is in the range of 0.1 to 0.3 mass %.

P: 0.05 to 0.2 mass %

P is an inevitable element to be contained in an alloy containing no Sb for enhancing the dezincification resistance. The P content of 0.05 mass % or more is effective. While the dezincification resistance is enhanced with an increase of the P content, since the tensile strength is lowered, the upper limit of the P content is set to be 0.2 mass %. Incidentally, in an alloy containing Sb, P is an optional element and is added for further enhancing the dezincification resistance.

Unavoidable Impurities: Fe, Si, Pb and Mn

As unavoidable impurities in the embodiment of the brass alloy according to the present invention, Fe, Si, Pb and Mn can be cited. When an alloy contains these elements, due to precipitation of hard intermetallic compounds, adverse effects that the cuttability of the alloy is lowered and that an exchange frequency of a cutting tool is increased are induced. Therefore, 0.1 mass % or less of Fe, 0.1 mass % or less of Si, 0.25 mass % or less of Pb and 0.03 mass % or less of Mn are treated as the unavoidable impurities lightly affected on the cuttability. As other unavoidable impurities, 0.1 mass % or less of As, 0.03 mass % or less of Al, 0.01 mass % or less of Ti, 0.1 mass % or less of Zr, 0.3 mass % or less of Co, 0.3 mass % or less of Cr, 0.1 mass % or less of Ca and 0.1 mass % or less of B can be cited.

The Bi-containing leadless brass alloy of the present invention is configured based on the above elements. The compositions of the representative alloys are as follows (The unit of the component ranges is mass %. Sb and Se may be optional components for any purpose).

(Alloy 1: "Alloy Satisfying Evaluation Criterion B (12 h) of Stress Corrosion Cracking Resistance")

Sn: 0.7 to 2.5
Sb: 0.06 to 0.60
Cu: 59.5 to 66.0
Bi: 0.5 to 2.0
Se: $0<Se\leq 0.20$
Balance: Zn and unavoidable impurities (Alloy 2: "Optimum Alloy Satisfying Evaluation Criterion A (26 h) of Stress Corrosion Cracking Resistance")

Sn: 1.0 to 2.5
Sb: 0.08 to 0.21
Cu: 60.0 to 66.0
Bi: 0.7 to 2.0
Se: 0.03 to 0.09
Balance: Zn and unavoidable impurities Next, in the brass alloys containing the aforementioned elements, the relation between the γ phases distributed in the alloy structures in accordance with a constant rule and the stress corrosion cracking resistance, specifically the relation between the grain-surrounding average γ phase ratio and the stress corrosion cracking resistance and the relation between the number of contacts by the γ phase and the stress corrosion cracking resistance, will be described. Here, the γ phase in the alloy of the present invention is composed mainly of Cu, Zn and Sn or Cu, Zn, Sn and Sb and precipitated in the boundaries of the grains formed by the α phases or β phases (each composed mainly of Cu and Zn). Since the γ phase is harder than the α phase, when the distal ends of stress corrosion cracks propagating in the alloy structure have come into contact with the γ phase, it is possible to delay the crack-propagating velocity. Therefore, by increasing the amount of the γ phase or varying the γ phase, it is possible to heighten the probability of cracks coming into contact with the γ phase to enable the stress corrosion cracking resistance of the alloy to be enhanced.

Therefore, the amount and variation (collectively called "distribution") of the γ phase have been specified using indices "the grain-surrounding average γ phase ratio" and "the number of contacts by the γ phase". The detailed definitions of "the grain-surrounding average γ phase ratio" and "the number of contacts by the γ phase" and the correlation thereof to the stress corrosion cracking resistance will be described.

EXAMPLE 1

First, an example showing the relation between the grain-surrounding average γ phase ratio and the stress corrosion cracking resistance will be described in detail. The "grain-surrounding average γ phase ratio" is defined by the following formula based on the average value of data obtained by measuring the circumferential length of the grain boundary (grain boundary of the grains (α phase)) and the length of the γ phase existing on the circumference at an optional section of an alloy and performing the measurement plural times.

$$\text{Grain-surrounding average } \gamma \text{ phase ratio}[\%]=(\gamma \text{ phase length/grain boundary circumferential length})\times 100 \quad \text{[Formula 1]}$$

The "grain-surrounding average γ phase ratio" means showing the percentage of the γ phase being annularly distributed in the grain boundary. Therefore, the higher the "grain-surrounding average γ phase ratio", the higher the probability of cracks coming into contact with the γ phase is. In addition, since the ratio shows the percentage of the γ phase being annularly distributed, in the case of failing to specify the stress load direction, i.e. the crack direction, it is an appropriate index as a value showing the γ phase distribution necessary for suppressing the cracks from propagating.

Next, the relation between the "grain-surrounding average γ phase ratio" and the stress corrosion cracking resistance will be described based on the actually measured data. Rod materials were produced from billets 1 to 3 having the same composition using three kinds of producing methods and tested for the stress corrosion cracking resistance. In addition, the grain-surrounding γ phase ratio that was the percentage of the γ phase surrounding the grains was analyzed from a microstructure, and the correlation thereof relative to the stress corrosion cracking resistance was acquired. The component values of the billets used in the test are shown in Table 3. The billets had three kinds of different compositions for comparison. In addition, the methods for producing rod materials from the billets are shown in FIG. 5. In the figure, producing method A comprises extruding the billets without any subsequent heat treatment, producing method B comprises extruding the billets and then performing heat treatment for α-phase transformation for the purpose of exhibiting dezincification corrosion resistance, producing method C comprises extruding the billets, then performing heat treatment heat treatment for α-phase transformation and performing strain-removing annealing for enhancing elongation, and producing method D comprises extrusion, drawing and annealing. Incidentally, the test materials were rod materials having a diameter of about 35 mm, and the annealing conditions included a temperature in the range of 300 to 500° C. and a period in the range of about 2 to 4 hours.

TABLE 3

| Quality of Material | Cu | Sn | Bi | Se | Ni | P | Sb | Zn |
|---|---|---|---|---|---|---|---|---|
| Billet 1 | 60.4 | 1.5 | 1.3 | 0.03 | 0.2 | 0.1 | 0.00 | Balance |
| Billet 2 | 60.4 | 1.6 | 1.4 | 0.03 | 0.2 | 0.0 | 0.08 | Balance |
| Billet 3 (Comp. Ex.) | 61.9 | 2.0 | 1.9 | 0.04 | 0.2 | 0.1 | 0.00 | Balance |

Next, the rod materials produced from the billets 1 to 3 of different components produced using different methods A, B and C as shown in Table 4 are assigned as test materials 1 to 6 in which the relations between the grain-surrounding average γ phase ratios (%) and the stress corrosion cracking time periods (hr) measured by the experiments are compared. The grain-surrounding γ phase ratio is calculated by taking a microstructure photograph with an optical microscope with a magnification of 1000 (100 μm×140 μm), measuring on a computer the circumferential length of the grains (grain boundary length) and the length of the γ phase existing on the grain boundary, and using Formula 1.

TABLE 4

| Quality of material | Producing Method | No. of test material | Grain-surrounding average γ phase ratio (%) | Stress corrosion cracking time period (hr) |
|---|---|---|---|---|
| Billet 1 | Method A | 1 | 63 | 43 |
| | Method B | 2 | 48 | 28 |
| Billet 2 | Method A | 3 | 71 | 46 |
| | Method B | 4 | 47 | 32 |
| | Method C | 5 | 49 | 26 |
| Billet 3 | Method C | 6 | 20 | 4 |

Figure 6:
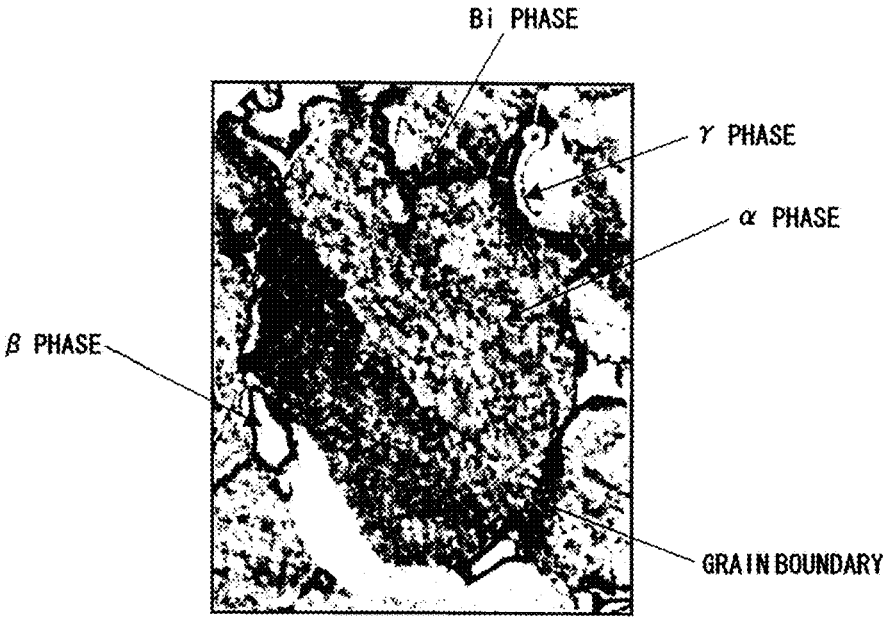
FIG. 6 shows enlarged photographs showing the microstructures of rod materials.
Figure 6:
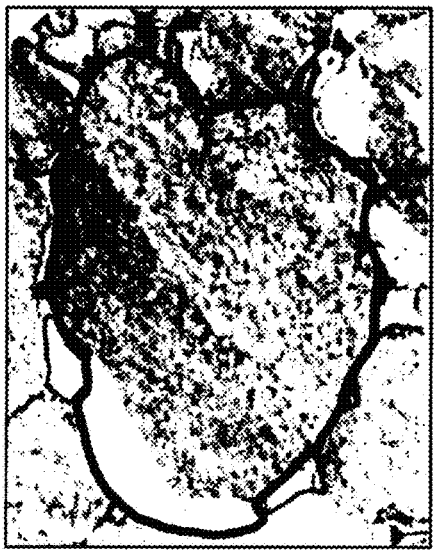
Figure 6:
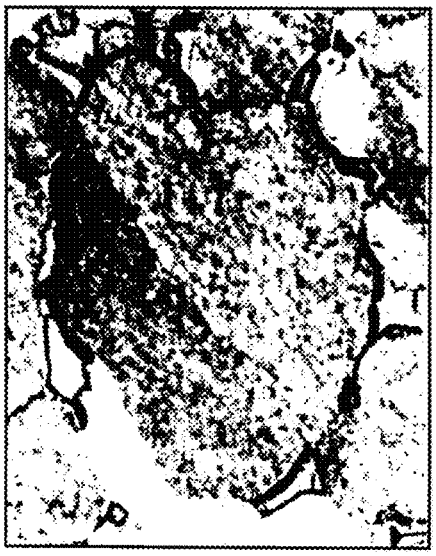

FIG. 6 shows an example of the microstructure photograph taken at this time. FIG. 6(*a*) represents an explanation of the structure in the photograph. In FIG. 6(*b*), the circumference of the grain boundary is shown by a heavy line and, in FIG. 6(*c*), the length of the γ phase is shown by a heavy line. In FIG. 6(*b*) and FIG. 6(*c*), the circumferential length of the grain boundary (grain boundary length) and the length of the γ phase (length of the γ phase on the grain boundary) are measured, and the measured values are plugged into Formula 1 to calculate the grain-surrounding γ phase ratio that is the percentage of the γ phase relative to the grains when the γ phase has surrounded the grains. The ratios are measured through optional selection of 20 grains in a sheet of microstructure photograph, and the average value thereof is used as the grain-surrounding average γ phase ratio of the alloy. The grain-surrounding average γ phase ratio of each test material obtained by this method and the stress corrosion cracking time period are shown in Table 4. In addition, a graph showing the relation between the grain-surrounding average γ phase ratio of each and the stress corrosion cracking time period is shown in FIG. 7.

Figure 7:
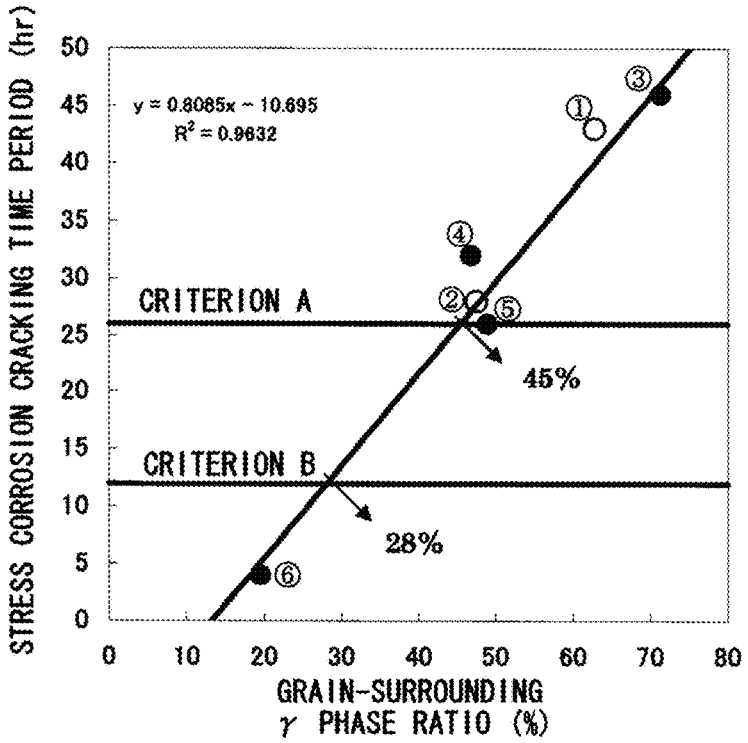
FIG. 7 is a graph showing the relation between the grain-surrounding average γ phase ratio and the stress corrosion cracking time period of the brass alloy of the present invention.

FIG. 7 shows that the grain-surrounding average γ phase ratio and the stress corrosion cracking time period have a substantially straight line relation and a tendency that the stress corrosion cracking time period becomes long in proportion as the grain-surrounding γ phase ratio increases. In addition, it was found from relational expressions ($y=0.8085x-10.695$, $R^2=0.9632$) shown in the figure that the grain-surrounding average γ phase ratio satisfying the criterion B (stress corrosion cracking time period of 12 hours) was 28% or more and that the grain-surrounding average γ phase ratio satisfying the more preferable criterion A (stress corrosion cracking time period of 26 hours) was 45% or more. Here, "R" in the relational expressions statistically denotes the coefficient of correlation, and use of the squared value thereof "$R^2$" means the indication by an absolute value. The fact that the closer to 1 the value of $R^2$ is, indicates a state in which the relational expressions become closer to each data, namely relational expressions having strong correlation between x and y. The grain-surrounding average γ phase ratio can appropriately be increased or decreased as shown in Table 3 through the adjustment of alloy components (adjustment of the Cu or Bi content, for example) or the presence or absence of annealing or the adjustment of the annealing time period, temperature, etc. and can be set in accordance with the target criterion of the stress corrosion cracking time period without modifying the straight line relation thereof relative to the stress corrosion cracking time period shown in the relational expressions.

As described above, by securing the grain-surrounding average γ phase ratio of 28% or more or of 45% or more, the probability of the cracks coming into contact with the γ phase and, since the grain-surrounding average γ phase ratio indicates the percentage of the γ phase is annularly distributed in the grain boundary, the stress corrosion cracking resistance satisfying the prescribed criterion can be obtained in the case of the stress load direction being not specified, i.e. in an alloy having the crack direction unspecified. Incidentally, the upper limit of the grain-surrounding average γ phase ratio is about 75%, preferably 71% in the test material No. 3.

Figure 8:
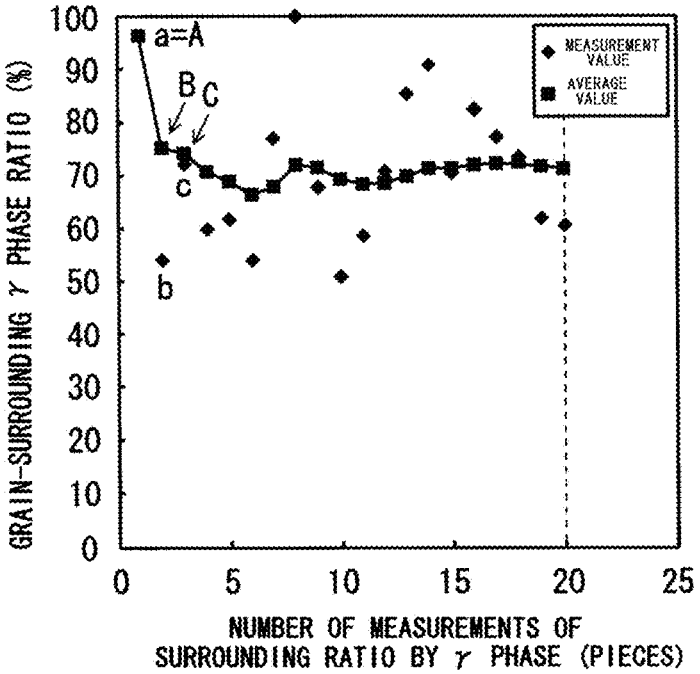
FIG. 8 is a graph showing the relation between the number of measurement of surrounding ratio by the γ phase and the grain-surrounding γ phase ratio.

Here, though the number of measurements of the γ phase surrounding ratio necessary for the calculation of the grain-surrounding average γ phase ratio, i.e. the number of crystals to be measured, is optional, why the number of the crystals to be measured in the present example was 20 is that the number is the minimum necessary number of measurements for converging the average value calculated from the measured values to a constant value. As shown in FIG. 8, the average value becomes an average value A that is a measurement value a per se when the number of measurements is 1, an average value B of measurement values a and b when the number of measurements is 2, an average value C of measurement values a to c when the number of measurements is 3. In the present example, since the average value is converged in the neighborhood of the measurement number of 15 based on the figure, the average value of the grain-surrounding γ phase ratios based on the measurement number of 20 was used as the grain-surrounding average γ phase ratio in consideration of a measurement error. Thus, the influence of a variation in average value is eliminated using the minimum necessary measurement value to enable the correlation between the grain-surrounding average γ phase ratio and the stress corrosion cracking resistance to be grasped correctly.

EXAMPLE 2

Next, an example showing the relation between the number of contacts by the γ phase and the stress corrosion cracking resistance will be described in detail. The "number of contacts by γ phases" is defined by the following formula based on the average value and the root-mean-square deviation of the data obtained from the measurements, performed plural times, of the number of contacting γ phases per unit length set in the vertical direction relative to the stress load direction in an optional section of an alloy.

Number of contacts by the γ phase[places]="Average value of the number of contacting γ phases"−"Root-mean-square deviation of the number of contacts by the γ phase" [Formula 1]

Therefore, the larger the "number of contacts by the γ phase", the higher the probability of cracks coming into contact with the γ phase is. In addition, since the number of contacts by the γ phase shows the ratio of the γ phase distributing in the direction vertical to the stress load direction, it is an appropriate index as a value showing the distribution of the γ phase necessary for suppressing cracks from propagating in the case of specifying the stress load direction, i.e. the cracking direction. Why attention has been paid to the ratio of the γ phase distribution in the direction vertical to the stress load direction lies in a point that stress corrosion cracks propagate in the direction vertical to the stress load direction. As described above, since the single and straight-line crack is apt to be induced in a Bi-based leadless copper ally, by distributing the γ phase in the direction vertical to the stress load direction in the alloy in accordance with a constant rule for the purpose of delaying the propagation of the stress corrosion crack, it is possible to improve the stress corrosion cracking resistance.

Next, the relation between the "number of contacts by the γ phase" and the stress corrosion cracking resistance will be described based on the actually measured data. Similarly to Example 1, rod materials were produced from billets 1 to 3 of the same composition using three kinds of producing methods and tested for stress corrosion cracking resistance. In addition, the number of contacts by the γ phase, which was the number of the γ phases existing per unit length, was analyzed from a microstructure, and the correlation thereof to the stress corrosion cracking resistance was obtained.

Figure 9:
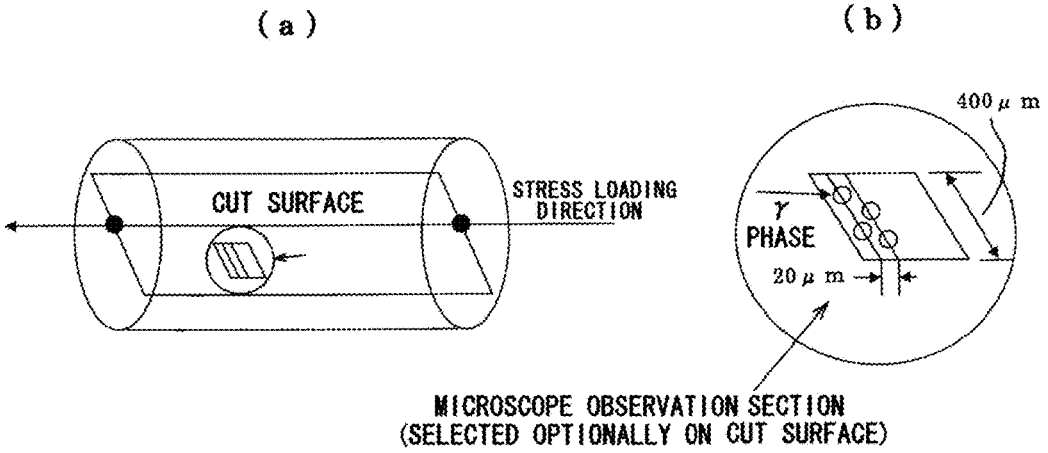
FIG. 9 shows explanatory views showing a measurement place of a test material.

The "number of contacting γ phases" was defined by a procedure comprising cutting a cylindrical test material at a plane parallel to the stress load direction as shown in FIG. 9, photographing a metallic structure of an optional section of the cut surface with a microscope of 400 magnifications (observation surface: 400 μm×480 μm), drawing 24 straight lines having a length of 400 μm on the photograph at intervals of 20 μm in the direction vertical to the stress load direction, measuring the number of contacting γ phases on each of the 24 straight lines to obtain the number of contacting γ phases and root-mean-square deviation, subtracting the root-mean-square deviation from the number of contacting γ phases to obtain a target value of the "number of contacts by the γ phase".

Why the measurements were made at the intervals of 20 μm is that the average grain diameter was 14 to 16 μm and that it was intended to avoid plural measurements in relation to the grains of the same diameter. In addition, why the unit length was set to be 400 μm was that the microscope of 400 magnifications easy to observe and measure the microstructure was used and that the narrow side of the field of view in the magnifications was 400 μm. Table 5 shows the number of contacts by the γ phase (places) and the stress corrosion cracking time period in each of the test materials 1 to 6. In addition, a graph showing the relation between the number of contacts by the γ phase and the stress corrosion cracking time period obtained from Table 5 is shown in FIG. 10.

TABLE 5

| Quality of material | Producing method | No. of test material | Number of contacts by γ phase (places) | Stress corrosion cracking time period (hr) |
|---|---|---|---|---|
| Billet 1 | Method A | 1 | 11 | 43 |
| | Method B | 2 | 6 | 28 |
| Billet 2 | Method A | 3 | 9 | 46 |
| | Method B | 4 | 6 | 32 |
| | Method C | 5 | 4 | 26 |
| Billet 3 | Method C | 6 | 1 | 4 |

Figure 10:
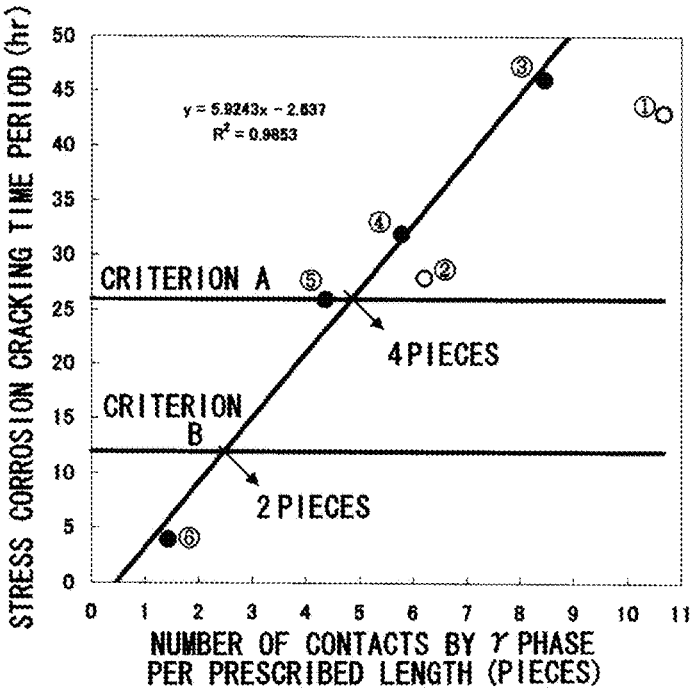
FIG. 10 is a graph showing the relation between the number of contacts by the γ phase and the stress corrosion cracking time period.

It was found from FIG. 10 that the number of contacts by the γ phase and the stress corrosion cracking time period had a straight line relation with respect to billets 2 and 3 and that a tendency that the stress corrosion cracking time period became long in proportion as the number of contacts by the γ phase increased. In addition, it is found from the relational expressions that $y=5.9243x-2.637$ and that $R^2=0.9853$ that the number of contacts by the γ phase satisfying the criterion B (stress corrosion cracking time period of 12 hours) is 2 to 80 and that the number of contacts by the γ phase satisfying the preferable criterion A (stress corrosion cracking time period of 26 hours) is 4 to 80. Furthermore, with respect to a billet 1, the number of contacts by the γ phase is 6 or more, thus enabling the criterion A to be satisfied.

Here, the grain size of brass rods generally produced is around 5 μm in the case of minute size. Therefore, 80 crystals tops can exist in a measurement length of 400 μm. Since one γ phase is present around one grain, the upper limit of the number of contacts by the γ phase is set to be 80 places. The number of contacts by the γ phase can suitably be increased or decreased through the adjustment of the alloy components (adjustment of the contents of Cu or Bi and Sb) or the presence or absence of annealing or the adjustment of annealing time period and temperature and can be set in accordance with the criterion of the stress corrosion cracking time period aimed at without modifying the straight line relation relative to the stress corrosion cracking time period shown in the above rational expressions.

Incidentally, in the "relation between the grain-surrounding average γ phase ratio and the stress corrosion cracking time period" in Example 1, it is impossible to grasp from the graph of FIG. 7 the influence of the Sb content on the stress corrosion cracking resistance. However, by analyzing FIG. 10 on the "relation between the number of contacts by the γ phase and the stress corrosion cracking time period" in Example 2, it is possible to quantitatively grasp the relation between the Sb content and the stress corrosion cracking resistance.

That is to say, in FIG. 10, while the data on billet 2 (test materials 3, 4 and 5) and billet 3 (test material 6) appear on the graph so as to be substantially along the formula $y=5.9243x-2.637$, the data on billet 1 (test materials 1 and 2) appear on the graph so as to be apart from the straight line. It is found from this fact that the stress corrosion cracking time period is enhanced in the presence of Sb rather than in the absence of Sb in the case where the numbers of contacts by the γ phase are the same. Therefore, it has been found that the existence of Sb is better in terms of the fact that the stress corrosion cracking resistance time period becomes longer even when the number of contacts by the γ phase is small.

As described above, by securing the number of contacts by the γ phase to be two or more, or four or more, (six or more in the absence of Sb), the probability of the cracks coming into contact with the γ phase becomes high and, furthermore, since the number of contacts by the γ phase shows the percentage of the γ phase distributing in the direction vertical to the stress load direction, the stress corrosion cracking resistance satisfying the prescribed criterion can be acquired in the case where the stress load direction is specified, i.e. where the direction of alloy cracks is specified.

In spite of the fact that the "grain-surrounding average γ phase ratio" or "number of contacts by the γ phase" is the numerical number based on the partially measured data of the alloy, the correlation thereof relative to the stress corrosion cracking resistance could here be obtained as described above. By suitably setting the "grain-surrounding average γ phase ratio" or "number of contacts by the γ phase" based on the correlation, it is possible to obtain a state in which the γ phase has been distributed in the alloy at a constant rate and, by making the probability of the cracks coming into contact with the γ phase high, it is possible to delay a crack-propagating velocity and enhance the stress corrosion cracking resistance. In addition, only the calculation of the "grain-surrounding average γ phase ratio" or "number of contacts by the γ phase" enables the stress corrosion cracking resistance of the test materials to be evaluated without performing the stress corrosion cracking test on a case-by-case basis.

Figure 11:
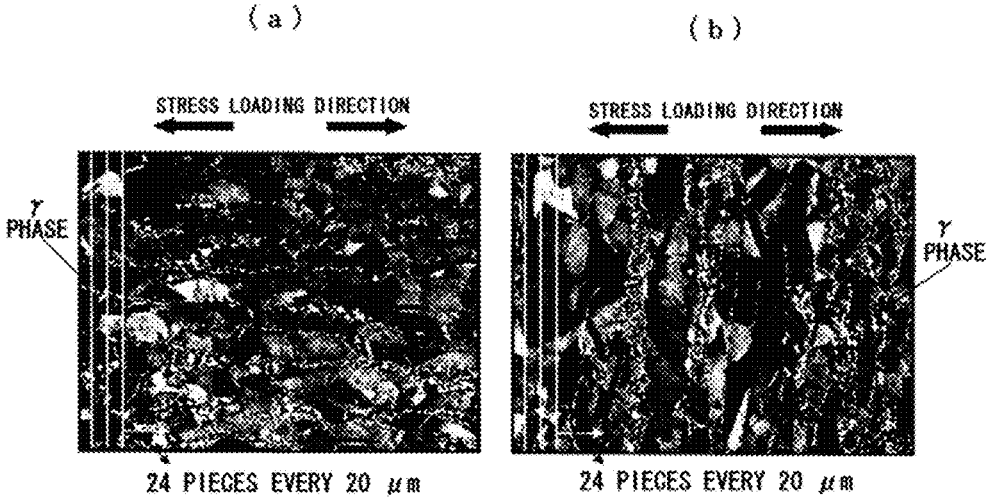
FIG. 11 shows enlarged photographs depicting measurement states of the number of contacting γ phases at prescribed places of a test material.
Figure 12:
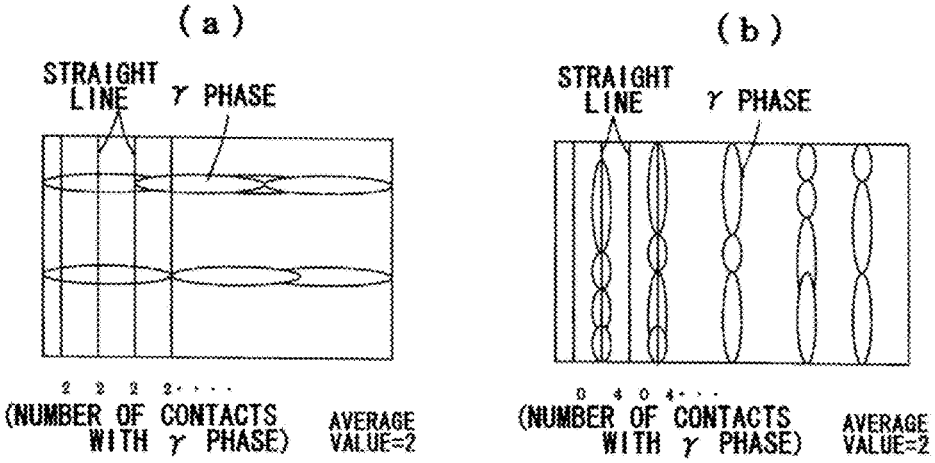
FIG. 12 shows explanatory views showing measurement states of the number of contacting γ phases at predetermined places of a test material.
Figure 13:
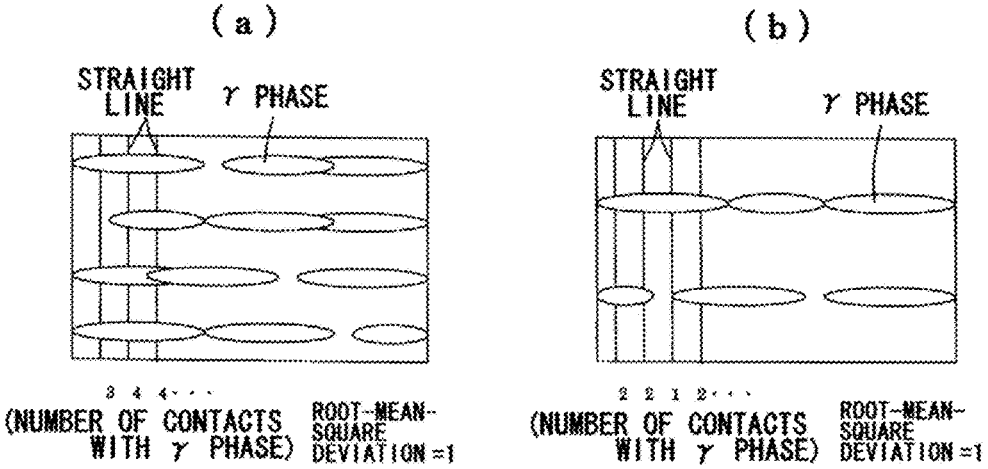
FIG. 13 shows explanatory views showing measurement states of the number of contacting γ phases at other places of the test material.

Incidentally, the "number of contacts by the γ phase" is the index capable of statistically supporting the reasonability as a numerical number showing a high probability of the cracks coming into contact with the γ phase. As described above, the "number of contacts by the γ phase" is the index calculated from the average value of the number of contacting γ phases and root-mean-square deviation measured relative to the plural unit lengths. The indices calculated from the average value alone show the same numerical number in the case of an alloy having the γ phase existing on the average relative to the unit length as shown in FIG. 11(*a*) and FIG. 12(*a*) and in the case of an alloy having the γ phase existing unevenly relative to the unit length as shown in FIG. 11(*b*) and FIG. 12(*b*). In this case, therefore, it is impossible to suitably show the distribution of the γ phase necessary for suppressing the crack-propagating velocity.

Furthermore, the indices calculated only from the root-mean-square deviation indicating the variation in data show the same numeral number in the case of an alloy having a large average value and in the case of an alloy having a small average value. Therefore, it is also impossible to suitably show the distribution of the γ phase necessary for suppressing the crack-propagating velocity.

In the brass alloy of the present invention, the combination of the average value of the number of contacting γ phases and the root-mean-square deviation was used as the index suitably showing the state of existence of the γ phase necessary for suppressing the crack-propagating velocity. By so doing, it was possible to find the correlation relative to the stress corrosion cracking time period, specify the distribution of the γ phase necessary for securing the stress corrosion cracking resistance in a Bi-based leadless brass that is an alloy assuming a straight line crack, thereby confirming the reasonability as the numerical number showing a high probability of the crack coming into contact with the γ phase.

Figure 14:
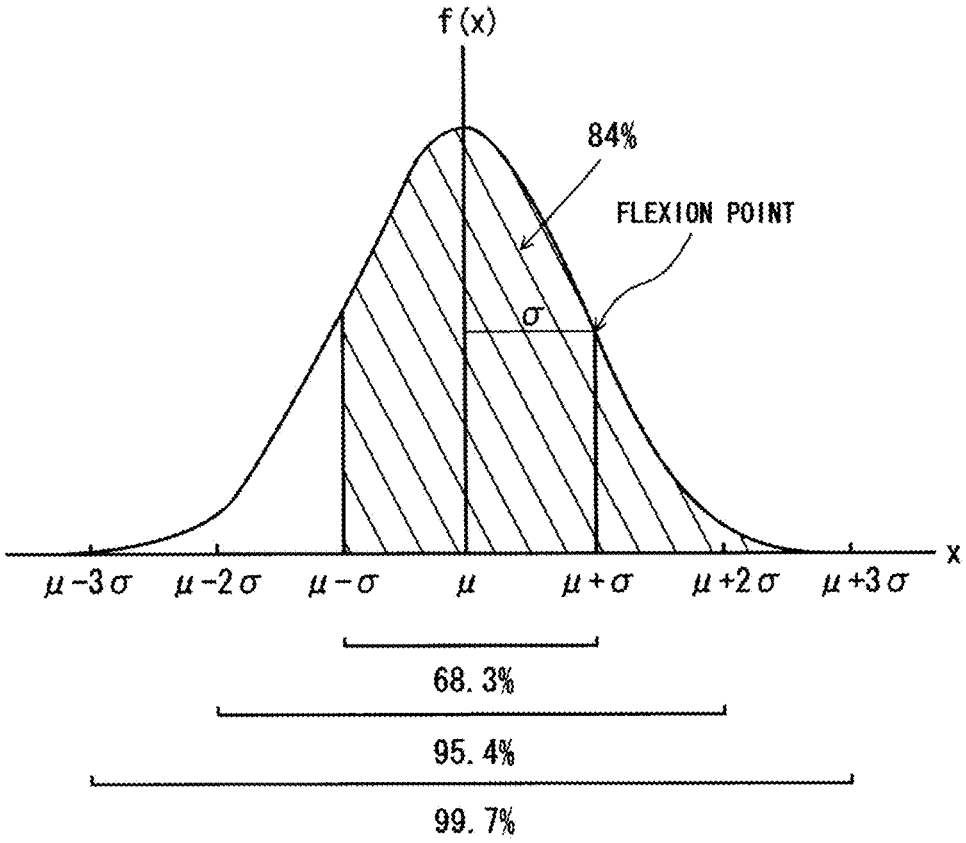
FIG. 14 is an explanatory view showing an average value to root-mean-square deviation region, drawn by diagonal lines, in a normal distribution diagram.

In addition, since the "number of contacts by the γ phase is a numerical number represented by the "average value (μ)−root-mean-square deviation (σ)", it is a numerical number corresponding to the lower limit of a diagonal region in the normal distribution diagram of FIG. 14. In the normal distribution diagram of FIG. 14, the abscissa axis stands for the number of contacts by the γ phase and the longitudinal axis for the frequency of the measured data assuming the number of contacts by the γ phase.

In the statistics, as means for presuming whole data of physical objects (statistically called "populations") based on partially measured data of the physical objects (statistically called "samples"), "normal distribution" capable of commonly showing data distribution of plenty of natural phenomena is used. Since the alloy of the present invention is required to presume the distribution of the γ phase in a whole observation section based on 24 measured data at the observation section, the normal distribution diagram can be applied.

According to the normal distribution, it is shown that the probability of the number of contacting γ phases in a unit length, which is the measured data at an optional position of the observation section, exceeds the "number of contacts by the γ phase" is about 84% corresponding to the diagonal region in the normal distribution diagram of FIG. 14.

In the brass alloy of the present invention, therefore, the term "two or more number of contacts by the γ phase" means that there are 20 or more unit lengths having two or more contacting γ phases when 24 unit lengths have been measured with respect to the number of contacting γ phases in a unit length.

As described above, the "number of contacts by the γ phase" is the index capable of statistically supporting the reasonability as a numerical number showing a high probability of the cracks coming into contact with the γ phase. Furthermore, since the clear correlation thereof relative to the stress corrosion cracking resistance of the whole alloys (test materials) could be obtained as described above, the numerical number is reasonable as the index showing the distribution of the γ phase necessary for securing the stress corrosion cracking resistance of the Bi-based leadless brass.

EXAMPLE 3

Next, a test of Example 3 was conducted for the purpose of examining the relation between the Sn content of the Bi-based leadless brass alloy of the present invention and the stress corrosion cracking resistance and verifying an optimum addition range (content) of Sn relative to the stress corrosion cracking resistance. The method for producing test materials 7 to 16 of the present invention comprised dissolving raw materials in a high-frequency furnace, pouring a melt into a mold at a temperature of 1010° C. to produce casts of ϕ32×300 (mm) by the metallic mold casting.

The stress corrosion cracking test method comprised screwing a bushing of stainless steel having a sealing tape wound around it in an Rc ½ screw part of each test material as shown in FIG. 2 using a torque of 9.8 N·m, similarly to the case of the evaluation criterion test, and introducing the resultant test materials into a desiccator containing ammonia water having an ammonia concentration of 14% for a test time period in the range of 4 to 48 hours. Subsequently, each test material was taken out of the desiccator after the elapse of prescribed periods of time (every 4, 8, 12, 24, 36 and 48 hours), washing each test material and evaluating the presence or absence of cracks in each test material by the visual confirmation. In Example 3, the chemical components (mass %) of the produced casts (test materials 7 to 16) and the results of the stress corrosion cracking time period in each test material are shown in Table 6.

TABLE 6

| | Cu | Sn | Ni | Bi | P | Zn | Stress corrosion cracking time period (hr) |
|---|---|---|---|---|---|---|---|
| Test material 7 | 62.6 | 0.5 | 0.2 | 1.7 | 0.1 | Bal. | 9 |
| Test material 8 | 62.5 | 0.7 | 0.2 | 1.8 | 0.1 | Bal. | 16 |
| Test material 9 | 62.5 | 1.1 | 0.2 | 1.8 | 0.1 | Bal. | 48 |
| Test material 10 | 62.5 | 1.4 | 0.2 | 1.8 | 0.1 | Bal. | 48 |
| Test material 11 | 62.4 | 1.7 | 0.2 | 1.9 | 0.1 | Bal. | 48 |
| Test material 12 | 62.5 | 1.9 | 0.2 | 1.9 | 0.1 | Bal. | 48 |
| Test material 13 | 62.4 | 2.2 | 0.2 | 1.8 | 0.1 | Bal. | 48 |
| Test material 14 | 62.6 | 2.5 | 0.2 | 1.8 | 0.1 | Bal. | 37 |
| Test material 15 | 62.6 | 1.2 | 0.2 | 1.3 | 0.1 | Bal. | 48 |
| Test material 16 | 62.5 | 2.6 | 0.2 | 1.3 | 0.1 | Bal. | 32 |

Figure 15:
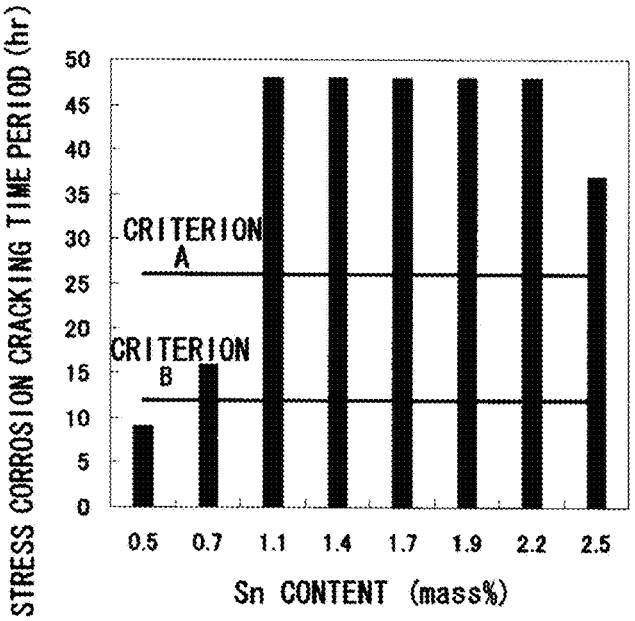
FIG. 15 is a bar graph showing the relation between the Sn content of a test material of the brass alloy according to the present invention and the stress corrosion cracking time period.

FIG. 15 is a graph showing the relation between the Sn content of each of test materials 7 to 14 (Bi content of about 1.8%) and the stress corrosion cracking time period obtained from Table 6. The results of FIG. 15 showed a tendency to satisfy the determined evaluation criterion A (26 hours) with respect to all the standards containing 1.1 mass % or more of Sn. However, since an excess amount of Sn added induces porous shrinkage cavities in a cast and deteriorates the workability, the optimum range of Sn to be added is preferably in the range of 1.0 to 2.0 mass %. On the other hand, as described above, while the Sn content of the present invention is in the range of 0.7 to 2.5 mass %, this content enables the criterion B to be satisfied. Incidentally, the above tendency is reproduced even in test materials 15 and 16 containing about 1.3 mass % of Bi as shown in Table 6.

EXAMPLE 4

Next, the relation between the Sn content of the Bi—Se-based leadless brass alloy in the present invention and the stress corrosion cracking resistance was examined. Standard casts of test materials No. 17 to No. 28 shown in Table 7 were produced by metallic mold casting and subjected to screw-in SSC property tests. The test conditions are the same as in the case of the test for Bi-based brass mentioned above and includes a screw-in torque of 9.8 N·m, an ammonia concentration of 14%, a time period of 4 to 48 hours and n=4. Furthermore, in order to confirm the effect of Se, test materials No. 25 and No. 26 containing 0.09% and 0.12% of Se, respectively, were tested. The results thereof are shown in Table 7 and the results of test materials Nos. 17 to 26 were also shown in FIG. 49. Incidentally, for the purpose of evaluating test results of Bi-based brass and test results of Bi—Se-based brass under the same conditions, the stress corrosion cracking time period of a standard test material (Cu: 62.6, Sn: 0.3, Pb: 2.8, P: 0.1, Zn: the balance; numerical number unit was mass %) was evaluated at the time of each test. As a result, the stress corrosion cracking time period of the standard test material was 48 hours at the time of the test for the Bi-based brass and 42 hours at the time of the test for the Bi—Se-based brass. Therefore, the test result (stress corrosion cracking time period) of each Bi—Se-based brass test material was multiplied by 48/42=1.14 (amendment value) and the product thereof is shown as an "amended value".

As a consequence of the test results, it was found that the Se content in addition to the Sn content enables the stress corrosion cracking resistance to be slightly enhanced. Incidentally, in the case of an increase in Se content among test materials No. 20, No. 25 and No. 26, the stress corrosion cracking resistance of test material No. 26 (Se=0.12%) was slightly lowered and started to peak. Incidentally, this tendency is substantially reproduced in test materials 27 and 28 containing about 1.3% of Bi as shown in Table 7.

TABLE 7

| Test material | Chemical component value of test products (mass %) Cu | Sn | Ni | Bi | Se | P | Zn | Stress corrosion cracking time period (hr) Numerical numbers in ( ) are amended values |
|---|---|---|---|---|---|---|---|---|
| 17 | 62.1 | 0.5 | 0.2 | 1.9 | 0.03 | 0.1 | Bal. | 5 (5.7) |
| 18 | 62.3 | 0.7 | 0.2 | 1.9 | 0.04 | 0.1 | Bal. | 14 (16.0) |
| 19 | 62.1 | 1.2 | 0.2 | 2.0 | 0.03 | 0.1 | Bal. | 45 (51.3) |
| 20 | 62.4 | 1.5 | 0.2 | 1.9 | 0.03 | 0.1 | Bal. | 48 (54.7) |

TABLE 7-continued

| Test material | Chemical component value of test products (mass %) Cu | Sn | Ni | Bi | Se | P | Zn | Stress corrosion cracking time period (hr) Numerical numbers in ( ) are amended values |
|---|---|---|---|---|---|---|---|---|
| 21 | 62.2 | 1.7 | 0.2 | 2.0 | 0.03 | 0.1 | Bal. | 48 (54.7) |
| 22 | 62.2 | 1.9 | 0.2 | 2.0 | 0.03 | 0.1 | Bal. | 48 (54.7) |
| 23 | 62.3 | 2.1 | 0.2 | 2.0 | 0.03 | 0.1 | Bal. | 45 (51.3) |
| 24 | 62.4 | 2.5 | 0.2 | 2.0 | 0.03 | 0.1 | Bal. | 33 (37.6) |
| 25 | 62.2 | 1.5 | 0.2 | 1.8 | 0.09 | 0.1 | Bal. | 48 (54.7) |
| 26 | 62.0 | 1.5 | 0.2 | 1.9 | 0.12 | 0.1 | Bal. | 42 (48.0) |
| 27 | 62.2 | 1.2 | 0.2 | 1.3 | 0.03 | 0.1 | Bal. | 42 |
| 28 | 62.2 | 2.6 | 0.2 | 1.3 | 0.03 | 0.1 | Bal. | 42 |

EXAMPLE 5

For the purpose of examining the relation between the Sb content and the stress corrosion cracking resistance of the Bi-based leadless brass alloy of the present invention and verifying the optimum range of Sb to be added (content) relative to the stress corrosion cracking resistance, a test of Example 5 was performed. The method of producing test materials 29 to 38 at this test is the same as in Example 3.

The stress corrosion cracking test method comprised screwing a bushing of stainless steel having a sealing tape wound around it in an Rc ½ screw part of each test material as shown in FIG. 2 using a torque of 9.8 N·m, similarly to the case of the evaluation criterion test, introducing the resultant test materials into a desiccator containing ammonia water having an ammonia concentration of 14%, taking each test material out of the desiccator after the elapse of time periods of 4, 8, 12, 24, 36 and 48 hours, washing each test material and evaluating the presence or absence of cracks in each test material by the visual confirmation. In Example 5, the chemical components (mass %) of the produced casts (test materials 29 to 38) and the results of the stress corrosion cracking time periods (hr) are shown in Table 8.

TABLE 8

| No. | Cu | Sn | Ni | Bi | Sb | Zn | Stress corrosion cracking time period (hr) |
|---|---|---|---|---|---|---|---|
| Test material 29 | 60.7 | 1.5 | 0.2 | 1.5 | 0.00 | Bal. | 32 |
| Test material 30 | 60.8 | 1.5 | 0.2 | 1.5 | 0.02 | Bal. | 28 |
| Test material 31 | 60.7 | 1.5 | 0.2 | 1.5 | 0.04 | Bal. | 27 |
| Test material 32 | 60.7 | 1.5 | 0.2 | 1.5 | 0.06 | Bal. | 34 |
| Test material 33 | 60.6 | 1.6 | 0.2 | 1.5 | 0.08 | Bal. | 42 |
| Test material 34 | 60.7 | 1.6 | 0.2 | 1.5 | 0.12 | Bal. | 45 |
| Test material 35 | 60.7 | 1.6 | 0.2 | 1.4 | 0.21 | Bal. | 39 |
| Test material 36 | 60.6 | 1.6 | 0.2 | 1.4 | 0.51 | Bal. | 33 |
| Test material 37 | 60.7 | 1.6 | 0.2 | 1.4 | 1.04 | Bal. | 10 |
| Test material 38 | 61.2 | 1.8 | 0.2 | 1.4 | 2.98 | Bal. | 2 |

Figure 16:
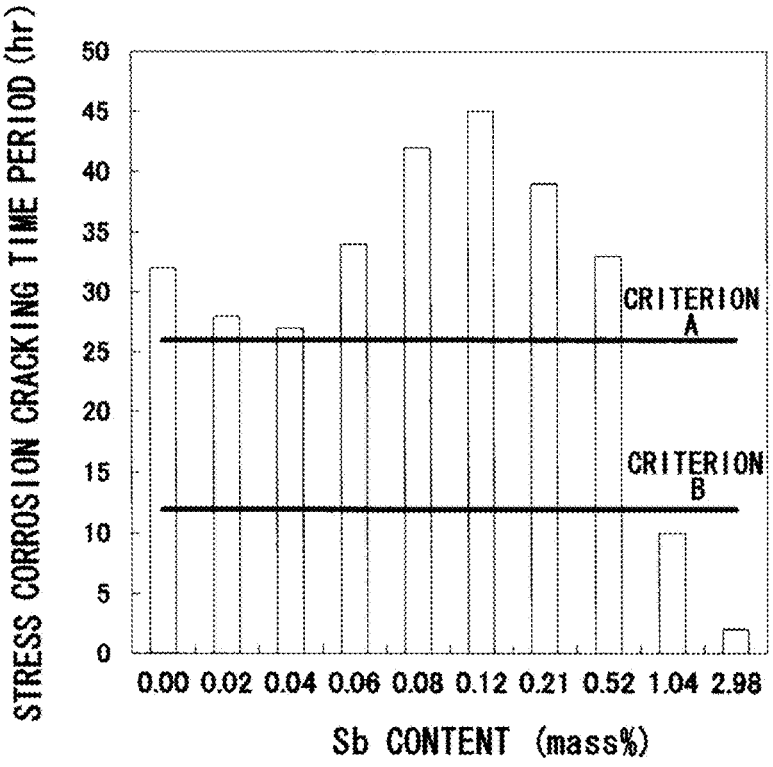
FIG. 16 is a bar graph showing the relation between the Sb content of the test material of the brass alloy according to the present invention and the stress corrosion cracking time period.
Figure 17:
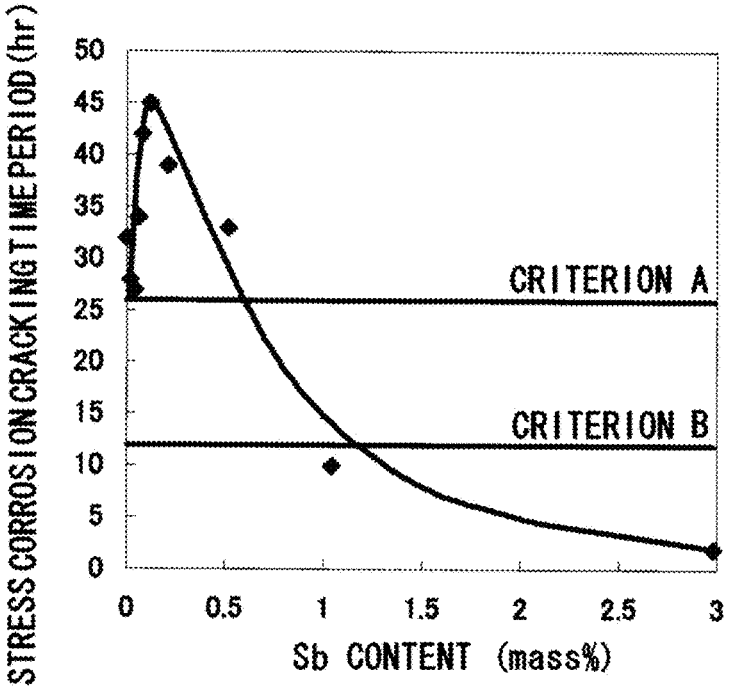
FIG. 17 is a line graph showing the relation between the Sb content of the test material of the brass alloy according to the present invention and the stress corrosion cracking time period.

Graphed relation between the Sb content and the stress corrosion cracking time period obtained from Table 8 is shown in FIG. 16 and FIG. 17. FIG. 16 is a bar graph equidistantly showing the test results of the test materials for the purpose of showing the test results of the test materials having a small Sb content in detail, and FIG. 17 is a curve chart showing the test results of the test materials based on the Sb content for the purpose of showing an entire tendency of the test materials containing Sb. It is found from the results of FIG. 16 and FIG. 17 that the Sb content in the range of 0.06 to 0.60 mass % (0.06 to 0.51 with further certainty) fulfills the stress corrosion cracking resistance satisfying criterion A. On the other hand, as described above, though the Sb content in the present invention is expressed as 0.06<Sb≤0.60 mass %, this content satisfies criterion B. Incidentally, the effect of the Sb content could not obtained from test material 30 (Sb: 0.02 mass %) and test material 31 (Sb: 0.04 mass %).

Here, the alloy of the present invention has to have an Sn content of 0.7 to 2.5 mass % when it has an Sb content. Alloys having an Sn content lowered to 0.5 mass % were similarly tested as comparative examples, and the results thereof are shown in Table 9. In these alloys, the enhancement of the stress corrosion cracking resistance could not be confirmed even when the Sb contents were increased to 0.1 mass % and 0.3 mass %, respectively.

TABLE 9

| No. | Cu | Sn | Ni | Bi | Sb | P | Zn | Stress corrosion cracking time period (hr) |
|---|---|---|---|---|---|---|---|---|
| Comp. Ex. 1 | 62.4 | 0.5 | 0.2 | 1.7 | 0.1 | 0.1 | Bal. | 6 |
| Comp. Ex. 2 | 62.7 | 0.5 | 0.2 | 1.6 | 0.3 | 0.1 | Bal. | 4 |

Incidentally, the relation between the Sb content and the stress corrosion cracking resistance of the Bi—Se-based leadless alloys of the present invention was tested in the same manner as in the case of the Bi-based test materials.

TABLE 10

| No. | Cu | Sn | Ni | Bi | Se | Sb | Zn | Stress corrosion cracking time period (hr) |
|---|---|---|---|---|---|---|---|---|
| Test material 39 | 60.8 | 1.7 | 0.2 | 1.4 | 0.03 | 0.08 | Bal. | 48 |
| Test material 40 | 60.8 | 1.7 | 0.2 | 1.4 | 0.03 | 0.22 | Bal. | 40 |

It is found from the results of Table 10 that the same tendency as in the Bi-based test materials is reproduced in the Bi—Se-based leadless brass alloys.

EXAMPLE 6

Subsequently, a test of Example 6 was performed for the purpose of examining the relation between the Cu content and the stress corrosion cracking resistance of the Bi-based brass alloy in the present invention and determining the optimal range of Cu addition relative to the stress corrosion cracking resistance. The method for producing test materials 41 to 45 is the same as in Example 3.

The method of stress corrosion cracking test comprised, similarly to that in Example 4, taking the test materials out of the desiccator every 4, 8, 12, 24, 36, 48 hours, washing the test materials and evaluating the presence and absence of cracks in the test materials by visual confirmation. The chemical compositions (mass %) of the produced casts (test materials 41 to 45) and the results of the stress corrosion cracking time periods are shown in Table 11.

TABLE 11

| No. | Cu | Sn | Ni | Bi | P | Zn | Stress corrosion cracking time period (hr) |
|---|---|---|---|---|---|---|---|
| Test material 41 | 58.5 | 1.7 | 0.2 | 1.5 | 0.1 | Bal. | 8 |
| Test material 42 | 59.6 | 1.7 | 0.2 | 1.5 | 0.1 | Bal. | 12 |
| Test material 43 | 60.6 | 1.7 | 0.2 | 1.5 | 0.1 | Bal. | 40 |

TABLE 11-continued

| No. | Cu | Sn | Ni | Bi | P | Zn | Stress corrosion cracking time period (hr) |
|---|---|---|---|---|---|---|---|
| Test material 44 | 62.4 | 1.7 | 0.2 | 1.9 | 0.1 | Bal. | 48 |
| Test material 45 | 65.3 | 1.7 | 0.2 | 1.5 | 0.1 | Bal. | 20 |

Figure 22:
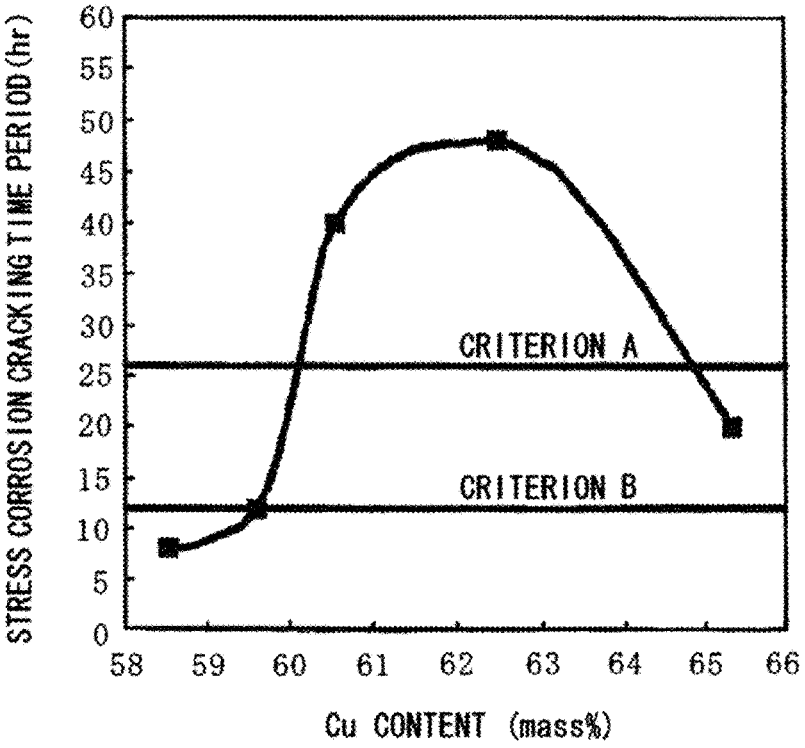
FIG. 22 is a line graph showing the relation between the Cu content and the stress corrosion cracking time period of the test material of the brass alloy according to the present invention.

A graphed relation between the Cu contents and the stress corrosion cracking time periods obtained from Table 11 is shown in FIG. 22. It was confirmed from the results of FIG. 22 that the effective Cu content satisfying criterion B (12 hours) of the stress corrosion cracking resistance was 59.5 mass % or more (59.6 mass % or more with further certainty) and that the effective Cu content satisfying criterion A (26 hours) was approximately 60.0 mass % or more (60.6 mass % or more with further certainty).

EXAMPLE 7

One of the factors to which stress corrosion cracks are attributed is a residual tensile stress in the worked test material. The residual tensile stress possibly deteriorates the stress corrosion cracking resistance interdependently on the corrosion environment. Since Bi is an element contributing to cuttability, it affects the stress remaining in the worked test material. Therefore, the Bi content and the stress in the worked test material are examined, and the amount of Bi to be added not to induce any residual tensile stress is determined. The method of producing test materials 46 to 50 used here is the same as that in Example 3.

Figure 23:
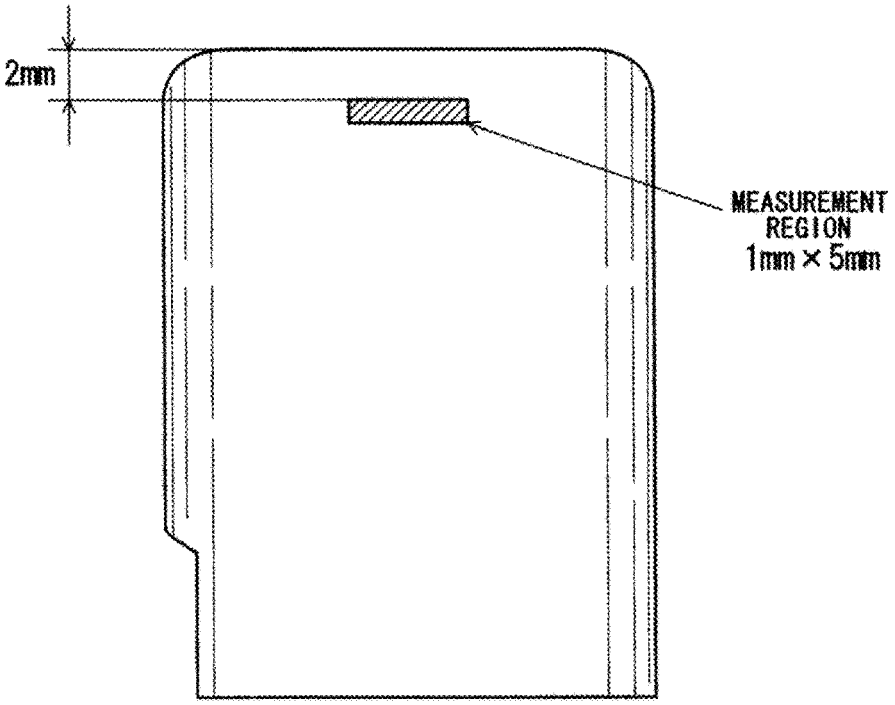
FIG. 23 is a schematic view showing the external appearance of a test material and a stress measurement place.

The stress in a test material is measured by the X-ray stress measuring method. Here, the external stress influences the lattice spacing constituting the material and the lattices distorted by the stress influence the angle of the diffracted X-ray relative to the incident X-ray. The metal material is polycrystalline and, when a stress is exerted on the metal material, it generally elongates in the stress direction and shrinks in the orthogonal direction. Therefore, by measuring variations including the elongation and shrinkage of the crystalline lattice spacing distance using the X-ray diffraction method, it is possible to acquire an internal stress. In Example 7, the appearance of the produced casts (test materials 46 to 50) and the measurement place are shown in FIG. 23, and the chemical components (mass %) and the stress values (MPa) measured are shown in Table 12. Incidentally, the casts have the same shape as the cylindrical test material shown in FIG. 2.

TABLE 12

| No. | Cu | Sn | Ni | Bi | P | Zn | Stress value (MPa) |
|---|---|---|---|---|---|---|---|
| Test material 46 | 62.6 | 0.5 | 0.2 | 0.0 | 0.1 | Bal. | +646.76 |
| Test material 47 | 62.3 | 0.5 | 0.2 | 0.1 | 0.1 | Bal. | +429.90 |
| Test material 48 | 61.9 | 0.5 | 0.2 | 0.4 | 0.1 | Bal. | +286.95 |
| Test material 49 | 62.1 | 0.5 | 0.2 | 0.6 | 0.1 | Bal. | +124.18 |
| Test material 50 | 62.3 | 0.5 | 0.2 | 1.0 | 0.1 | Bal. | −249.40 |

(+ stands for the tensile stress and − for the compression stress)

Figure 24:
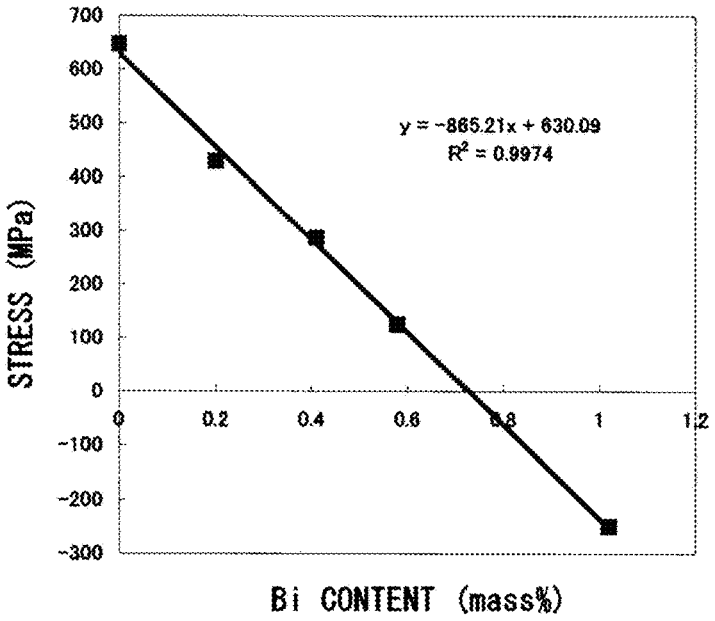
FIG. 24 is a graph showing the relation between the Bi content and the stress of the test material of the brass alloy according to the present invention.

A graphed relation of the Bi contents and stresses obtained from Table 12 is shown in FIG. 24. The results in FIG. 24 showed a tendency that the more the Bi content, the less the stress was and found out from a regression formula having the data connected with a straight line that in the worked test materials, the Bi content of 0.7 mass % or less converted the residual stress into the compression stress.

Incidentally, the stress corrosion cracking test in each of the examples, when being not specifically described therein, is performed under an environment of about 20° C.

EXAMPLE 8

Figure 18:
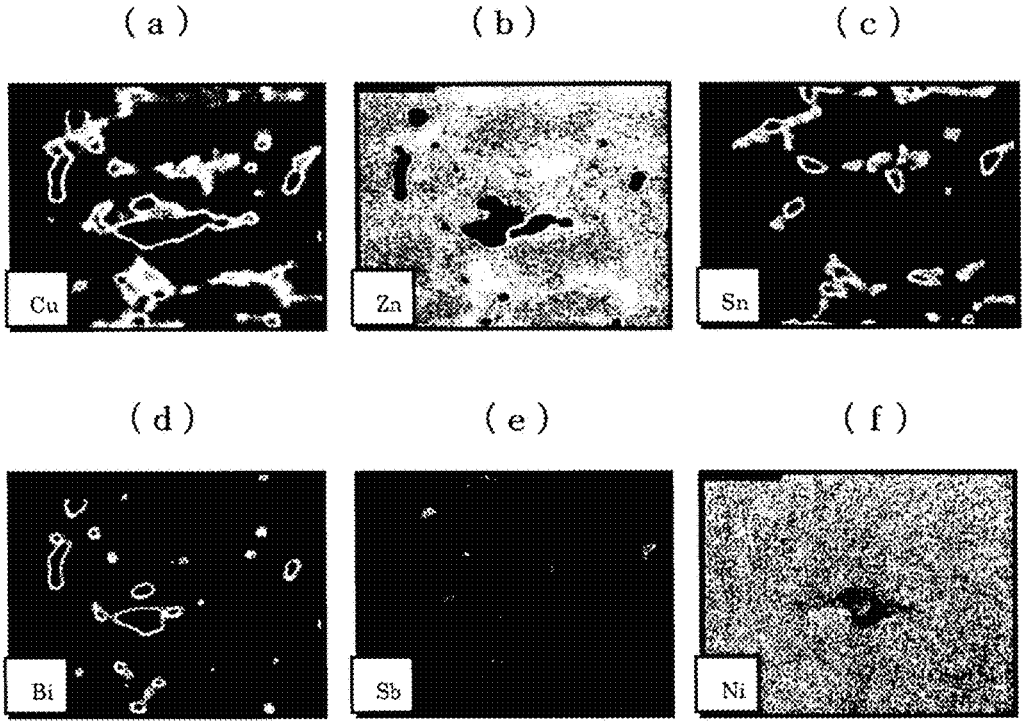
FIG. 18 shows enlarged photographs depicting mapping analysis results of a test material 3 (of α+β+γ structure) with the EMPA.

Next, the distribution of Sb in the alloy will be described in detail. The test material 3 (of α+β+γ structure) was subjected to mapping analysis using an EPMA (Electron Probe Micro-Analyzer) as Example 5 and the results thereof were shown in FIG. 18. The test material used here was produced in accordance with method A shown in FIG. 5. In FIG. 18(*a*) to FIG. 18(*f*), the mapping analysis was performed with respect to each of 6 elements that were Cu, Zn, Sn, Bi, Sb and Ni.

Referring to the Sb mapping image of FIG. 18(*e*), white places could be found in spots and thus Sb was detected though the concentration thereof was low. When running Sb with five other elements, the major white places of Sb correspond to black parts surrounding white parts of the mapping image of Sn in FIG. 18(*c*). This means that Sb exists at the same places as Sn.

Figure 19:
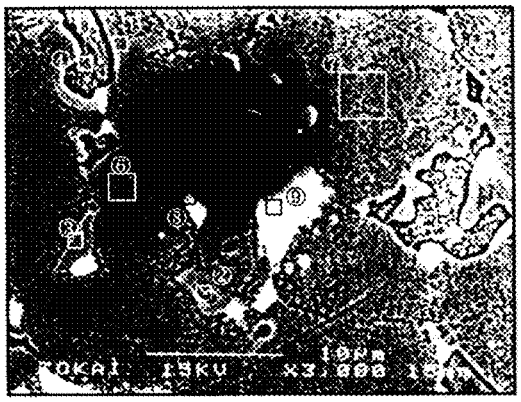
FIG. 19(*a*) is an enlarged photograph depicting measurement results of the test material 3 (of α+β+γ structure) with the SEM-EDX.

Subsequently, the quantitative analysis of the α-phase, β-phase and γ-phase in the alloy was performed using a SEM-EDX (Energy Dispersive X-ray analysis). The results thereof are shown in FIG. 19. FIG. 19(*b*) shows the compositions at the analysis places given numerical numbers shown in FIG. 19(*a*). Measurement places (1) to (3) are results of the analysis with respect to the γ phase. The γ phase is composed preponderantly of Cu, Zn, Sn and Sb and contains a high-concentration Sn of about 10 mass % and 3 mass % of Sb as a solute.

Figure 20:
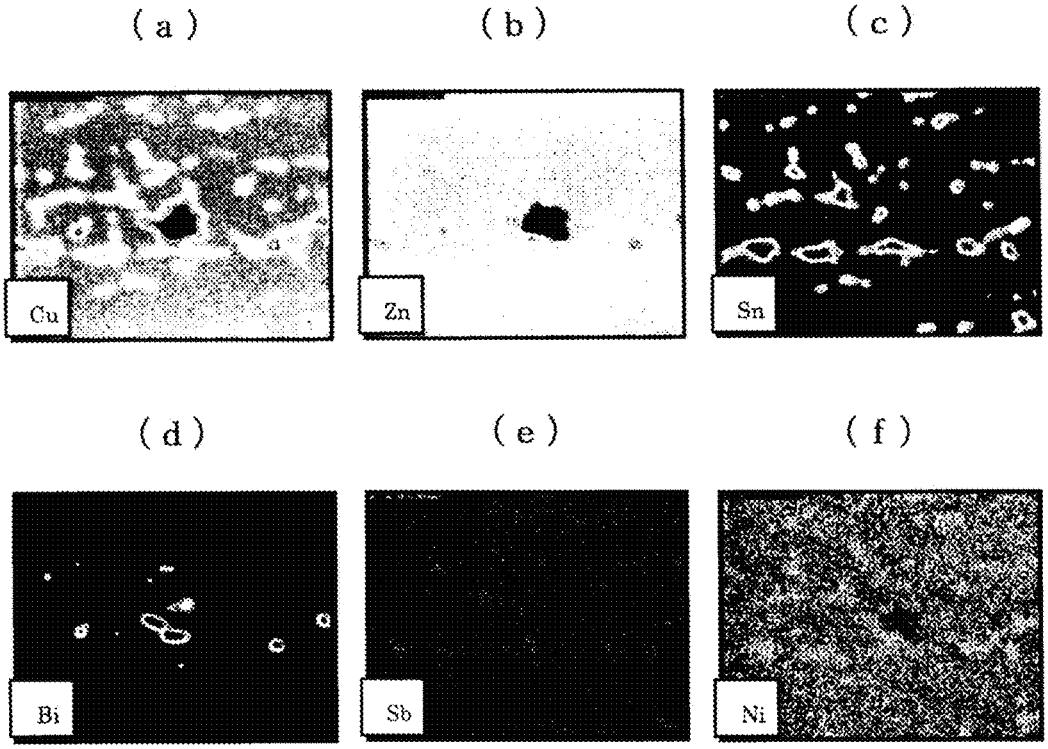
FIG. 20 shows enlarged photographs depicting mapping analysis results of a test material 4 (of α+γ structure) with the EMPA.

Next, the test material 4 (of α+γ structure) was subjected to mapping analysis using the EPMA and the results thereof are shown in FIG. 20. The test material was produced in accordance with the method B in FIG. 5. In FIG. 20(*a*) to FIG. 20(*f*), the mapping analysis was performed with respect to each of 6 elements that were Cu, Zn, Sn, Bi, Sb and Ni. Referring to the Sb mapping image of FIG. 20(*e*), (faint) white places could be found in spots and thus Sb was detected though the concentration thereof was low. When running Sb with five other elements, the major white places of Sb correspond to black parts surrounding white parts of the mapping image of Sn in FIG. 20(*c*). This means that Sb exists at the same places as Sn similarly to the case of the α+β+γ structure.

Figure 21:
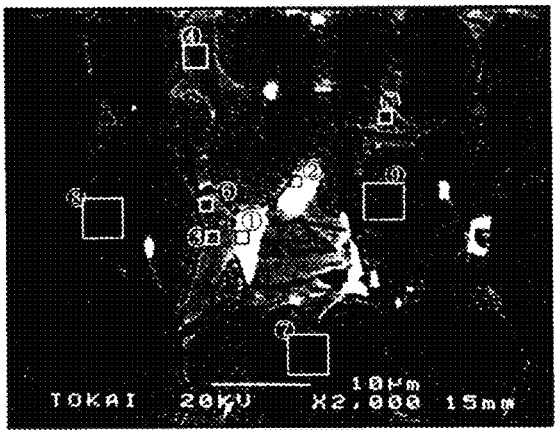
FIG. 21(*a*) is an enlarged photograph depicting measurement results of the test material 4 (of α+γ structure) with the SEM-EDX.

Subsequently, the quantitative analysis of the α-phase, β-phase and γ-phase in the alloy was performed using the SEM-EDX. The results thereof are shown in FIG. 21. FIG. 21(*b*) shows the compositions at the analysis places given numerical numbers shown in FIG. 21(*a*). Measurement places (3) to (6) are results of the analysis with respect to the γ phase. The γ phase is composed preponderantly of Cu, Zn, Sn and Sb and contains a high-concentration Sn of about 10 mass % and 2 to 3 mass % of Sb as a solute. Thus, the results of the γ phase in the α+γ structure were substantially the same as those of the γ phase in the α+β+γ structure. It can be said from the results of the EPMA and SEM-EDX analysis that Sb in the brass alloys having the α+β+γ structure and α+γ structure is contained in the γ phase as a solute.

Next, the micro-Vickers hardness of the γ phases found in the microstructures of the test materials 1 and 3 produced from billets 1 and 2 in accordance with the method B was measured at five places.

The average values of the γ phases in the test materials 1 and 3 were 158 and 237, respectively. Thus, it was clear that the γ phases precipitated in the billet 2 are harder. It is conceivable, as described in the results of the analysis by EPMA or SEM-EDX, that the reason for it is owing to the fact that the Sb added has been contained in the γ phases as a solute. In the present example, the γ phase containing Sb as a solute is defined as the "hardened γ phase" to be distinguished from the γ phase of the brass alloy, such as billet 1, not containing Sb, but containing Sn.

What is important in the stress corrosion cracking resistance of the Bi-containing leadless brass alloy is how plenty of γ phases are brought into contact with the cracks propagating linearly. In addition, it is found from the relation between the number of contacts by the γ phase and the stress corrosion cracking time periods shown in FIG. 10 that the stress corrosion cracking time period of the rod material containing Sb is longer than that of the rod material containing no Sb and that the stress corrosion cracking time period becomes long even in the case of a small number of contacts by the γ phase. This means that the "hardened γ phase" is more effective for preventing the propagation of cracks propagating linearly than the "γ phase".

EXAMPLE 9

Next, test materials 3 and 4 were subjected to the dezincification corrosion test and gap jet test the purpose of evaluating the dezincification corrosion resistance and erosion-corrosion resistance.

(1) Dezincification Corrosion Test:

The dezincification corrosion test was performed based on the brass dezincification corrosion test method prescribed by the ISO 6509-1981. To be specific, a test piece having the surface thereof polished with emery paper No. 1500 was immersed for 24 hours in a test vessel having an aqueous 1% cupric chloride solution retained to a temperature of 75° C., and the test piece taken out of the test vessel was measured and observed in corrosion depth and corrosion configuration of the cross section thereof using a microscope. The acceptance and rejection criteria were such that acceptance (◎ in table) was given to the maximum dezincification depth of 200 μm or less, acceptance (○) to the maximum dezincification depth exceeding 200 μm and up to 400 μm inclusive, and rejection (×) to the maximum dezincification depth that exceeds 400 μm. As shown in Table 13, both the test materials were given acceptance.

TABLE 13

| Test material | Determination | Maximum dezincification depth (μm) | Corrosion configuration |
|---|---|---|---|
| Test material 4 (production by method B: rod material) | ◎ | 50 | Stratified |
| Test material 3 (production by method A: cast product) | ◎ | 45 | Stratified |

Figure 25:
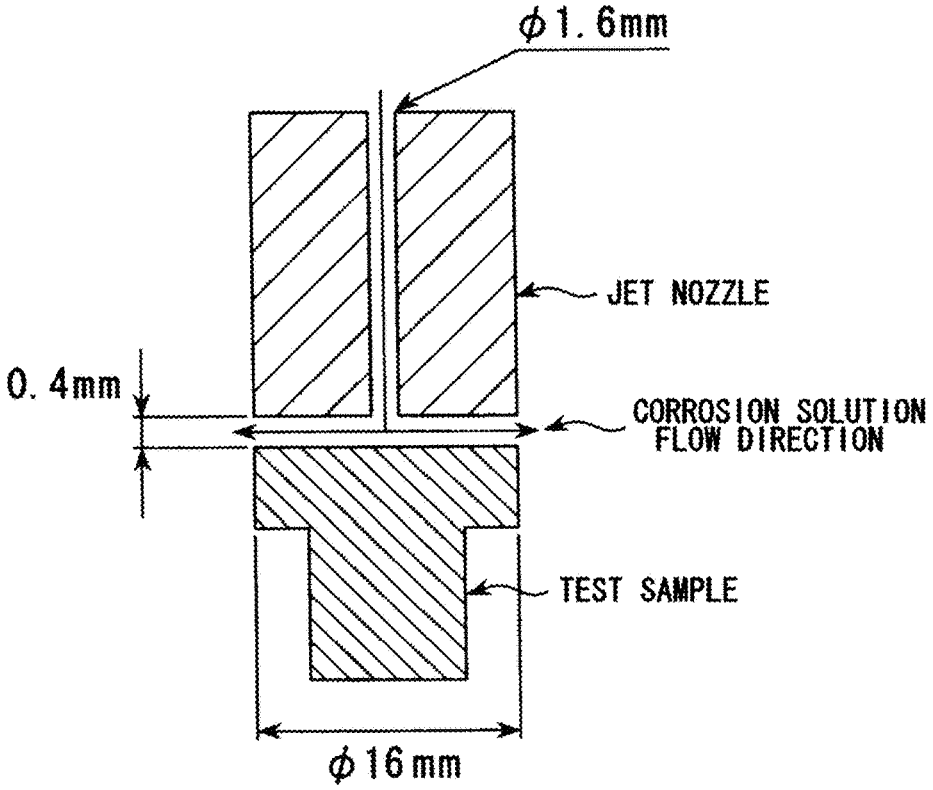
FIG. 25 is an explanatory view schematically showing a gap jet test device.

(2) Gap Jet Test:

The erosion-corrosion resistance was evaluated by the gap jet test. To be specific, a test piece worked to have an area of 64 $\pi cm^2$ (ø 16 mm) to be exposed to a corrosion solution was mirror-polished and disposed as shown in FIG. 25. Subsequently, a test solution (aqueous 1% cupric chloride solution) was jetted from a jet nozzle (nozzle diameter: ø 1.6 mm) disposed at a height of 0.4 mm from the surface of the test piece. In 5-hour jetting of the test solution, a mass was measured to obtain a mass loss and a corrosion depth, and the corrosion configurations were observed. The acceptance and rejection criteria were such that acceptance (○ in table) was given to the test materials exhibiting no local corrosion as compared with cast bronzes that are comparative materials and that rejection was given to the test materials exhibiting local corrosions. As shown in Table 14, both the test materials were given acceptance.

TABLE 14

| Test material | Determination | Mass loss (g) | Corrosion configuration | Corrosion depth (μm) |
|---|---|---|---|---|
| Test material 4 (production by method B: rod material) | ○ | 0.37 | Stratified | 69 |
| Test material 3 (production by method A: cast product) | ○ | 0.37 | Stratified | 38 |
| Cast bronze (CAC 406) | — | 0.26 | Stratified | 60 |
| Cast bronze (CAC 407) | — | 0.33 | Stratified | 65 |

As described above, by having Sb contained in the brass alloy of the first invention, like the billet 2 in Table 3, and subjecting the resultant alloy to heat treatment that was annealing for α-phase transformation, it was possible to enhance the stress corrosion cracking resistance. In addition, in this case, it was possible to secure excellent dezincification corrosion resistance and erosion-corrosion resistance that were the characteristics of a brass alloy.

Next, a preferred embodiment of leadless brass alloys excellent in stress corrosion cracking resistance according to the second invention will be described in detail. The leadless brass alloy of the second invention is a leadless brass alloy having the stress corrosion cracking resistance enhanced by having Sn contained in a Bi-based leadless brass alloy to precipitate γ phases and dispersing the γ phases uniformly in a metallic structure to become sections to be preferentially corroded, thereby suppressing local corrosions on the alloy surface.

Figure 26:
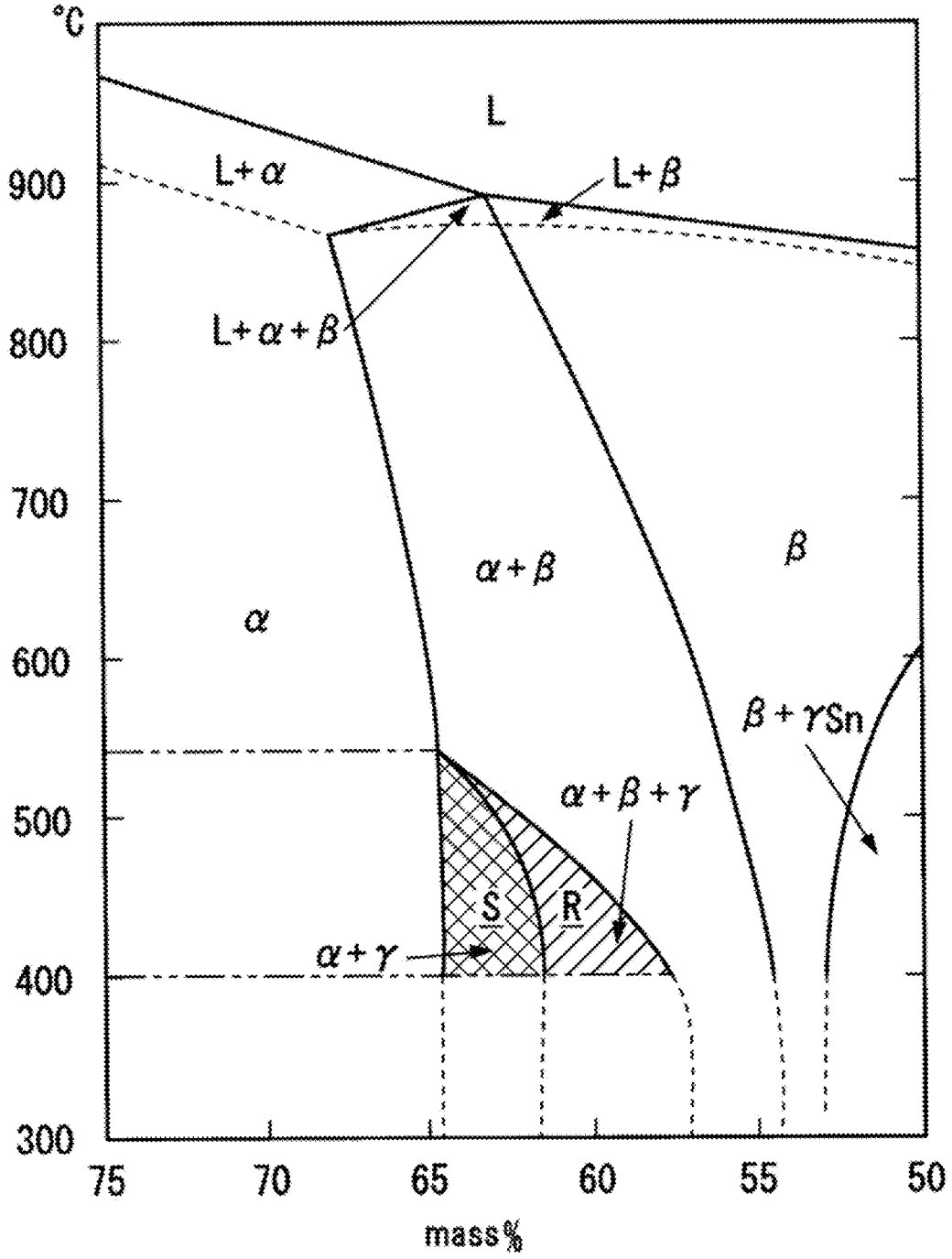
FIG. 26 is a state diagram of a brass alloy containing 1% of Sn.

Since the elements contained in the leadless brass alloy, their desirable composition ranges and the reason for them in the second invention are the same as those in the first invention, the description thereof will be omitted. In order to uniformly dispersing the γ phases, production is performed using an appropriate and desirable producing method selected from the producing methods A to D shown in FIG. 5 to obtain a state shown in FIG. 26 having an α+γ structure (refer to a range S) shown by cross hatching and an α+β+γ structure (refer to a range R) shown by hatching. Particularly by performing α-phase transformation to suppress induction of β phases, as is done in the methods B to D, it becomes possible to uniformly disperse the γ phase and enhance the stress corrosion cracking resistance while exhibiting dezincification resistance.

Here, as means for selecting the appropriate and desirable producing method necessary for uniformly dispersing the γ phases in the leadless brass alloy of the second invention, an evaluation method using an "evaluation coefficient" will be described. The term "evaluation coefficient" means a value obtained by quantifying (classifying the weight of) the influences of producing steps (factors) including drawing, heat treatment, etc. on the stress corrosion cracking resistance in the method for producing a rod material of leadless brass alloy using statistical means and multiplying the quantified factors. For example, as an example using a rod material of a diameter of ø 32 produced through the steps "extrusion" and "α-phase transformation (temperature: 470° C.)" and calculating an evaluation coefficient of a test material produced from the rod material without performing "drawing" and "heat treatment before and after drawing" to become 1 as a criterion value, the evaluation coefficient can be represented by the following formula.

"Evaluation coefficient"=Influence of rod material diameter×Influence of temperature for α-phase transformation×Influence of drawing×Influence of heat treatments before and after drawing=$a/32(1+|470-t|/100)$×(performing drawing:0.8)×(performing heat treatments before and after drawing:0.3) [Formula 2]

Incidentally, a stands for the rod material diameter (unit: mm), and t for the temperature for α-phase transformation (° C.) and, therefore, the evaluation coefficient a dimensionless number. In addition, in case where annealing for α-phase transformation is not performed, the influence of temperature for α-phase transformation (1+|470−t|/100) is quantified as 1.

EXAMPLE 10

A billet having the chemical components shown in Table 15 was used to produce test materials 1 to 23 of rod material diameters through the producing steps (annealing before drawing, drawing and annealing after drawing), a stress corrosion cracking test similar to that in Example 3 of the first invention was performed, and Formula 2 was used to calculate evaluation coefficients. Stress corrosion cracking time periods (SCC time periods) that are results of the stress corrosion cracking test and the calculated evaluation coefficients are shown in Table 16 and, at the same time, the relation between the evaluation coefficient and the stress corrosion cracking time period is shown by a graph of FIG. 27.

TABLE 15

| Cu | Sn | Bi | Se | Ni | P or Sb | Zn |
|---|---|---|---|---|---|---|
| 60.4 | 1.5 to 1.6 | 1.3 to 1.4 | 0.03 | 0.2 | 0.1 | Balance |

TABLE 16

| No. | Rod material diameter | Annealing temperature before drawing ° C. | Drawing | Annealing temperature after drawing ° C. | Stress Corrosion Cracking Hr | Evaluation coefficient |
|---|---|---|---|---|---|---|
| 51 | 33 | Absence | Absence | Absence | 38.40 | 1.03 |
| 52 | 33 | Absence | Absence | Absence | 43.20 | 1.03 |
| 53 | 33 | 470 | Absence | Absence | 43.20 | 1.03 |
| 54 | 33 | 500 | Presence | 330 | 0.00 | 0.32 |

TABLE 16-continued

| No. | Rod material diameter | Annealing temperature before drawing ° C. | Drawing | Annealing temperature after drawing ° C. | Stress Corrosion Cracking Hr | Evaluation coefficient |
|---|---|---|---|---|---|---|
| 55 | 33 | 500 | Presence | 330 | 0.67 | 0.32 |
| 56 | 33 | 500 | Presence | 330 | 0.67 | 0.32 |
| 57 | 32 | 500 | Presence | 330 | 0.00 | 0.31 |
| 58 | 28 | Absence | Absence | Absence | 30.0 | 0.81 |
| 59 | 33 | Absence | Absence | Absence | 30.00 | 1.03 |
| 60 | 33 | 425 | Absence | Absence | 46.00 | 1.50 |
| 61 | 33 | 450 | Absence | Absence | 40.00 | 1.24 |
| 62 | 33 | 475 | Absence | Absence | 36.00 | 1.08 |
| 63 | 33 | 500 | Absence | Absence | 44.00 | 1.34 |
| 64 | 34 | 450 | Absence | Absence | 48.00 | 1.28 |
| 65 | 32 | 450 | Presence | Absence | 30.00 | 0.96 |
| 66 | 32 | 450 | Presence | Absence | 32.00 | 0.96 |
| 67 | 32 | 450 | Presence | 330 | 12.00 | 0.29 |
| 68 | 34 | 450 | Absence | Absence | 42.00 | 1.28 |
| 69 | 26 | 450 | Presence | Absence | 26.00 | 0.78 |
| 70 | 26 | 450 | Presence | 330 | 3.30 | 0.23 |
| 71 | 26 | Absence | Presence | Absence | 22.00 | 0.65 |
| 72 | 32 | 450 | Presence | 330 | 3.30 | 0.29 |
| 73 | 32 | 450 | Presence | 450 | 14.7 | 0.29 |

Figure 27:
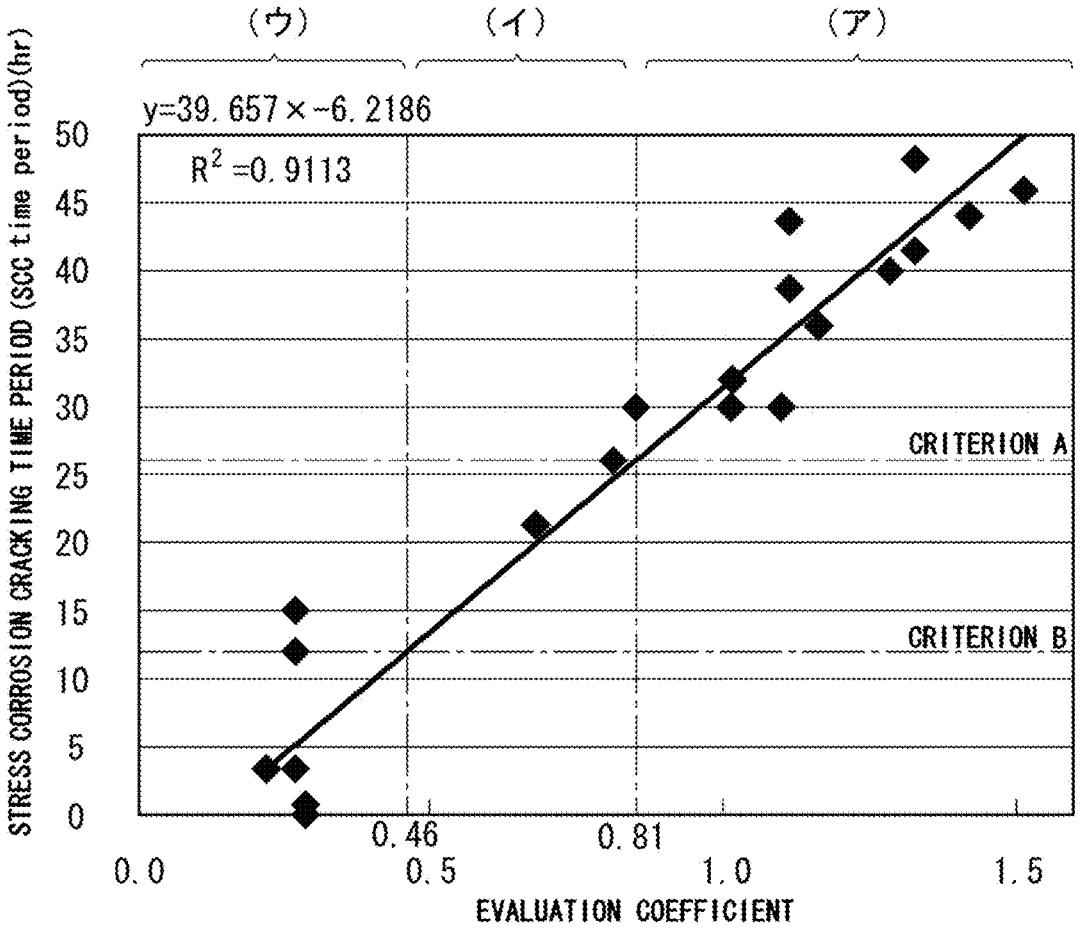
FIG. 27 is a graph showing the relation between the evaluation coefficient and the stress corrosion cracking time period.

It is found from FIG. 27 that the evaluation coefficient and stress corrosion cracking time period have ever-increasing substantially straight-line relation, i.e. a tendency to prolong the SCC time period in proportion as the evaluation coefficients increases. In addition, the relational expressions ($y=39.657x\times-6.2186$, $R^2=0.9113$) shown in the figure shows high correlation between the evaluation coefficient and the SCC time period. According to FIG. 27, the evaluation coefficient satisfying criterion B (stress corrosion cracking time period: 12 hours) is 0.46 or more, and that satisfying criterion A (stress corrosion cracking time period: 26 hours) is 0.81 or more.

Figure 28:
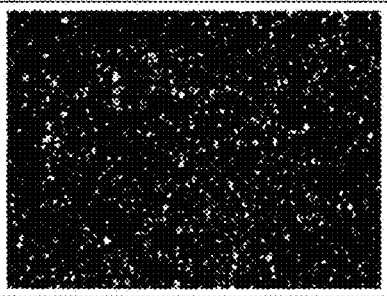
FIG. 28 shows enlarged photographs showing the states of γ-phase distribution.
Figure 28:
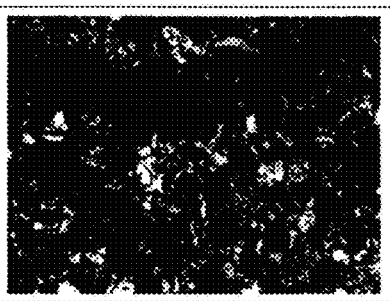
Figure 28:
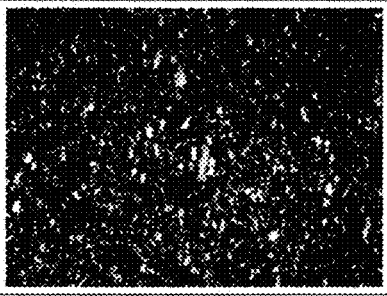
Figure 28:
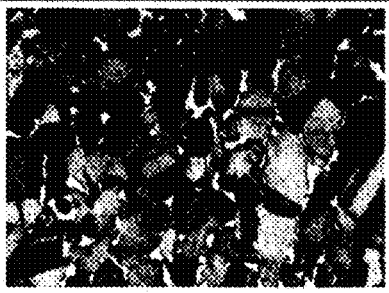
Figure 28:
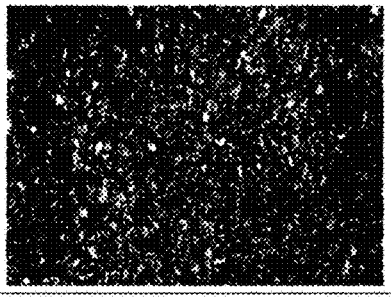
Figure 28:
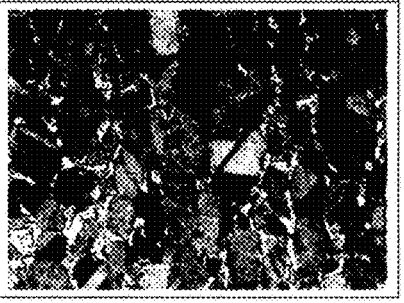

FIG. 28 shows photographs (observations at 200 magnifications and 1000 magnifications) of microstructures of test materials No. 60, No. 69 and No. 70 in Table 16. The evaluation coefficients-stress corrosion cracking time periods of the test materials are 1.50-46 hr, 0.78-26 hr and 0.23-3.3 hr, respectively, corresponding respectively to areas (ア), (イ) and (ウ) in the graph of FIG. 27. The section of the microstructure observed is a longitudinal section structure in the vicinity of the Rc ½ screw part of the test material shown in FIG. 2 having subjected to the stress corrosion cracking test. This structure shows a microstructure in the longitudinal direction of the rod material extruded and shows that the stress corrosion cracking time period becomes short in proportion as the γ phases existing to surround the grains exhibit high distribution of states of being aligned in the longitudinal direction of the photographs.

Sample No. 60 is subjected to a treatment for α-phase transformation at 425° C. falling outside the optimum temperature to be described later and, because of the presence of residual β phases, exhibits good γ-phase distribution, a long stress corrosion cracking time period and good stress corrosion cracking resistance. Sample No. 69 is subjected to a treatment for α-phase transformation at 450° C. near the optimum temperature and, because of few residual β phases, exhibits good stress corrosion cracking resistance though a tendency to align the γ phases in the longitudinal direction is found. Sample No. 70 is subjected to heat treatments before and after drawing and, because of a high tendency to align the γ phases in the longitudinal direction, exhibits a short stress corrosion cracking time period.

Next, the factors of the evaluation coefficient will be described.

(1) Influence of Rod Material Diameter (Criterion Value in Formula 2: ø 32)

Figure 29:
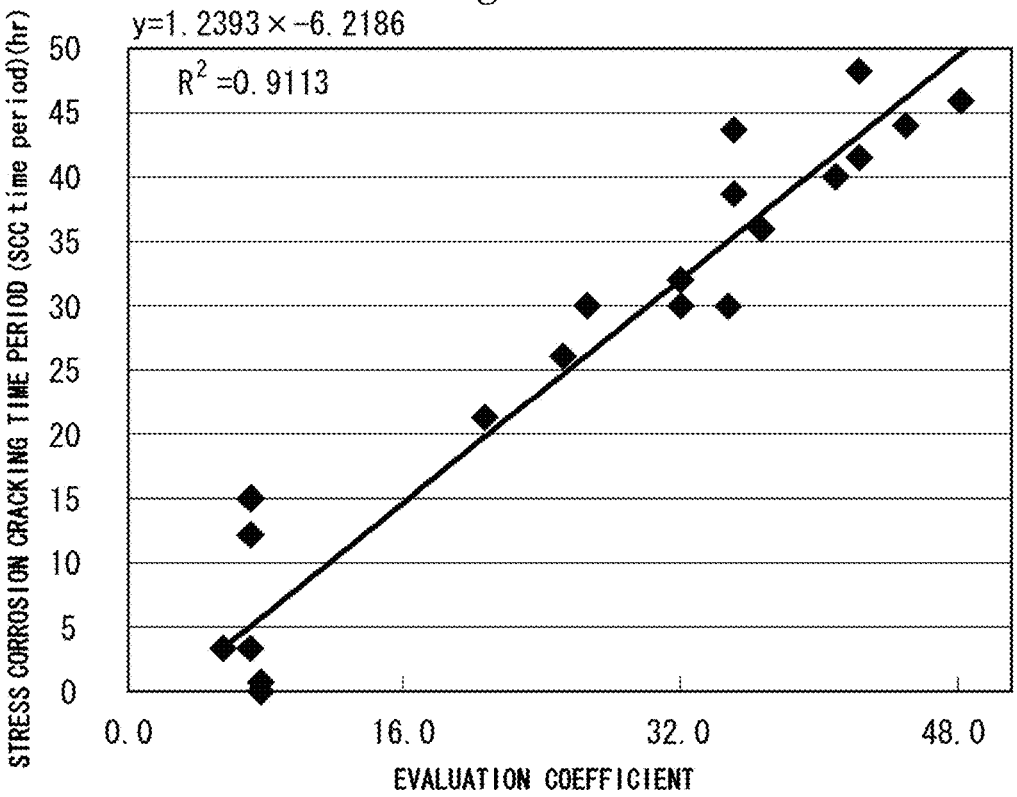
FIG. 29 is a graph showing the case where the criterion value of the rod material diameter (φ1) varies.
Figure 30:
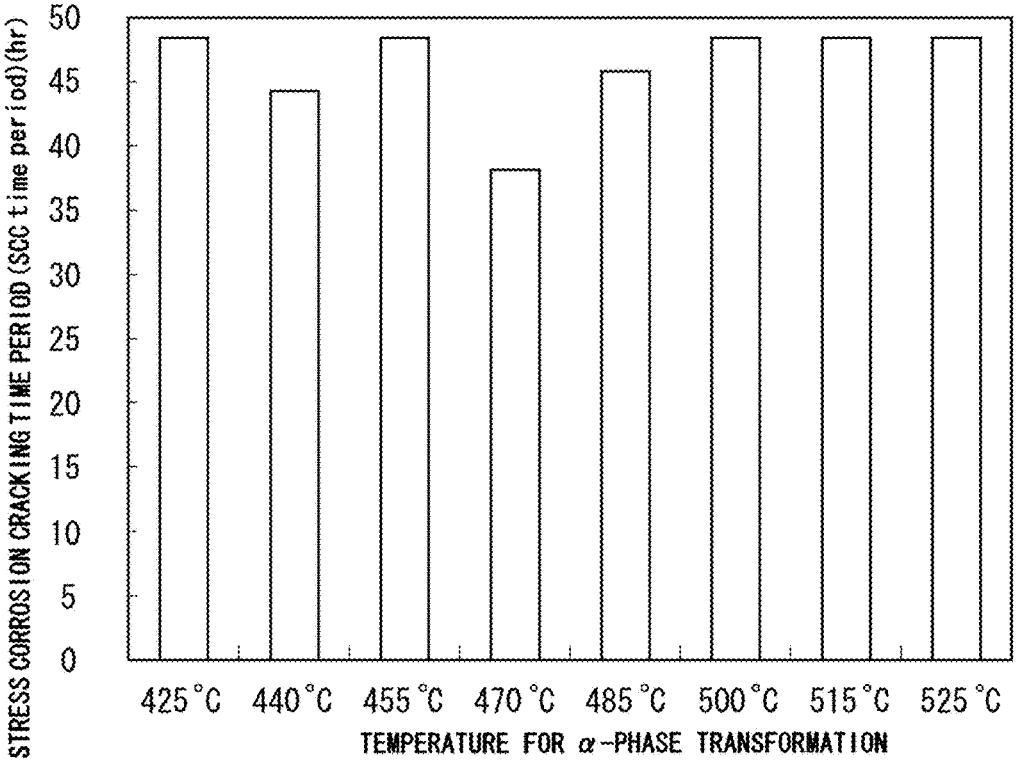
FIG. 30 is a graph showing the relation between the temperature for α-phase transformation and the fracture time period of the stress corrosion cracking property.

The "influence of rod material diameter" is a factor contributing to an increase or decrease in relative value of the evaluation coefficient and not directly affecting the relation between the evaluation coefficient and the stress corrosion cracking time period. When the criterion value of the rod material diameter is ø 1, i.e. when the influence of the rod material is a/1, for example, the relation between the evaluation coefficient and the stress corrosion cracking time period is shown by a graph in FIG. 29. So, when the criterion value is ø 1, the value of the evaluation coefficient becomes large in comparison with the graph in FIG. 30, obtained when the criterion value is ø 32 and, though the inclination and intercept of the graph vary, the value of the "correlation coefficient $R^2$" showing the correlation between the evaluation coefficient and the stress corrosion cracking time period does not vary. Therefore, the "influence of the rod material diameter" does not directly affect the relation between the evaluation coefficient and the stress corrosion cracking time period, is a numerical number appropriately selective in accordance with an object of an evaluator and is an optional factor in the "evaluation coefficient".

(2) Influence of Temperature for α-Phase Transformation (Criterion Value in Formula 2: 470° C.)

The "influence of temperature for α-phase transformation" is a factor for increasing or decreasing a substantial value of the evaluation coefficient and slightly affects the relation between the evaluation coefficient and the stress corrosion cracking resistance. In the leadless brass alloy of the present invention, at an optimum temperature for α-phase transformation, 455° C.<t<475° C. (485° C. with further certainty), a tendency is such that the dezincification resistance is enhanced, whereas the γ-phase distribution becomes deteriorated and the SCC resistance is lowered. As a concrete example, a billet having the chemical component values shown in Table 15 is used, extruded into a sample having a rod material diameter of ø 33, the sample was tested for stress corrosion cracking similarly to that in Example 3 of the first invention. The results thereof are shown by graphs in FIG. 30 as the relation between the temperature for α-phase transformation and the stress corrosion cracking time period. Though the data have a slight variation, since the data obtained at 470° C. shows the shortest stress corrosion cracking time period (SCC time period), in an appropriately desirable producing method required for uniform dispersion of the γ phases, the α-phase transformation is performed at a temperature higher or lower than 470° C. to enable suppression of lowering the stress corrosion cracking resistance. In consideration of the balance between the stress corrosion cracking resistance and the dezincification resistance, however, the optimum temperature at which the α-phase transformation is performed is in the range of 425° C. to 455° C. Therefore, the "influence of temperature for α-phase transformation" slightly affects the relation between the evaluation coefficient and the stress corrosion cracking time period and is an optional factor in the "evaluation coefficient".

(3) Influence of Drawing (Degree of Influence: 0.8)

Figure 31:
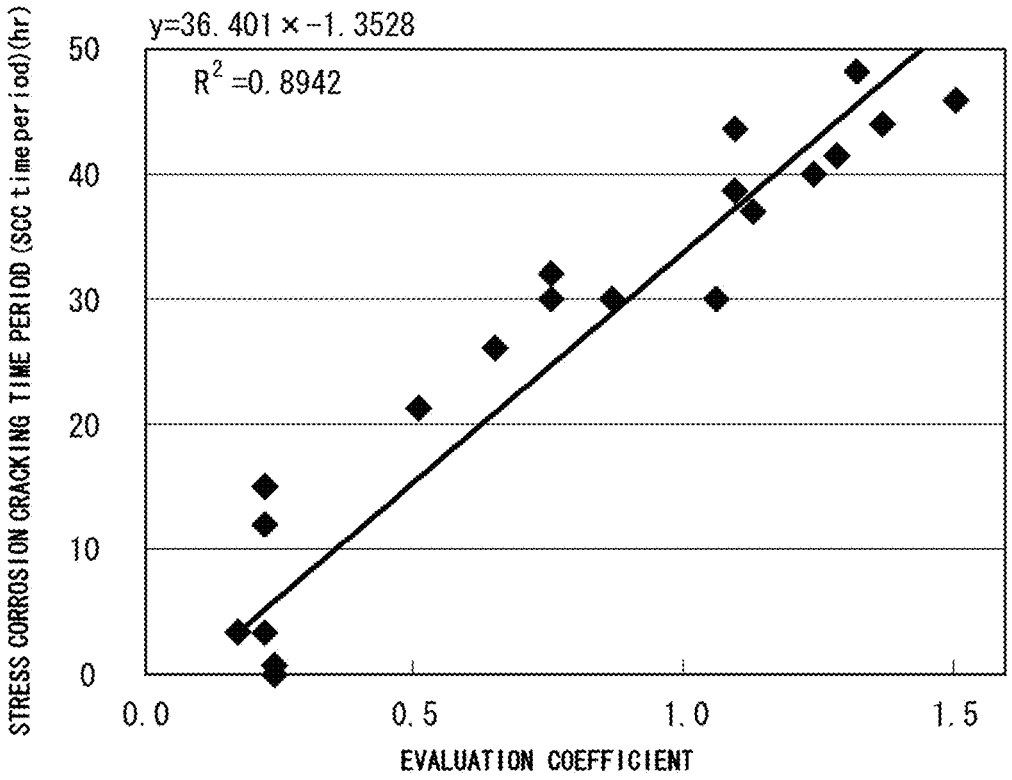
FIG. 31 is a graph showing a variation by a degree of the drawing influence (0.6).

The "influence of drawing" is a factor for increasing or decreasing the substantial value of the evaluation coefficient and affects the relation between the evaluation coefficient and the stress corrosion cracking time period. Though it is generally said that the stress corrosion cracking resistance of a brass alloy is enhanced owing to the fact that the step of drawing brings about high tensile strength or high proof stress, since the toughness, such as elongation, impact, etc. has a tendency to lower, when a rod material having undergone the step of drawing has a cutout induced on the surface thereof by corrosion, there is a possibility of a crack propagating rapidly. Another example in which the degree of influence of drawing has been set to be 0.6 is shown in FIG. 31. In the graph thereof, since the correlation coefficient is shown as $R^2$=0.8942, the correlation between the evaluation coefficient and the SCC time period is slightly lowered as compared with the case of FIG. 27 in which the degree of influence of drawing is 0.8. In order to obtain the correlation coefficient of 0.9 or more, it is better to set the degree of influence of drawing to be 0.6 to 0.9 (example: the correlation coefficient in the case where the degree of influence of drawing was 0.9 was expressed as $R^2$=0.8997). In an appropriately desirable producing method required for uniform dispersion of the γ phases, a next step of the treatment for α-phase transformation is taken without performing drawing to enable the enhancement of the stress corrosion cracking resistance. Therefore, the "influence of drawing" affects the relation between the evaluation coefficient and the stress corrosion cracking time period and is a factor indispensable to the "evaluation coefficient".

(4) Influence of Heat Treatments Performed Before and after Drawing (Degree of Influence: 0.3)

Figure 32:
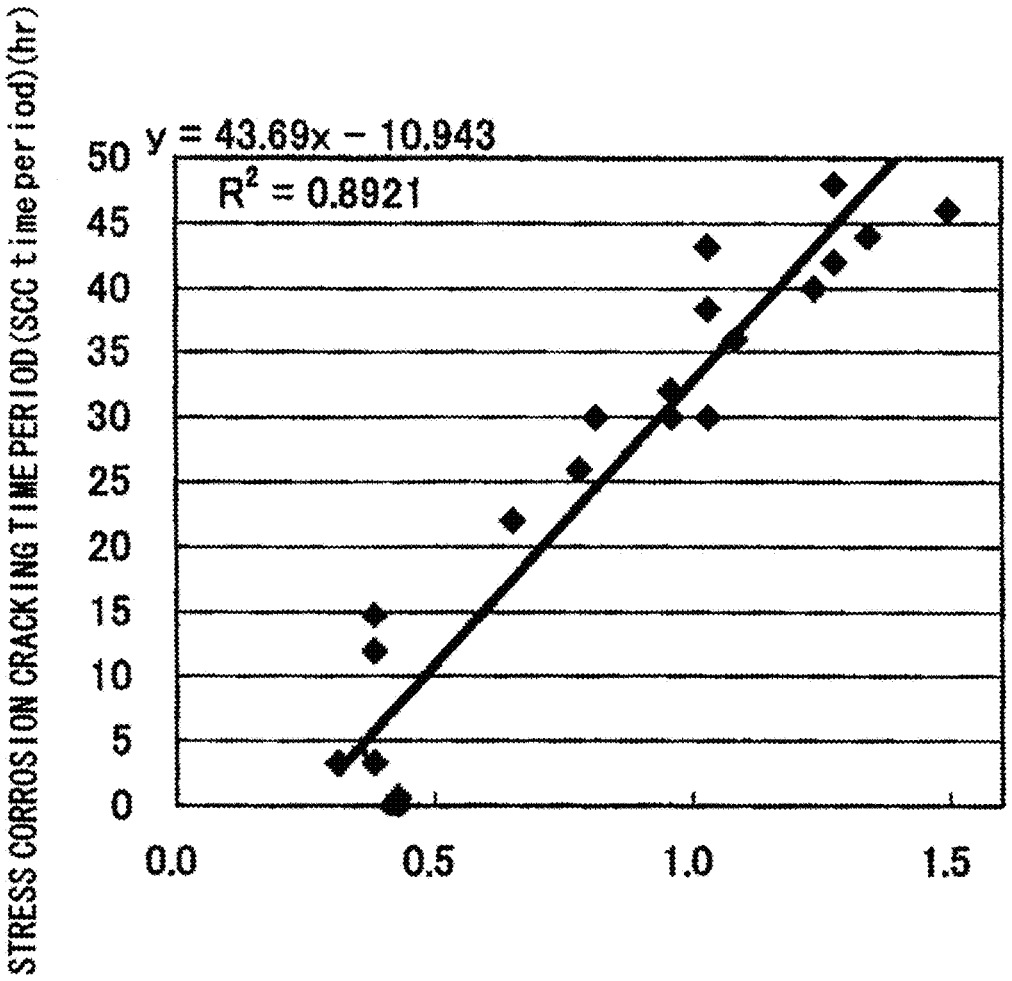
FIG. 32 is a graph showing a variation by a degree of the drawing influence (0.4).
Figure 33:
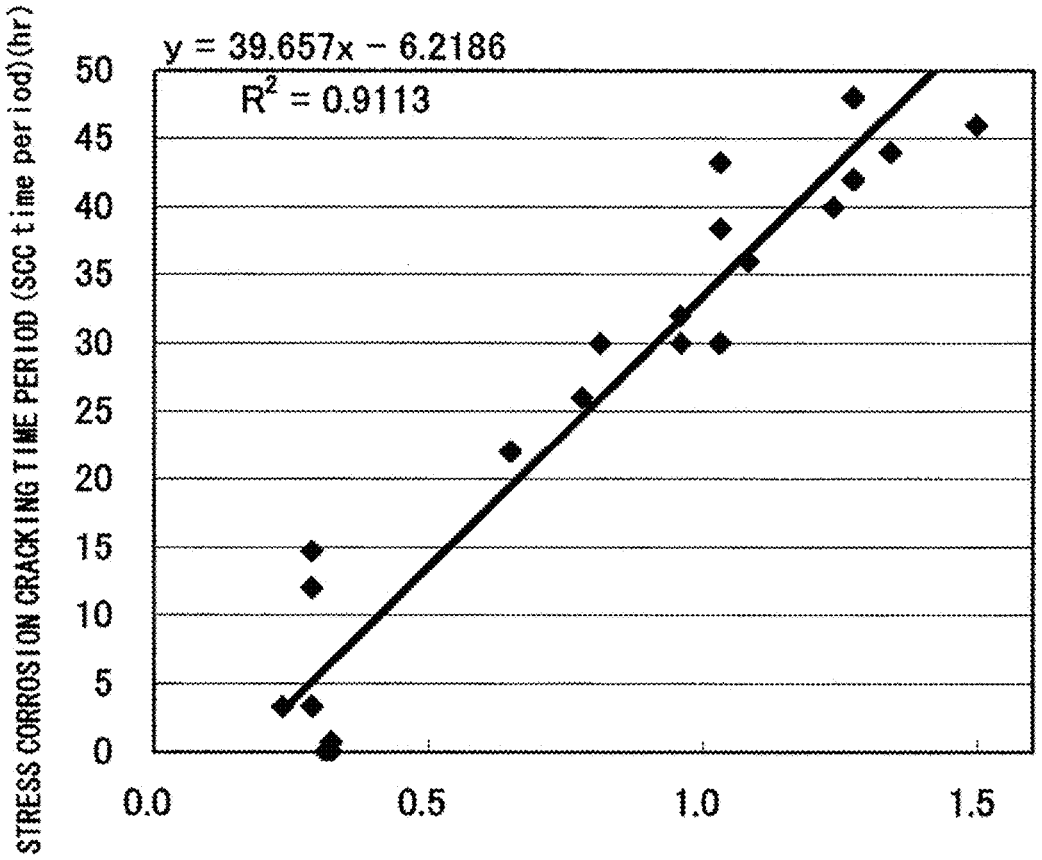
FIG. 33 is a graph showing a variation by a degree of the drawing influence (0.2).

The "influence of heat treatments performed before and after drawing" is a factor for increasing or decreasing the substantial value of the evaluation coefficient and greatly affects the relation between the evaluation coefficient and the stress corrosion cracking time period. FIG. 32 and FIG. 33 are graphs showing variations induced by the influence of heat treatments performed before and after drawing, the degree of influence in FIG. 32 is 0.4 or less, in which the best thereof is 0.3, the degree of influence in FIG. 27 is 0.3 and that in FIG. 33 is 0.2. As is clear from these figures, making the degree of influence smaller makes the correlation coefficient high. Table 17 below shows a combination of the upper and lower limits of each evaluation coefficient factor and an evaluation coefficient boundary value.

TABLE 17

Upper and lower limits of each factor affecting stress corrosion cracking resistance and evaluation coefficients corresponding to criteria A and B

| | Evaluation coefficient factor | | | | | Evaluation coefficient | | |
|---|---|---|---|---|---|---|---|---|
| No. | Rod material diameter ø a mm | Temperature for α-phase transformation t ° C. | Drawing | Heat treatments performed twice | Correlation coefficient $R^2$ | Criterion A (26 hr) | Criterion B (12 hr) | Remarks |
| 1 | 32 | 450 | 0.6 | 0.2 | 0.8469 | 0.70 | 0.29 | Min. value |
| 2 | 32 | 450 | 0.6 | 0.4 | 0.7796 | 0.75 | 0.37 | |
| 3 | 32 | 450 | 0.9 | 0.2 | 0.8671 | 0.77 | 0.39 | |
| 4 | 32 | 450 | 0.9 | 0.4 | 0.7742 | 0.86 | 0.53 | |
| 5 | 32 | 475 | 0.6 | 0.2 | 0.9142 | 0.74 | 0.32 | |
| 6 | 32 | 475 | 0.6 | 0.4 | 0.8826 | 0.79 | 0.42 | |
| 7 | 32 | 475 | 0.9 | 0.2 | 0.9089 | 0.82 | 0.42 | |
| 8 | 32 | 475 | 0.9 | 0.4 | 0.8821 | 0.89 | 0.58 | Max. value |
| 9 | 32 | 470 | 0.6 | 0.2 | 0.9093 | 0.73 | 0.32 | |
| 10 | 32 | 470 | 0.6 | 0.4 | 0.8736 | 0.78 | 0.41 | |
| 11 | 32 | 470 | 0.9 | 0.2 | 0.9103 | 0.81 | 0.42 | |
| 12 | 32 | 470 | 0.9 | 0.4 | 0.8794 | 0.88 | 0.57 | |
| Optimum value | 32 | 470 | 0.8 | 0.3 | 0.9113 | 0.81 | 0.46 | |

Table 17 shows the upper and lower limits of each factor affecting the stress corrosion cracking resistance and evaluation coefficients corresponding to criteria A and B. From the table, it is possible to take 0.70 to 0.89 as the evaluation coefficient corresponding to criterion A and 0.29 to 0.58 as the evaluation coefficient corresponding to criterion B through variation in each evaluation coefficient factor. This shows that the variation is made depending on a difference or variation in production equipment and production conditions and further on a variation in stress corrosion cracking test results. By causing each factor to have substantially the optimum value, an alloy good in γ-phase distribution and excellent in stress corrosion cracking resistance can be obtained. As a result, the optimum evaluation coefficient corresponding to criterion A is 0.81 and that corresponding to criterion B is 0.46.

In FIG. 32, FIG. 33 and Table 17, when heat treatment is performed in a state of the residual stress of a material being high, phase transformation propagates readily. In the case of the brass alloy of the present invention, through a high degree of distortion working and heat treatments performed twice, i.e. through the procedure of extrusion→annealing for α-phase transformation→drawing→annealing for distortion removal, there is a fair possibility of the γ-phase distribution being deteriorated and the SCC resistance being lowered. The influence of the heat treatments performed before and after drawing can be set from the correlation coefficient of the regression line of a graph showing the evaluation coefficient and stress corrosion cracking time period. With a setting in a range capable of obtaining high correlation as a standard, a preferable affection of heat treatments performed before and after the drawing is 0.4 or less (Refer to FIG. 32). In addition, by making the affection of heat treatments performed before and after the drawing close to 0, a high correlation coefficient can be acquired. This case shows that the evaluation coefficients of Nos. 54, 55, 56, 57, 67, 70, 72 and 73 in Table become close to 0 and that the stress corrosion cracking time periods become in the vicinity of 0.0 hour. Though the stress corrosion cracking time periods of Nos. 54 and 57 in Table 14 are shown as 0.0 hour, the actual time periods are four hours or less, meaning that all the test pieces have been cracked. That is to say, since it is contradictory that the stress corrosion cracking time period becomes 0.0 hour, it is undesirable that the influence of heat treatments performed before and after the drawing is set to be in the vicinity of 0. In view of the above, a preferable lower limit of the influence of heat treatments performed before and after the drawing is 0.2 (Refer to FIG. 33). In addition, most suitable influence of heat treatments performed before and after the drawing is 0.3 (Refer to FIG. 27).

In addition, an appropriately desirable producing method required to uniformly disperse γ phases includes one heat treatment performed either before or after the drawing performed in producing methods B and D in FIG. 5, thereby enabling the enhancement of the stress corrosion cracking resistance. Therefore, the "influence of heat treatments performed before and after the drawing" greatly affects the relation between the evaluation coefficient and the stress corrosion cracking time period and is a factor indispensable to the "evaluation coefficient". As described above, by performing an evaluation using the "evaluation coefficient", it is possible to easily select a desirable producing method required to uniformly disperse γ phases in the leadless brass alloy of the second invention and to efficiently obtain a leadless brass alloy having a desired stress corrosion cracking resistance.

Next, corrosion in the second invention will be described. The corrosion in the second invention indicates that a metal is rusted in consequence of reaction with water or oxygen in an environment and has the surface thereof discolored, damaged and worn and is divided into general (uniform) corrosion and local corrosion. The general corrosion means that wear damage (corrosion) of the metal surface propagates uniformly as shown in FIG. 34(*a*) and, at the time of the general corrosion, both an anode reaction and a cathode reaction proceed uniformly on the metal surface.

Figure 34:
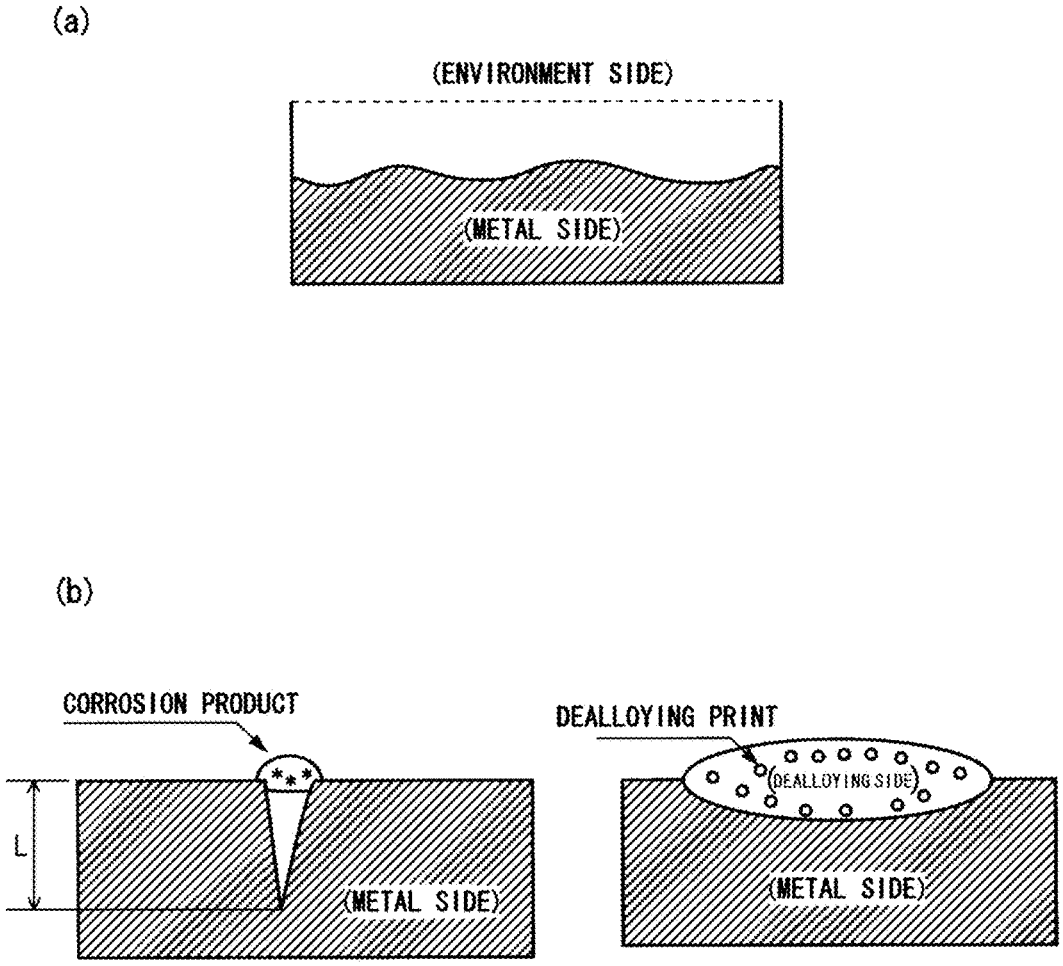
FIG. 34 shows schematic cross section showing the states of metals corroded.

On the other hand, the local corrosion assumes a corrosion configuration in which one of alloy components is selectively dissolved as shown in FIG. 34(*b*) and which is induced when an anode reaction is concentrically made at a certain section of the metal surface. At this time, a cathode section is in a passive state in which little metal dissolution proceeds and, at this section, only a cathode reduction reaction of oxygen proceeds. On the other hand, an anode section is in an active state in which metal dissolution is easy to occur and, at this section, only an anode reaction proceeds. Generally, in this case, since the area of the anode section becomes extremely small in comparison with the area of the cathode section, the corrosion current density at the anode section becomes extremely large, thereby inducing propagation of active local corrosion.

In this case, in the state of the local corrosion, a stress is easy to concentrate at a remarkably corroded place to shorten a time period required until induction of cracks. On the other hand, in the case of the general corrosion, the alloy surface is uniformly corroded to alleviate the stress concentration, thereby prolonging the time period required until induction of cracks in comparison with the local corrosion. That is to say, in order to alleviate the stress concentration, it is important to adopt a general corrosion configuration and, for this reason, it is important to control the distribution or abundance, shape, etc. of intervening phases that can become anode sections. As parameters for controlling these, (1) the degree of dispersion of the intervening phases (2) the degree of circularity of the intervening phases and (3) the α-phase aspect ratio were used. Each parameter will be described hereinafter. The intervening phases used herein indicate components not contained in the α phase or β phase as solutions and intermetallic compounds and, as examples thereof, a Bi phase, Pb phase, γ phase and Zn—Se phase can be raised. Particularly, in the description of the parameters shown hereinafter, they indicate the γ phase or Pb phase preferentially corroded in comparison with the α phase.

Incidentally, since the stress corrosion cracking is a phenomenon occurring when the corrosion depth has reached a specific depth (Refer to dimension L in FIG. 34(*b*)), in the case of the so-called general corrosion configuration in which the corrosion propagates gradually and uniformly on the whole surface of a metal, it is possible to delay the time period until the corrosion reaches the specific depth and to suppress the induction of cracks. As an example of specific depth, the maximum corrosion depth (example: maximum corrosion depth=about 59.4 μm in a corrosion time period of 144 hours) of the present invention product in Table 24 of Example 17 described later can be cited.

(1) Degree of Dispersion of Intervening Phases:

In order to acquire the degree of dispersion of intervening phases, in the present example, 19×19 grids (one grid of 13 μm×17 μm) were limned on the photograph of a microstructure taken at 400 magnifications, the values of (the number of grids in which the intervening phases exist)/(the number of all the grids of 361) were measured and the average value thereof was calculated when n=5. The calculation result is used as the degree of dispersion of the intervening phases that is an index for expressing how many intervening phases exist in a dispersed state and means that the dispersion is large in proportion as the index is close to 1. In addition, since the degree of dispersion becomes low when the amount of the inclusions existing is small, it also includes the amount of the existing inclusions as an element.

(2) Degree of Circularity of Intervening Phases:

The degree of circularity of intervening phases was measured by the graphite shape coefficient method using the measurement principle of the graphite spheroidizing ratio in spherical graphite cast iron. In the present example, measurements were made when n=30 to calculate the average value thereof. The degree of circularity of the intervening-phases is an index for expressing the shape of the intervening phases and means that the shape becomes a perfect circle in proportion as the index is close to 1 and becomes a shape out of a perfect circle in proportion as the index is away from 1. Since the shape is close to a perfect circle when the amount of the inclusions exiting is small, the degree of circularity also includes the amount of the existing inclusions as an element.

(3) α-Phase Aspect Ratio

Figure 35:
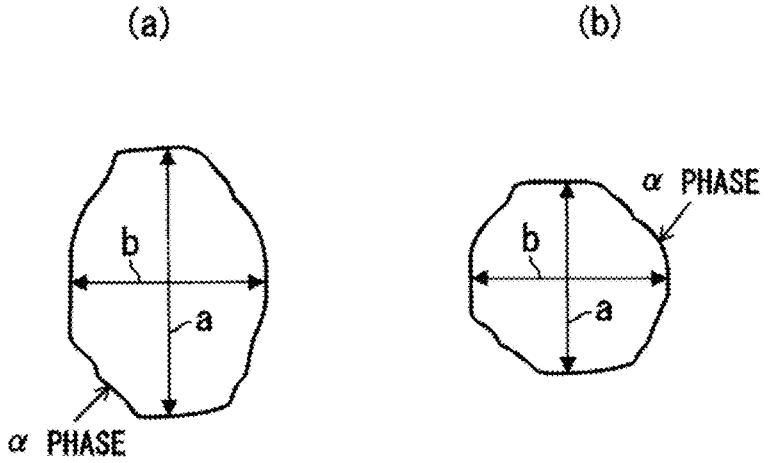
FIG. 35 schematically shows the longitudinal and lateral lengths of the α phase of an alloy in ground plan.

The ratio of the longitudinal length of the α phase on the alloy surface to the lateral length thereof was measured, and the measurement result was used as the α-phase aspect ratio. In the present example, measurements were made when n=30, and the average value thereof was measured. When the longitudinal length of the α phase is expressed as a, and the lateral length thereof as b, as shown in FIG. 35, the α phase assumes a shape close to a perfect circle as shown in FIG. 35(*b*) when the α-phase aspect ratio a:b becomes close to 1 and a vertically long shape as shown in FIG. 35(*a*) when the α-phase aspect ratio becomes away from 1. Furthermore, the intervening phases are distributed so as to surround the α-phase grain boundaries when the α-phase aspect ratio is close to 1. On the other hand, when the α-phase aspect ratio is large, the γ phases have a tendency to exist to get in line longitudinally. That is to say, the α-phase aspect ratio includes the degree of dispersion and shape of the intervening phases as elements.

EXAMPLE 11

Subsequently, the relation between the three parameters that are the degree of dispersion of the intervening phases, the degree of circularity of the intervening phases and the α-phase aspect ratio, and the stress corrosion cracking resistance will be led to. In order to lead to the relation between the parameters and the stress corrosion cracking resistance, parameters of brass alloys of the second invention are actually measured and, for comparison with the brass alloys of the present invention, brass alloys having different chemical component values are similarly measured actually.

An example of brass alloy of the second invention has chemical components values as shown in Table 18 (hereinafter referred to as the "present invention product". Brass alloys for comparison (hereinafter referred to as the "comparative examples) 1, 3 and 4 having chemical component values shown in Table 18 are prepared.

TABLE 18

| | | Cu | Pb | Fe | Sn | Bi | Se | Ni | P | Sb | Zn |
|---|---|---|---|---|---|---|---|---|---|---|---|
| Present invention product | | 60.4 | — | 0.0 | 1.6 | 1.4 | 0.03 | 0.2 | 0.0 | 0.09 | Bal. |
| Comp. Ex. | 1 | 62.4 | 2.6 | 0.1 | 0.3 | — | — | 0.1 | 0.1 | — | Bal. |
| | 3 | 62.3 | — | 0.0 | 0.4 | 1.7 | 0.03 | 0.2 | 0.1 | — | Bal. |
| | 4 | 61.3 | 1.9 | 0.1 | 1.1 | — | — | 0.1 | 0.1 | — | Bal. |

The degree of dispersion of the intervening phases, degree of circularity of the intervening phases and α-phase aspect ratio of the present invention product (second invention) and comparative examples were measured using samples having a material diameter of ø 32 and, in a tensile SCC property test, the time of each sample being fractured when a tensile force was exerted thereon under a load stress of 50 MPa within a desiccator in a 14% ammonia atmosphere was examined. The results thereof are shown in Table 19. The test method of the tensile SCC property test is the same as in an example to be described later.

Figure 36:
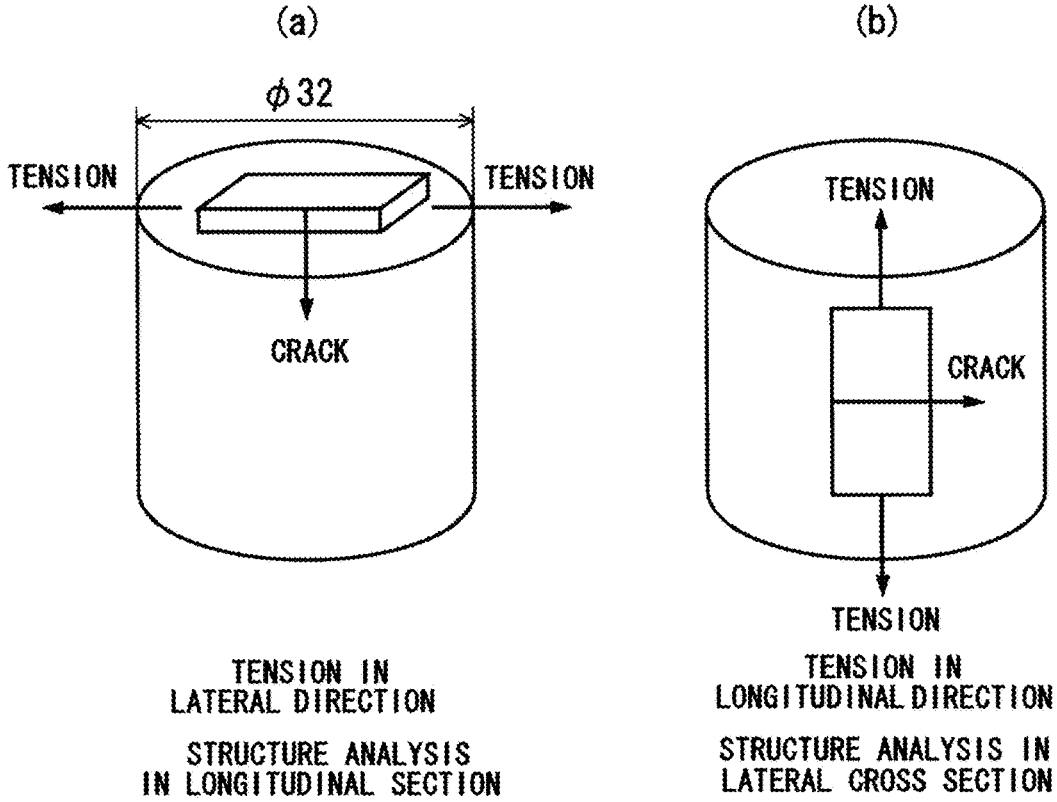
FIG. 36 explanatory shows the tension directions and observation surfaces in tensile SCC property tests.

The intervening phases of each sample to be measured are γ phases in the present invention product and Comparative Example 3, Pb phases in Comparative Example 1 and γ phases and Pb phases in Comparative Example 4. In addition, the "tension direction" and "observation surface" in Table 19 indicate, respectively, the direction in which a tensile force is applied to a sample extracted from a rod material and the surface on which the parameters are measured, as shown in FIG. 36. Incidentally, in the present example, the present invention product was produced by producing method A in Table 5, Comparative Example 1 by producing method B, Comparative Example 2 (Refer to Table 20) by producing method A, Comparative Example 3 by producing method C and Comparative Example 4 by producing method A.

TABLE 19

| | No. | Tension direction | Observation surface | Tensile SCC fracture time period 14%-50 MPa | Degree of dispersion | Degree of circularity of intervening phases | α-phase aspect ratio | x |
|---|---|---|---|---|---|---|---|---|
| Comp. Ex. 4 | 11 | (a) Lateral direction | Longitudinal section | 33.2 hr | 0.64 | 0.53 γ 0.66 Pb 0.60 (Ave.) | 1.9 | 0.56 |
| | 12 | (b) Longitudinal direction | Horizontal section | 96.0 hr | 0.83 | 0.46 γ 0.71 Pb 0.58 (Ave.) | 1.0 | 1.43 |
| Comp. Ex. 1 | 13 | (a) Lateral direction | Longitudinal section | 41.7 hr | 0.68 | 0.81 | 1.9 | 0.44 |
| | 14 | (b) Longitudinal direction | Horizontal section | 179.6 hr | 0.93 | 0.77 | 1.0 | 1.21 |
| Present Invention | 15 | (a) Lateral direction | Longitudinal section | 157.3 hr | 0.94 | 0.48 | 1.8 | 1.09 |
| | 16 | (b) Longitudinal direction | Horizontal section | 334.0 hr (75 MPa) | 1.00 | 0.41 | 1.0 | 2.44 |
| Comp. Ex. 3 | 17 | (a) Lateral direction | Longitudinal section | 4.3 hr | 0.07 | 0.78 | 2.2 | 0.04 |

*x: Degree of dispersion/(Degree of circularity of intervening phases × Aspect ratio)

Subsequently, with x (the degree of dispersion/(the degree of circularity of the intervening phases×the α-phase aspect ratio) shown in Table 19 placed along the X-axis and the fracture time period in the tensile SCC property test placed along the Y-axis, measurements results of samples were plotted. The results thereof are shown in FIG. 37 as the relation between the structure parameters and the tensile SCC property test results (fracture time periods).

Figure 37:
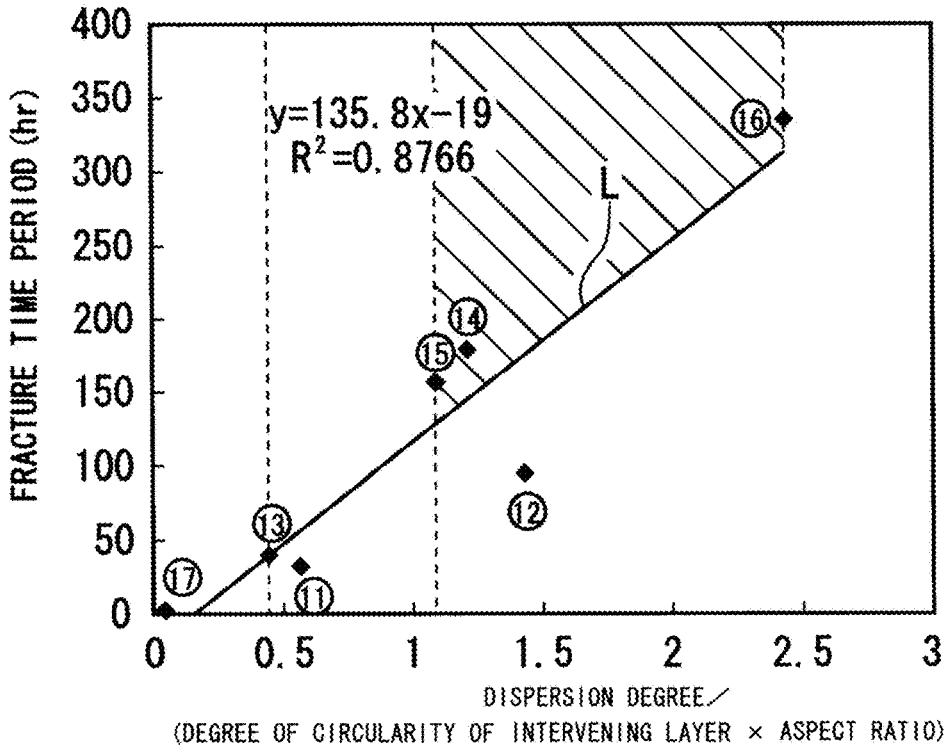
FIG. 37 is a graph showing the relation between texture parameters and the fracture time period at the time of the tensile induction test.

It can be understood from FIG. 37 that when x (the degree of dispersion/(the degree of circularity of the intervening phases×the α-phase aspect ratio) was 0.5 or more, with Comparative Example 13 as a criterion, present invention products 15 and 16 had more excellent stress corrosion cracking resistance (fracture time period) than other comparative examples. That is to say, it was confirmed from the regression line L of the measurement results plotted that alloys satisfying relational expressions X≥0.5 and Y≥135.8X−19 could fulfill the stress corrosion cracking resistance the same as or more than that of Comparative Example 13. Furthermore, brass alloys having a value of 1.09, which is the value of x of present invention product 15, or more, i.e. structure parameters of the degree of dispersion/(the degree of circularity of the intervening phases×the α-phase aspect ratio) satisfying a relational expression X≥1.09 (brass alloys falling within a region shown by hatching in FIG. 37) are more desirable brass alloys. Incidentally, though Comparative Example 14 is plotted in the figure at the position satisfying the relational expression, since Comparative Example 14 (Comparative Example 13) is the same as Comparative Example 1 in Table 18 and exhibits a low Sn content, it falls outside the premise of the present invention containing a high Sn content.

As described above, it was found that the degree of dispersion/(the α-phase aspect ratio×the degree of circularity of the intervening phases) and tensile SCC fracture time period have high correlation, and the correlation could be found out as the parameters showing the uniform dispersion of the γ phases. By setting the parameters to be appropriate values, it is possible to distribute the anode sections and cathode sections in an alloy with a proper balance and to uniformly distribute the γ phases. Thus, the leadless brass alloy of the present invention has the γ phases dispersed uniformly in the alloy structure and enables the anode-cathode reaction to substantially uniformly proceed on the alloy surface by the γ phases reacting as the anode sections and the α phases reacting as the cathode sections.

EXAMPLE 12

"Evaluation by Maximum Corrosion Depth/Average Corrosion Depth"

Figure 38:
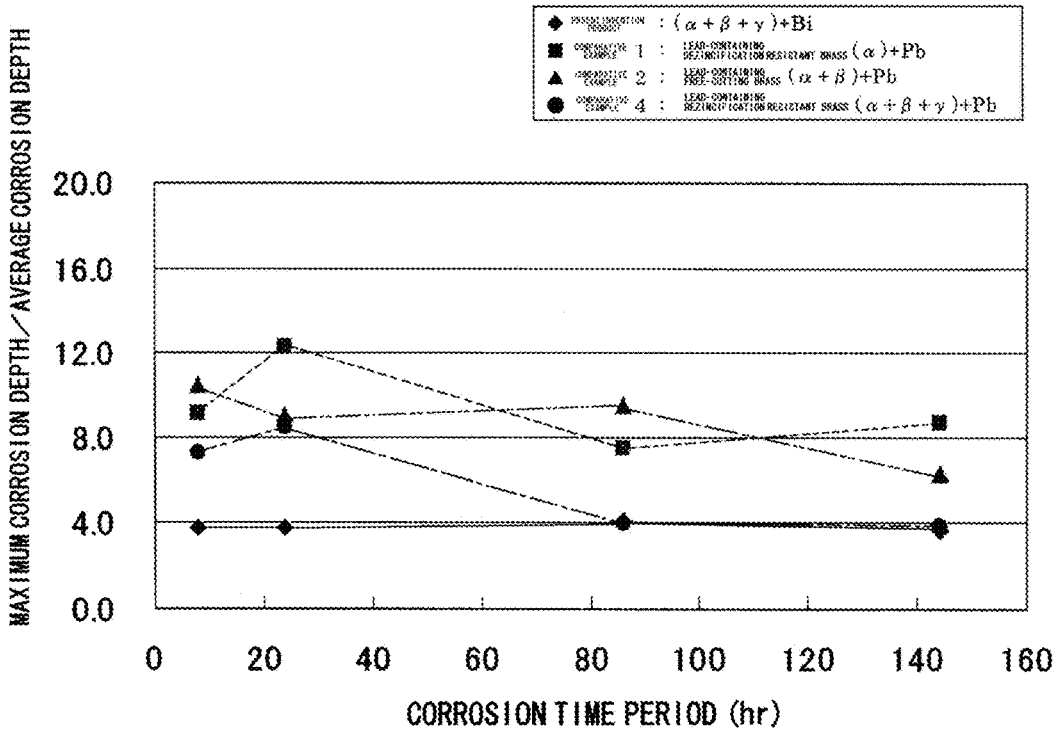
FIG. 38 is a graph showing the relation between the corrosion time period and the maximum corrosion depth/the average corrosion depth.

Next, the stress corrosion cracking resistance of the brass alloy of the present invention will be analyzed from the standpoint of a corrosion state. Brass alloys having chemical component values shown in Table 20 were prepared, the maximum corrosion depths and average corrosion depths of the present invention product and Comparative Examples 1, 2 and 4 were actually measured in Example 11 described later, and the ratio of the maximum corrosion depth/the average corrosion depth was quantified and used as a state of suppression of local corrosion. The ratios of the maximum corrosion depths/the average corrosion depths of the present invention product and Comparative Examples 1, 2 and 4 shown in Table 20 are shown in Table 21 and FIG. 38. The crystal structure of the present invention product was (α+β+γ)+Bi, and Comparative Example 1 is a lead-containing dezincification resistant brass having a crystal structure of (α)+Pb, Comparative Example 2a lead-containing free-cutting brass having a crystal structure of (α+β)+Pb and Comparative Example 4 a lead-containing dezincification resistant brass having a crystal structure of (α+β+γ)+Pb.

TABLE 20

| Material | | Cu | Pb | Fe | Sn | Bi | Se | Ni | P | Sb | Zn |
|---|---|---|---|---|---|---|---|---|---|---|---|
| Present invention product | (α + β + γ) + Bi | 60.4 | — | 0.0 | 1.6 | 1.4 | 0.03 | 0.2 | 0.0 | 0.09 | Bal. |
| Comp. Ex. | 1. Lead-containing dezincification resistant brass (α) + Pb | 62.4 | 2.6 | 0.1 | 0.3 | 0.0 | — | 0.1 | 0.1 | — | Bal. |
| | 2. Lead-containing free-cutting brass (α + β) + Pb | 59.4 | 3.1 | 0.1 | 0.3 | 0.0 | — | 0.1 | 0.0 | — | Bal. |
| | 4. Lead-containing dezincification resistant brass (α + β + γ) + Pb | 61.3 | 1.9 | 0.1 | 1.1 | 0.0 | — | 0.1 | 0.1 | — | Bal. |

TABLE 21

| Corrosion time period (h) | Present invention product | Comp. Ex. 1 | Comp. Ex. 2 | Comp. Ex. 4 |
|---|---|---|---|---|
| 8 | 3.9 | 9.2 | 10.5 | 7.4 |
| 24 | 3.8 | 12.3 | 9.0 | 8.6 |
| 86 | 4.2 | 7.6 | 9.5 | 4.0 |
| 144 | 3.8 | 8.8 | 6.3 | 4.0 |
| Rupture time period | 157.3 (h) | 41.7 (h) | 21.3 (h) | 33.2 (h) |
| Coefficient of fluctuation | 110% | 163% | 166% | 212% |

In Table 21, the alloy assumes general corrosion in proportion as the ratios of the maximum corrosion depths/the average corrosion depths are close to 1. The present invention product has a small ratio and exhibits a small variation in corrosion time periods. On the other hand, Comparative Examples 1, 2 and 4 have relatively large ratios and exhibit large variations in corrosion time periods. It can be understood from these tendencies that the present invention product assumes general corrosion and exhibits no variation of corrosion configuration in the corrosion time periods.

The same tensile SCC property test as in Example 12 described later was performed in a 14% ammonia atmosphere and under a load stress of 50 MPa. As a result, as shown in Table 21, the present invention product ruptured in 157.3 hours, Comparative Example 1 in 41.7 hours, Comparative Example 2 in 21.3 hours and Comparative Example 4 in 33.2 hours. It is conceivable from these results that in the comparative examples the initial corrosion state up to about the corrosion time period of 24 hours is related to the fracture time period. Comparing the ratios of the maximum corrosion depths/the average corrosion depths, that of the present invention product is in the range of 3.8 to 4.2 and those of Comparative Examples 1, 2 and 4 all exceed the above range. When Comparative Example 1 exhibiting the longest fracture time period is used as a target for comparison, the ratio of the maximum corrosion depth/the minimum corrosion depth in comparative example is in the range of 1 to 8.6. This corrosion at the initial stage is likely to become a source of cracks. In addition, since corrosion becomes large in a long period of time, a decision is hard to make. Therefore, the comparisons at the initial stage up to 24 hours enable the test materials to be accurately evaluated.

Therefore, when the brass alloy of the present invention is in a general corrosion state in which the ratio of the maximum corrosion depth/the average corrosion depth in a corrosion time period of 24 hours falls in the range of 1 to 8.6, it can exhibit the stress corrosion cracking resistance the same as or more than the comparative examples in a 14% ammonia atmosphere under a load stress of 50 MPa. Furthermore, more preferable state is a general corrosion state in which the ratio of the maximum corrosion depth/the average corrosion depth obtained from the test result for the present invention product in 24 hours falls in the range of 1 to 3.8. In addition, when the time period up to the fracture is a target for evaluation, it is better from the results of Table 21 that the ratio of the maximum corrosion depth/the average corrosion depth falls in the range of 1 to the maximum value of 6.4 inclusive.

Incidentally, the degree of variability obtained from calculation of the maximum corrosion depth/the average corrosion depth (maximum value/minimum value)×100 in a corrosion time period of 144 hours is 110% in the present invention product, about 163% in Comparative Example 1, 166% in Comparative Example 2 and about 212% in Comparative Example 4 as shown in Table 21, indicating that the percentage in the present invention product is smaller than those of the comparative examples. Moreover, the value of the maximum corrosion depth/the average corrosion depth in the initial stage of corrosion state up to 24 hours in the present invention product is smallest among the four test pieces. Therefore, the present invention product is in a general corrosion state in which the degree of variability is 110% or less and continuously holds a state in which the maximum corrosion depth is small even during the passage of time to suppress local corrosion.

EXAMPLE 13

"Evaluation by Variation Coefficient"

Subsequently, when it is thought that a general corrosion configuration can be obtained when a variation in corrosion depth is small, root-mean-square deviations showing data variations relative to the corrosion depths and average values of the present invention product and comparative examples are obtained, and the evaluation by the variation coefficient is analyzed. However, since the root-mean-square deviations of different groups cannot simply be compared, the variations in corrosion depth have been compared using the variation coefficient. As the variation coefficient, a value obtained by dividing the root-mean-square deviation of the corrosion depths in a prescribed range by the value of the average corrosion depth in the range has been used to enable the provision of the criterion of the corrosion depths when comparing alloys. Therefore, the variation coefficients were compared to compare variations in corrosion depth of the present invention product and comparative examples that were different groups.

Figure 39:
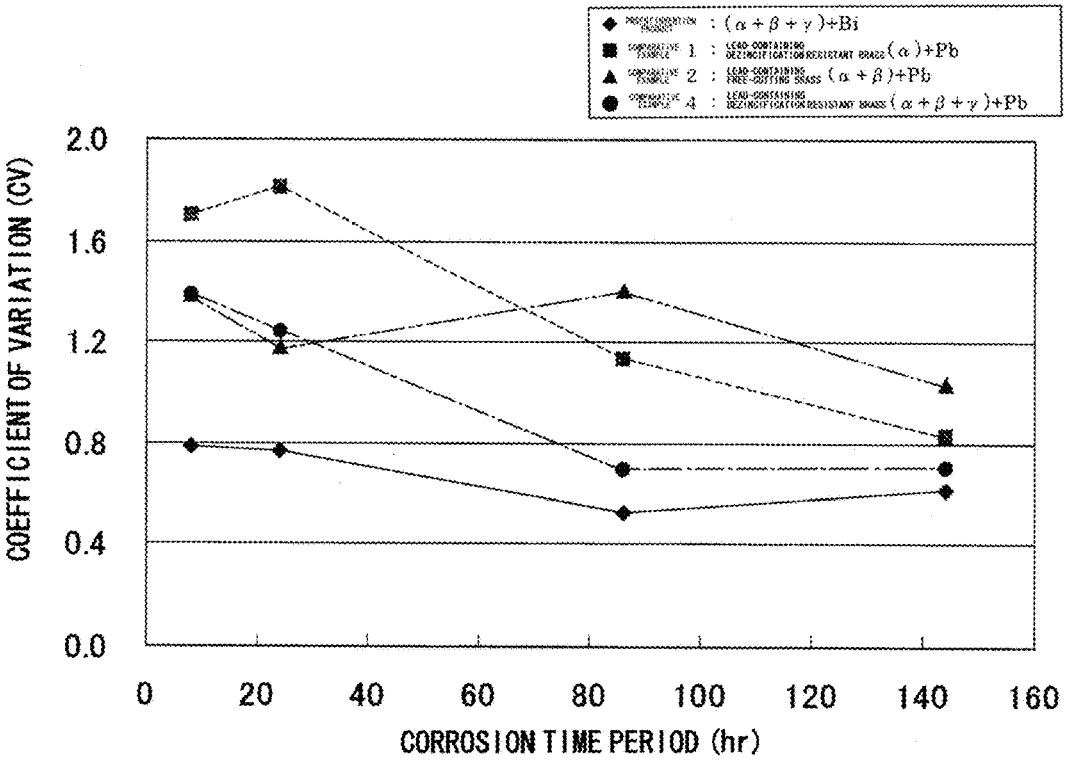
FIG. 39 is a graph showing the relation between the corrosion time period and the variation coefficient.

As regards the present invention product and Comparative Examples 1, 2 and 4, the variation coefficients obtained by dividing the root-mean-square deviations measured, with the corrosion depth as n=30, by the average corrosion depth values are shown in Table 22 and FIG. 39.

TABLE 22

| Corrosion time period(hr) | Present invention product | Comp. Ex. 1 | Comp. Ex. 2 | Comp. Ex. 4 |
|---|---|---|---|---|
| 8 | 0.79 | 1.70 | 1.39 | 1.39 |
| 24 | 0.77 | 1.81 | 1.18 | 1.25 |
| 86 | 0.53 | 1.14 | 1.41 | 0.70 |
| 144 | 0.62 | 0.83 | 1.04 | 0.71 |

In Table 22 and FIG. 39, similarly to the case of comparison of the maximum corrosion depths/the average corrosion depths, the value of the variation coefficient of the present invention product up to the corrosion time period of 24 hours is in the range of 0.77 to 0.79. Thus, since the variation in variation coefficient is small, a variation in corrosion depth is small, indicating that the corrosion proceeds uniformly.

On the other hand, the variation coefficient is 1.70 to 1.81 in Comparative Example 1, 1.18 to 1.39 in Comparative Example 2 and 1.25 to 1.39 in Comparative Example 4 and thus, in each of the comparative examples, the variation in variation coefficient is larger than that of the present invention product, from which it can be understood that the corrosion is in a local corrosion configuration. Similarly to the above, when Comparative Example 2 is a target for comparison, the variation coefficient of Comparative Example 2 in the corrosion time period of 24 hours is 1.18. Therefore, when the brass alloy of the present invention assumes a corrosion configuration in which the variation coefficient during the corrosion time period of 24 hours is larger than 0 and not more than 1.18, it can exhibit stress corrosion cracking resistance the same as or more than that in the comparative examples in a 14% ammonia atmosphere under a load stress of 50 MPa.

Furthermore, the more preferable variation coefficient is 0.77, which is the test result of the present invention product in 24 hours, or less. In addition, when the time period up to the fracture is a target for evaluation, it is good from Table 22 that the maximum value of the variation coefficient is 0.62. As described above, the corrosion state can be quantified from the maximum corrosion depth/the average corrosion depth and the variation coefficient and thus it is possible to make a comparison of the corrosion states quantified by the different comparison means.

Next, examples will be described with reference to figures in respect of a corrosion configuration evaluation test and a stress corrosion cracking test of the brass alloy of the second invention excellent in stress corrosion cracking resistance.

EXAMPLE 14

Figure 40:
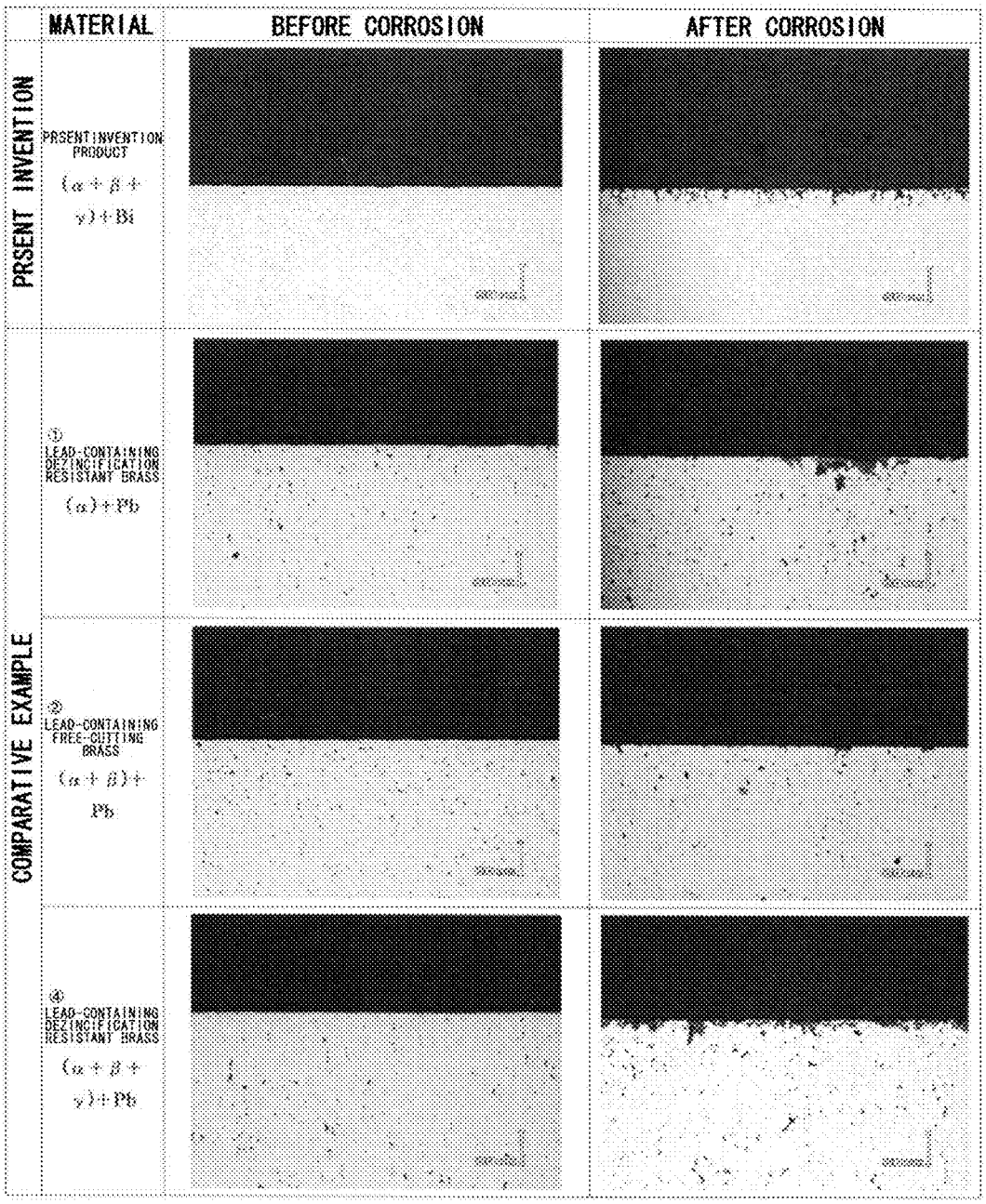
FIG. 40 shows microstructure cross-sectional photographs depicting the brass materials of the present invention and comparative examples before and after a corrosion test.

First, the difference in corrosion configuration between the brass alloy of the present invention and a conventional brass alloy under a condition of stress corrosion will be examined. In order to examine the difference in corrosion configuration of the brass materials in an atmosphere of stress corrosion cracking, the present invention product and Comparative Examples 1, 2 and 4 shown in Table 20 were disposed in a desiccator having a 14% ammonia atmosphere and the cross sections of the microstructures thereof taken at 200 magnifications were then observed. The microstructure cross sections assumed before and after the corrosion test are shown in FIG. 40. As a result, since the conditions of suppression of local corrosion and corrosion over the whole surface of the surface layer were found, the corrosion configuration of the present invention product was confirmed as uniform corrosion. On the other hand, those of Comparative Examples 1 and 2 can be decided as local corrosion because these comparative examples are locally corroded. In addition, while Comparative Example 4 is uniformly corroded, since deep corrosion partially exists, the comparative example becomes in a state close to local corrosion.

EXAMPLE 15

The difference in corrosion configuration by the difference in chemical component value was confirmed in Example 10. Next, however, in order to specify the intervening phase preferentially corroded in a stress corrosion cracking atmosphere, a corrosion test was performed with respect to the Bi-containing brass having an (α+β+γ) structure configuration (present invention product and the Pb-containing brass (Comparative Example 4).

Figure 41:
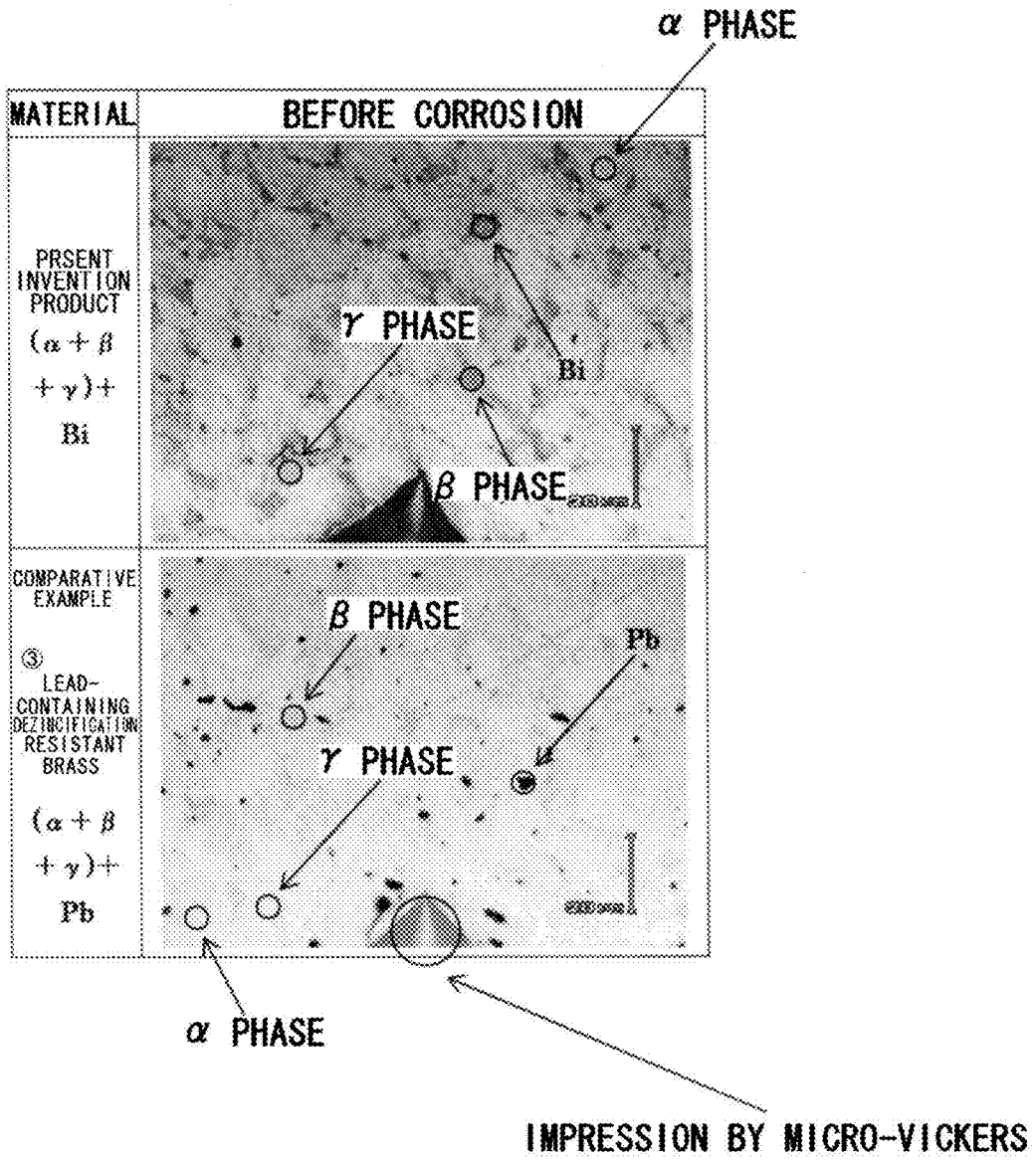
FIG. 41 shows photographs depicting the surface layer structures of the brass materials of the present invention and comparative example before being corroded.
Figure 42:
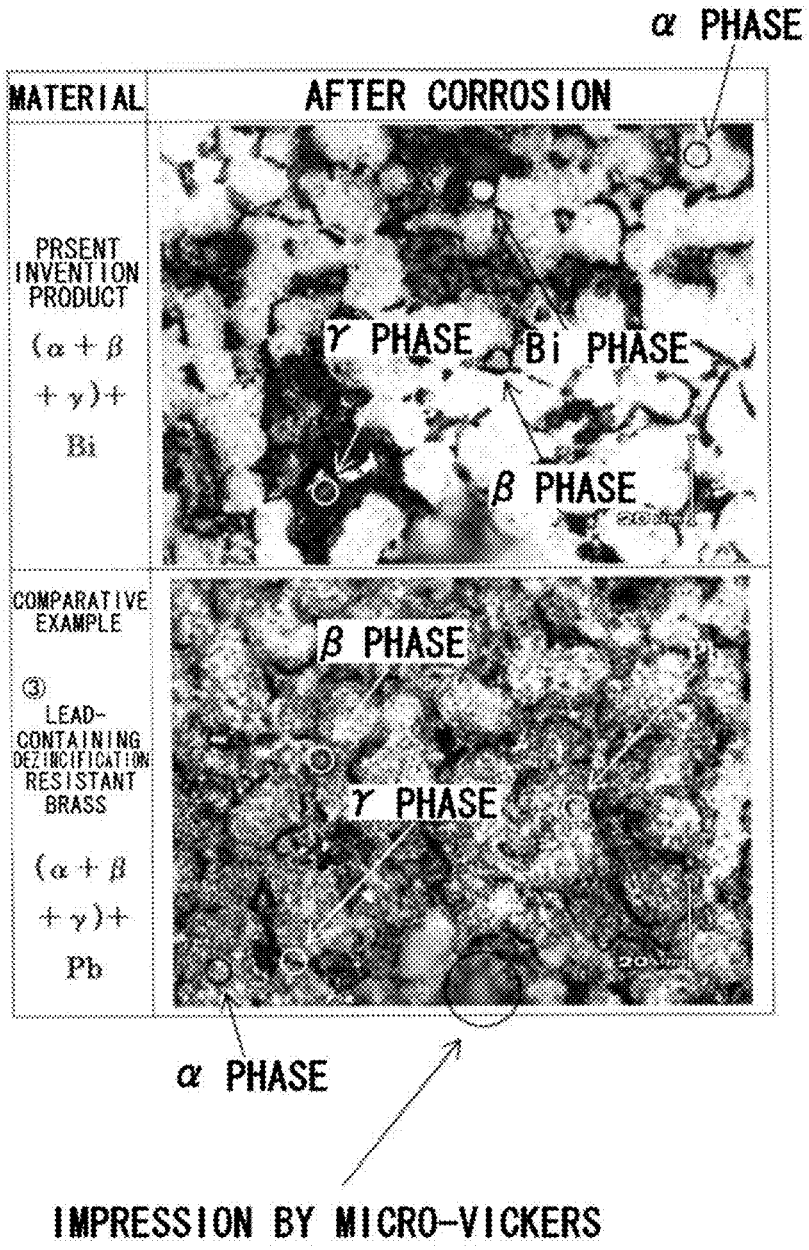
FIG. 42 shows photographs depicting the surface layer structures of the brass materials of the present invention and comparative example after being corroded.

The test comprised leaving the present invention product and Comparative Example 4 standing in a 14% ammonia atmosphere for 24 hours and observing the surfaces thereof before and after corrosion. At this time, in order to specify the intervening phases to be corroded, impressions were applied to the surfaces by a micro-Vickers tester so as to enable the same places to be observed at the same places. Photographs taken at 1000 magnifications before corrosion are shown in FIG. 41 and photographs after corrosion in FIG. 42. As a result, it was observed that the γ phase of the present invention product and the γ phase and Pb of Comparative Example 4 were corroded. On the other hand, no corrosion of the β phase and Bi phase was observed. It was consequently confirmed that the intervening phases preferentially corroded in comparison with the α phase were the γ phase and Pb phase. It was particularly confirmed that the γ phase was preferentially corroded in comparison with the Pb phase.

Figure 43:
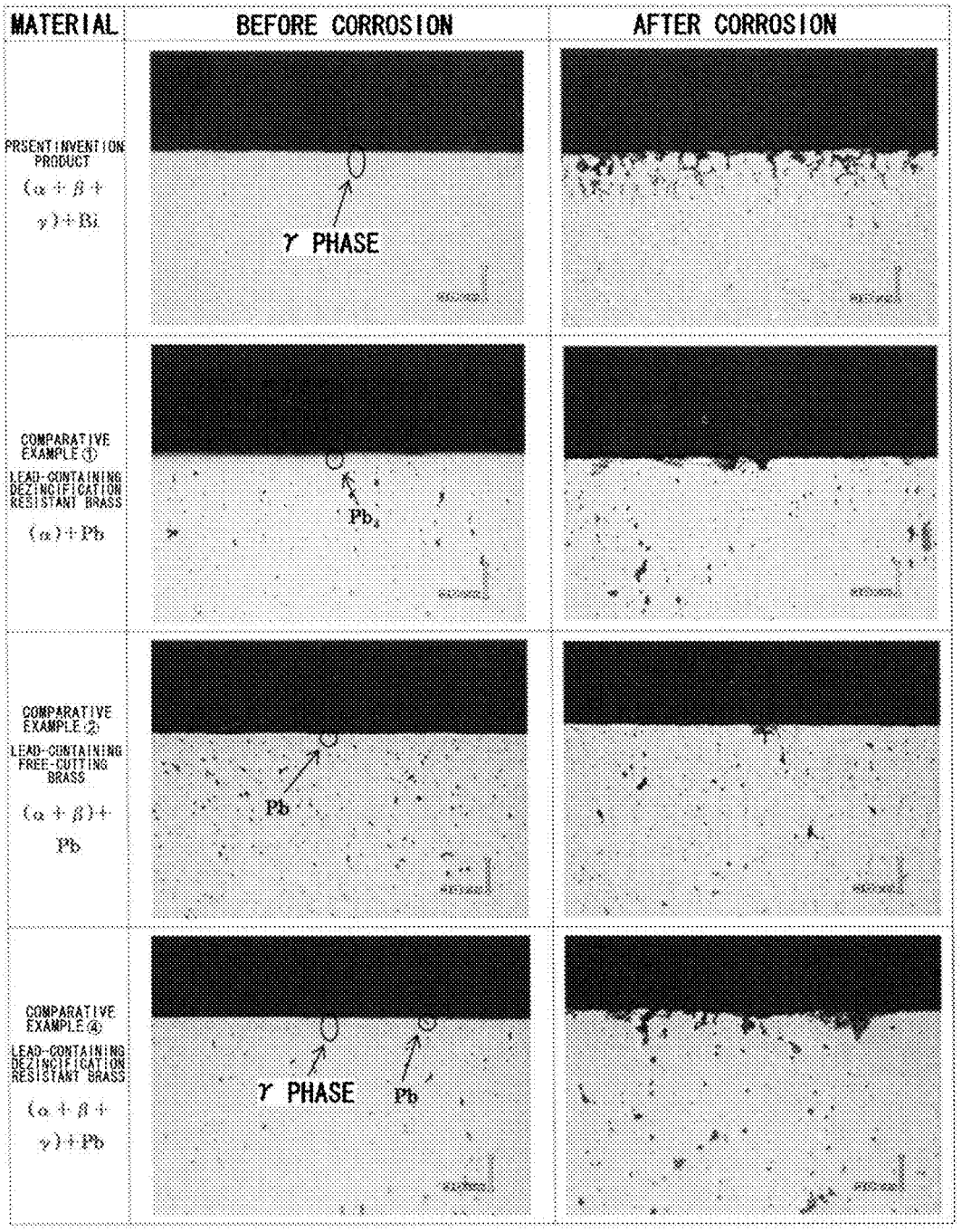
FIG. 43 shows enlarged photographs depicting cross-sectional microstructures.

Furthermore, cross sections of the microstructures of the present invention product and Comparative Examples 1, 2 and 4 were photographed at 400 magnifications. The results thereof are shown in FIG. 43. In the structure of the present invention product before corrosion, the γ phases are uniformly distributed on the surface layer. On the other hand, the Pb is distributed in the vicinity of the surface layers in the Comparative Examples 1 and 2 and, in Comparative Example 4, the Pb and γ phases were distributed. Also, in the present invention product after corrosion, the γ phases are uniformly corroded. On the other hand, the Pb in the vicinity of the surface layers of Comparative Examples 1 and 2 is locally corroded and, while Comparative Example 4 assumes uniform corrosion, the corrosion depth is large because the Pb and γ phases were corroded. It was verified from these facts that containing no Pb and having the γ phases distributed uniformly in the brass alloy is solving means for preventing local corrosion and attaining uniform corrosion.

EXAMPLE 16

A corrosion test was performed with respect to the present invention product and Comparative Examples 1, 2 and 4 in order to examine the relation between the corrosion time period and the corrosion depth in a stress corrosion cracking atmosphere to confirm the presence or absence of local corrosion. The test comprised placing the test pieces in a 14% ammonia atmosphere, taking out the test pieces in 8 hours, 24 hours, 86 hours and 144 hours, respectively, and measuring the corrosion depths. The measurement of the corrosion depth was performed using the dezincification corrosion depth measurement method. The measurement method comprised photographing 6 places of the microstructure of a sample (n=3) after the corrosion test at 200 magnifications, measuring the corrosion depths at equally spaced 5 points per place and calculating the average value of the 30 points. The maximum corrosion depth was measured at a point at which the corrosion depth in the microstructure image photographed was the maximum.

Figure 44:
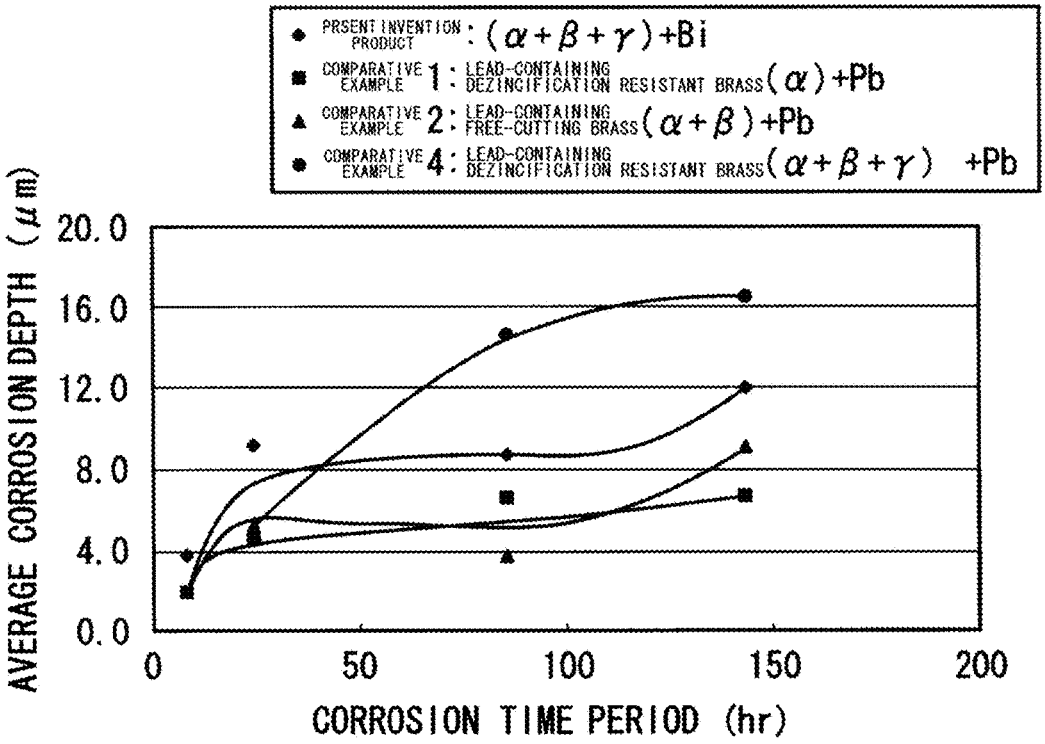
FIG. 44 is a graph showing the relation between the corrosion time period and the average corrosion depth.
Figure 45:
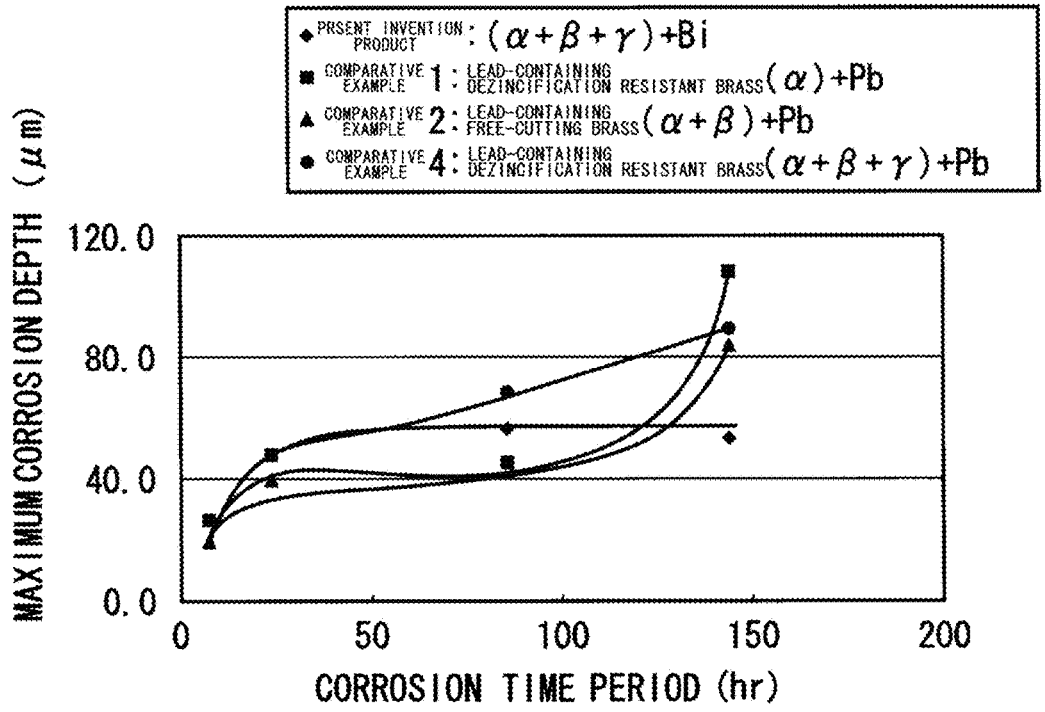
FIG. 45 is a graph showing the relation between the corrosion time period and the maximum corrosion depth.

The relation between the corrosion time period and the average corrosion depth of each alloy is shown in Table 23 and FIG. 44, and the relation between the corrosion time period and the maximum corrosion depth is shown in Table 24 and FIG. 45. In any of the alloys, the average corrosion depth becomes gradually large as time advances and, particularly, the corrosion depth of Comparative Example becomes large. In addition, though the maximum corrosion depths in Comparative examples 1, 2 and 4 become large as time advances, the maximum corrosion depth of the present invention product continues a constant corrosion depth up to 144 hours. Therefore, it was proved that the present invention product was a material difficult in inducing a crack that becomes a source of stress corrosion cracking because local corrosion was prevented even in the corrosion time period of 24 hours or thereafter since the maximum corrosion depth continued the constant corrosion depth while the average corrosion depth became gradually large as time advanced.

TABLE 23

| Corrosion time period (hr) | Present invention product | Comp. Ex. 1 | Comp. Ex. 2 | Comp. Ex. 4 |
|---|---|---|---|---|
| 8 | 4.3 | 2.5 | 2.4 | 3.4 |
| 24 | 8.3 | 3.3 | 3.3 | 5.3 |
| 86 | 13.3 | 5.8 | 5.3 | 15.4 |
| 144 | 14.3 | 6.6 | 10.0 | 17.2 |

TABLE 24

| Corrosion time period (h) | Present invention product | Comp. Ex. 1 | Comp. Ex. 2 | Comp. Ex. 4 |
|---|---|---|---|---|
| 8 | 18.2 | 26.4 | 19.1 | 29.7 |
| 24 | 49.1 | 47.6 | 39.7 | 47.6 |
| 86 | 56.4 | 48.8 | 57.3 | 67.0 |
| 144 | 59.4 | 108.2 | 83.9 | 89.1 |

EXAMPLE 17

Figure 46:
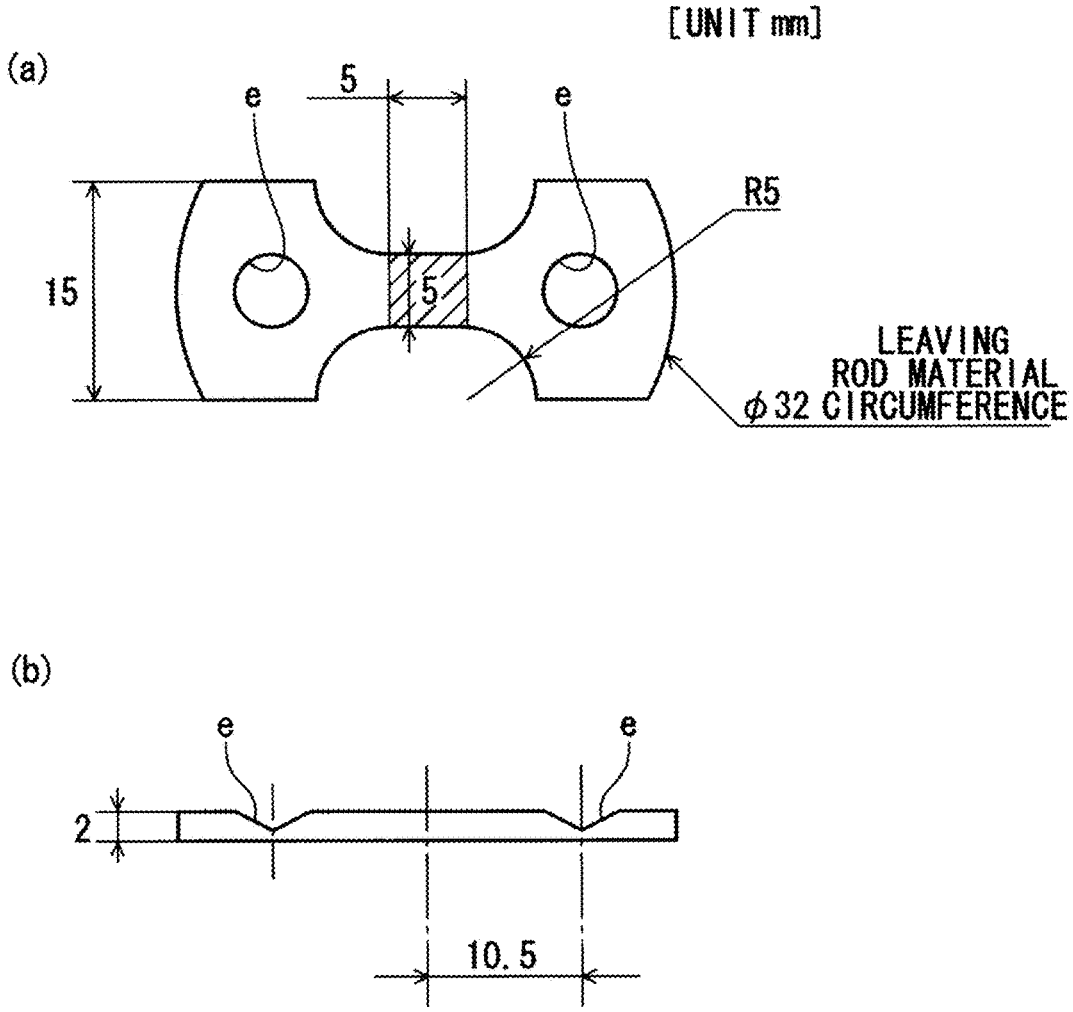
FIG. 46 schematically shows tensile test pieces.
Figure 49:
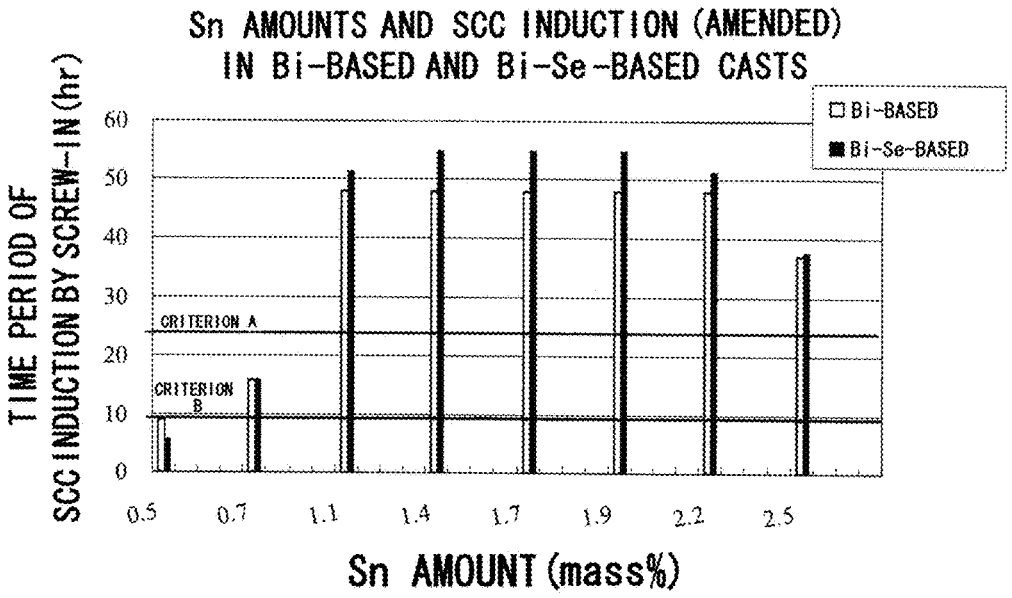
FIG. 49 is a graph showing the relation between the Sn amount and the SCC induction in Bi-based and Bi—Se-based casts.

In order to quantitatively evaluate the stress corrosion cracking property, the time periods up to the fracture of alloys were compared. The test method comprised preparing a test piece as shown in FIG. 46, pinching concaves e on the opposite sides of the test piece with mounting jigs not shown, continuously applying a tensile load to the test piece with a tension device not shown, but provided with a spring having a spring constant of 150 N/mm until fracture and measuring a time period at which fracture was induced in a region shown by diagonal lines in FIG. 46(*a*). The fracture time period was measured through photographing the jig disposed in a desiccator with a CCD camera and confirming the image videotaped. The test conditions included an ammonia concentration of 14% and load stresses of 50 MPa, 125 MPa and 200 MPa. The present invention product and Comparative Examples 1 and 2 having the chemical component values shown in Table 18 were used as the test pieces. The results thereof are shown in FIG. 49.

Figure 47:
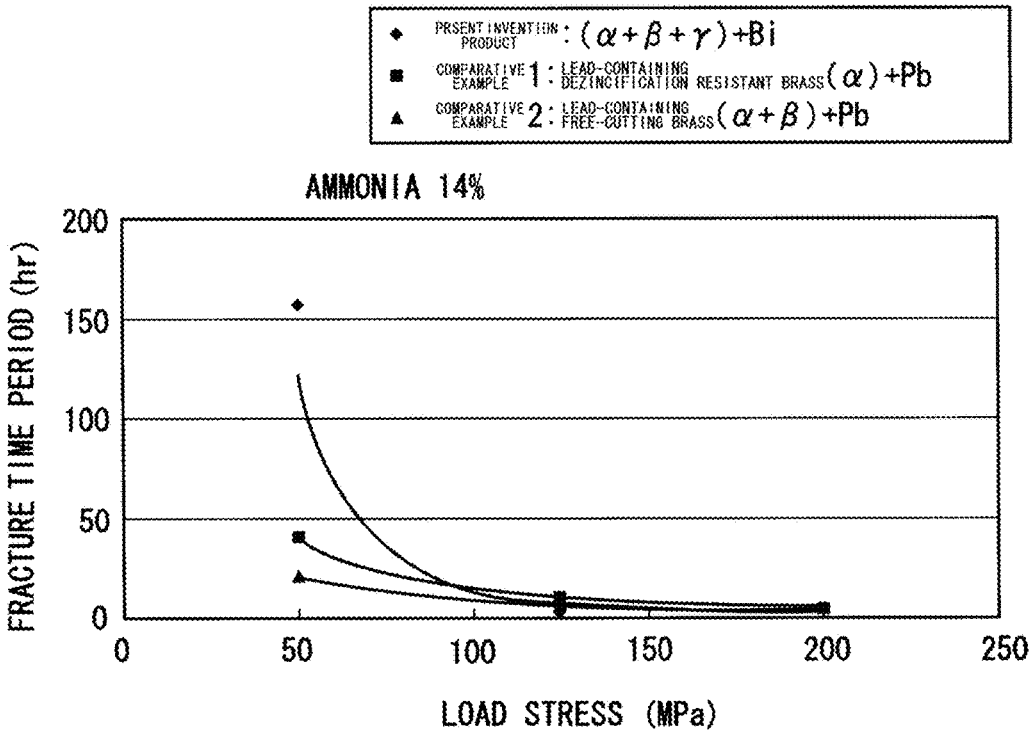
FIG. 47 is a graph showing the relation between the load stress and the fracture time period in a tensile test.
Figure 48:
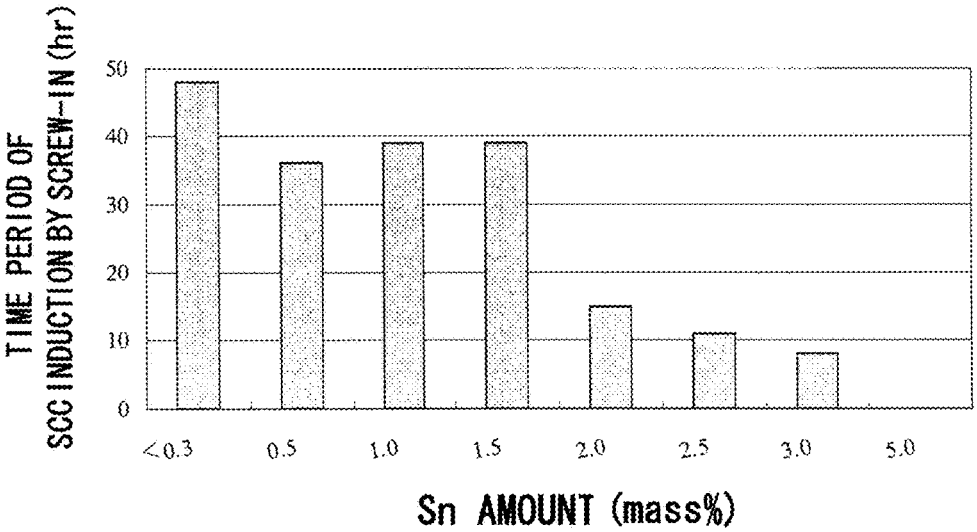
FIG. 48 is a graph showing the relation between the Sn content and the time period to induce cracks in an SCC induction test for a Pb-containing brass alloy.

FIG. 47 shows substantially the same fracture time period in all alloys under load stresses 125 MPa and 200 MPa and that the present invention product is longer in fracture time period than Comparative examples 1 and 2 under a load stress of 50 MPa and, therefore, it can be understood that the stress corrosion cracking resistance of the present invention product is enhanced. Since the influence of stress is large and cracking proceeds until fracture when cracks have been induced by corrosion under the load stresses of 125 MPa and 200 MPa, it is conceivable that no difference in material quality is induced. On the other hand, since the influence of the stress under a load stress of 50 MPa is small, it is conceivable that the corrosion configuration greatly affects the time period of induction of cracks. In the present invention product, the maximum corrosion depth becomes constant in a corrosion time period of 24 hours or thereafter and, therefore, the local corrosion is suppressed.

Thus, since the present invention product has a corrosion configuration in which the γ phases in the vicinity of the surface layer are uniformly corroded and the stress concentration is alleviated, it is possible to enhance the stress corrosion cracking resistance to a great extent if the load stress is around 50 MPa that delays the induction of cracks and makes the influence of corrosion greatly large. In addition, the observation of the microstructure of the cross section after the test revealed that the surface layer of the present invention product assumed uniform corrosion, that Comparative Examples 1 and 2 assumed local corrosion and that the relative merits of the stress corrosion cracking resistance could also be virtually confirmed.

INDUSTRIAL APPLICABILITY

The brass alloy excellent in stress corrosion cracking resistance according to the present invention can widely be applied to various fields requiring, not to mention the stress corrosion cracking resistance, cuttability, mechanical properties (tensile strength, elongation), dezincification resistance, erosion-and-corrosion resistance, resistance to cast tearing and impact resistance. In addition, the brass alloy of the present invention is used to cast ingots and provide the ingots as intermediate products, and the alloy of the present invention is worked and molded to provide parts to be wetted, building materials, electrical and mechanical parts, parts for boats and ships, hot water-related equipment, etc.

The brass alloy excellent in stress corrosion cracking resistance according to the present invention is a material advantageously befitting various kinds of members and parts in a wide range of fields, particularly including water contact parts, such as valves, water faucets, etc., namely ball valves, hollow balls for the ball valves, butterfly valves, gate valves, globe valves, check valves, stems for valves, hydrants, clasps for water heaters or warm-water-spray toilet seats, cold-water supply pipes, connecting pipes, pipe joints, refrigerant pipes, parts for electric water heaters (casings, gas nozzles, pump parts, burners, etc.), strainers, parts for water meters, parts for underwater sewer lines, drain plugs, elbow pipes, bellows, connection flanges for closet stools, spindles, joints, headers, corporation cocks, hose nipples, auxiliary clasps for water faucets, stop cocks, water-supplying, -discharging and -distributing faucet supplies, sanitary earthenware clasps, connection clasps for shower hoses, gas appliances, building materials, such as doors, knobs, etc., household electrical goods, adapters for sheath tube headers, automobile air-conditioner parts, fishing-tackle parts, microscope parts, water meter parts, measuring apparatus parts, railroad pantograph parts and other members and parts. Furthermore, the brass alloy of the present invention is widely applicable to washing things, kitchen things, bathroom paraphernalia, lavatory supplies materials, furniture parts, family room supplies materials, sprinkler parts, door parts, gate parts, automatic vending machine parts, washing machine parts, air-conditioner parts, gas welding machine parts, heat-exchanger parts, solar collector parts, metal molds and their parts, bearings, gears, construction machine parts, railcar parts, transport equipment parts, fodders, intermediate products, final products, assembled bodies, etc.

The invention claimed is:

1. A leadless brass alloy excellent in stress corrosion cracking resistance, wherein the alloy contains 59.5 to 66.0 mass% of Cu, 0.7 to 2.0 mass% of Sn, 0.5 to 2.0 mass% of Bi, 0.06 to 0.6 mass% of Sb and a balance of Zn and unavoidable impurities, wherein the unavoidable impurities contain 0.25 mass% or less of Pb, wherein the alloy has an α+γ structure and having γ phases distributed therein at a proportion to suppress a velocity of corrosion cracks propagating therein and enhance stress corrosion cracking resistance, wherein the γ phases contain Sb as a solute, and wherein a ratio of each of the γ phases to grains when the γ phases surround the grains is a grain-surrounding γ phase ratio, and a grain-surrounding average γ phase ratio that is an average value of grain-surrounding γ phase ratios is 28% or more to secure the proportion, wherein the grain-surrounding average γ phase ratio is calculated by the following grain-surrounding average γ phase ratio [%]=(γ phase length/grain boundary circumferential length)×100, Formula 1:

wherein the grain boundary circumferential length is a circumferential length of a grain boundary of the grains, and the γ phase length is a length of the γ phase existing on a circumference of the alloy.

2. The leadless brass alloy according to claim 1, wherein a number of the γ phases existing in unit length in a vertical direction of a stress load when the load is exerted onto the alloy is the number of contacting γ phases, and the number of contacting γ phases calculated from an average value and a root-mean-square deviation of the number of contacting γ phases is two or more to secure the proportion.

3. The leadless brass alloy according to claim 1, wherein the γ phases are uniformly distributed as anodes and maintain a balance relative to α phases that become cathodes.

4. The leadless brass alloy according to claim 1, wherein the alloy is in a corrosion state in which a ratio of a maximum corrosion depth from a range of an alloy surface after corrosion to an average corrosion depth in the range is 1 to 8.6.

5. The leadless brass alloy according to claim 1, wherein when a value obtained by dividing a root-mean-square deviation of a range of corrosion depth by an average corrosion depth in the range is a variation coefficient, the alloy assumes a corrosion configuration in which the variation coefficient is 1.18 or less.

* * * * *